US006329127B1

(12) United States Patent
Ito et al.

(10) Patent No.: US 6,329,127 B1
(45) Date of Patent: Dec. 11, 2001

(54) HEAT-DEVELOPABLE PHOTOSENSITIVE MATERIAL AND METHOD FOR FORMING IMAGE USING THE SAME

(75) Inventors: Tadashi Ito; Katsuyuki Watanabe; Kazunobu Katoh; Minoru Sakai, all of Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/537,764

(22) Filed: Mar. 30, 2000

(30) Foreign Application Priority Data

| | | |
|---|---|---|
| Mar. 30, 1999 | (JP) | 11-089674 |
| Mar. 30, 1999 | (JP) | 11-089882 |
| Mar. 30, 1999 | (JP) | 11-090125 |
| Oct. 1, 1999 | (JP) | 11-281747 |

(51) Int. Cl.[7] ..... G03C 1/498; G03C 1/34

(52) U.S. Cl. ..... 430/350; 430/611; 430/613; 430/614; 430/619

(58) Field of Search ..... 430/619, 611, 430/613, 614, 955, 626, 350

(56) References Cited

U.S. PATENT DOCUMENTS

| | | | | |
|---|---|---|---|---|
| 3,874,946 | | 4/1975 | Costa et al. . | |
| 5,432,287 | | 7/1995 | Kirk et al. . | |
| 5,545,515 | * | 8/1996 | Murray et al. | 430/619 |
| 5,705,324 | * | 1/1998 | Murray | 430/350 |
| 5,952,167 | * | 9/1999 | Okda et al. | 430/619 |
| 5,989,801 | * | 11/1999 | Hirosawa et al. | 430/619 |
| 6,087,086 | * | 7/2000 | Suzuki et al. | 430/617 |

* cited by examiner

*Primary Examiner*—Thorl Chea
(74) *Attorney, Agent, or Firm*—Birch, Stewart, Kolasch & Birch, LLP

(57) ABSTRACT

An object of the present invention is to provide a heat-developable photosensitive material of less heat development temperature and humidity dependency, which is unlikely to be affected by uneven temperature distribution in heat development apparatuses and humidity condition, and can stably form uniform images, in particular, a heat-developable photosensitive material of improved stability of coating solutions overtime, which can form uniform ultra-high contrast images without unevenness, which are suitable for mechanical processes, and exhibit suppressed fluctuation of photographic performance depending on the storage condition. According to the present invention, there is provided a heat-developable photosensitive material having at least one photosensitive image-forming layer comprising an organic silver salt, a photosensitive silver halide, a reducing agent and an organic binder, wherein at least one of the photosensitive image-forming layer and a layer adjacent to the photosensitive image-forming layer contains a first halogen-releasing precursor having at least one dissociative or hydrophilic substituent and a second hydrophobic halogen-releasing precursor.

15 Claims, 1 Drawing Sheet

HEAT-DEVELOPABLE PHOTOSENSITIVE MATERIAL AND METHOD FOR FORMING IMAGE USING THE SAME

FIELD OF THE INVENTION

The present invention relates to a heat-developable photosensitive material, wherein an image is obtained by development with heating without using development processing solutions, in particular, a heat-developable photosensitive material for scanners and image setters, which is suitable for photomechanical processes. More specifically, the present invention relates to a heat-developable photosensitive material for photomechanical processes, which exhibits high Dmax (maximum density), low fog and less increase of fog and sensitivity fluctuation during storage before light exposure as well as less Dmax (maximum density) fluctuation and less sensitivity fluctuation due to humidity in a development environment, and can afford images suitable for photomechanical process applications.

BACKGROUND OF THE INVENTION

A large number of photosensitive materials are known which have a photosensitive layer on a support and form image by imaging exposure. An example of a system that enables environmental conservation or simplification of image formation includes a technique of forming an image by heat development.

In recent years, reduction of amount of waste processing solutions is strongly desired in the field of photomechanical processes from the standpoints of environmental protection and space savings. Techniques relating to photosensitive heat-developable materials for use in photomechanical processes are required which enables efficient exposure by a laser scanner or a laser image setter and formation of a clear black image having high resolution and sharpness. The heat-developable photosensitive materials can provide users with a simple and non-polluting heat development processing system that eliminates the use of solution-type processing chemicals.

Methods for forming an image by heat development are described in, for example, U.S. Pat. Nos. 3,152,904, 3,457,075 and D. Klosterboer, Imaging Processes and Materials, "Thermally Processed Silver Systems", 8th ed., Chapter 9, page 279, compiled by J. Sturge, V. Walworth and A. Shepp, Neblette (1989). The photosensitive material contains a reducible light-insensitive silver source (e.g., organic silver salt), a photocatalyst (e.g., silver halide) in a catalytically active amount, and a reducing agent for silver, which are usually dispersed in an organic binder matrix. This photosensitive material is stable at an ambient temperature, but when the material is heated at a high temperature (e.g., 80° C. or higher) after light exposure, silver is produced through an oxidation-reduction reaction between the reducible silver source (which functions as an oxidizing agent) and the reducing agent. The oxidation-reduction reaction is accelerated by catalytic action of a latent image generated upon exposure. The silver produced by the reaction of the reducible silver salt in the exposure region provides a black image and this presents a contrast to the non-exposure region to form an image.

Since such image formation methods require no processing solutions such as developers, and provides images only by heating, i.e., without generating sulfur dioxide gas or ammonia gas. Therefore, those materials have become to attract much attention as recording materials that can be used with image-drawing apparatuses utilizing laser light and so forth. Laser image-drawing apparatuses are used in many fields. For example, they are used in image-forming apparatuses for medical use, image-forming apparatuses for photomechanical processes, image-drawing apparatuses for industrial use and so forth.

Those heat-developable recording materials are usually require heating time of 10 to 60 seconds at a temperature of 100° C. or higher.

Various heat development apparatuses have been proposed. For example, there have been known a method utilizing contact of a photosensitive material with a heat plate or a heat roller to attain heating by heat conduction, a method utilizing radiation heating by passing a photosensitive material through an oven, a method utilizing heat generation inside a layer of photosensitive material caused by electromagnetic wave, a method utilizing heat generation of resistive materials (carbon black etc.) upon applying an electric current, and so forth. Whichever method is employed, it is very important to maintain the whole surface of photosensitive material at the same temperature, and heat development apparatuses are variously devised for this purpose. However, it is actually impossible to keep the material within a temperature distribution within a temperature difference of less than ±0.5° C. The development may be performed for a wide area, for example, A1 or B1 size, for photosensitive materials used for mechanical processes. In such a case, in particular, it becomes still difficult to maintain a uniform temperature distribution. Therefore, it is desired for photosensitive materials to be used to have large latitude for the fluctuation of heat development temperature.

In recent years, as a heat-developable recording material for mechanical processes, materials utilizing transmission phenomenon by an ultrahigh contrast agent are under development. However, it has been found that such materials have a problem that fluctuation of development temperature causes extremely large fluctuation of the degree of ultrahigh contrast. If the degree of ultrahigh contrast is fluctuated, the size of half tone dot area or a line thickness will be fluctuated. Therefore, basic performance as a heat-developable recording material may not be obtained. In order to enable to use such heat-developable recording materials for that field, it is a very important theme to improve performance fluctuation depending on heat development temperature.

A still more important theme for heat-developable recording materials is improvement of storage stability. Because heat-developable recording materials also contain regents required for image development in a photosensitive layer beforehand, they cause deterioration such as increase of fog, reduction of photographic sensitivity and so forth. Therefore, they suffer from the drawback of extremely short shelf life.

As high contrast agents for forming high contrast images, there have been known the acylhydrazine derivatives disclosed in U.S. Pat. Nos. 5,464,738, 5,512,411, 5,496,695 and 5,536,622, the acrylonitrile derivatives disclosed in U.S. Pat. Nos. 5,545,515 and 5,635,339, the malondialdehydes disclosed in U.S. Pat. No. 5,654,130, the isoxazoles disclosed in U.S. Pat. No. 5,705,324 and so forth. As methods for accelerating the development, there has been disclosed addition of certain materials into image-forming layers together with the ultrahigh contrast agents, and such materials include the amine compounds disclosed in U.S. Pat. No. 5,545,505, the hydroxamic acids disclosed in U.S. Pat. No. 5,545,507, the hydrogen donors disclosed in U.S. Pat. No. 5,637,449 and so forth.

SUMMARY OF THE INVENTION

The object of the present invention is to provide an improved heat-developable photosensitive material. More specifically, an object of the present invention is to provide a heat-developable photosensitive material of less heat development temperature and humidity dependency, which is unlikely to be affected by uneven temperature distribution in heat development apparatuses and humidity condition, and can stably form uniform images, in particular, a heat-developable photosensitive material of improved stability of coating solutions overtime, which can form uniform ultra-high contrast images without unevenness, which are suitable for mechanical processes, and exhibit suppressed fluctuation of photographic performance depending on the storage condition. Another object of the present invention is to provide a heat-developable photosensitive material that enables to obtain images of low fog, which suffer from less increase of fog and less sensitivity fluctuation caused during storage before light exposure, in particular, for photomechanical processes, especially for scanners and image setters, and further enables to obtain images of high Dmax (maximum density) particularly suitable for photomechanical process applications. A still further object of the present invention is to provide a heat-developable photosensitive material that can be obtained by aqueous coating, which is advantageous in view of environmental protection and cost saving.

According to the present invention, there is provided a heat-developable photosensitive material having at least one photosensitive image-forming layer comprising an organic silver salt, a photosensitive silver halide, a reducing agent and an organic binder, wherein at least one of the photosensitive image-forming layer and a layer adjacent to the photosensitive image-forming layer contains a first halogen-releasing precursor having at least one dissociative or hydrophilic substituent and a second hydrophobic halogen-releasing precursor.

Preferably, the first halogen-releasing precursor is preferably a compound represented by the following formula (1).

(1)

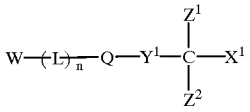

In the formula (1), $Z^1$ and $Z^2$ each independently represent a halogen atom, $X^1$ represents hydrogen atom or an electron withdrawing group, $Y^1$ represents —CO— group or —$SO_2$— group, Q represents an arylene group or a divalent heterocyclic group, L represents a linking group, W represents carboxyl group or a salt thereof, slufo group or a salt thereof, phosphoric acid group, hydroxyl group, a quaternary ammonium group, or a polyethyleneoxy group, and n represents 0 or 1.

Preferably, the second halogen-releasing precursor is a compound represented by the following formula (2).

(2)

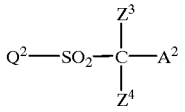

In the formula (2), $Q^2$ represents an aryl group or a heterocyclic group, $Z^3$ and $Z^4$ each independently represent a halogen atom, and $A^2$ represents hydrogen atom or an electron withdrawing group.

Preferably, the heat-developable photosensitive material of the present invention is prepared by using a solution of the first halogen-releasing precursor.

Preferably, the heat-developable photosensitive material of the present invention is prepared by using a solid dispersion of the second halogen-releasing precursor.

Preferably, the heat-developable photosensitive material of the present invention is prepared by using a solution of the first halogen-releasing precursor, a solid dispersion of the second halogen-releasing precursor and a solid dispersion of the reducing agent.

Preferably, the heat-developable photosensitive material of the present invention contains the second halogen-releasing precursor in the photosensitive image-forming layer and the first halogen-releasing precursor in a non-image-forming layer adjacent to the photosensitive image-forming layer.

Preferably, the heat-developable photosensitive material of the present invention further contains, on the side of a support provided with the image-forming layer, at least one kind of compound represented by the following formula (S).

(S)

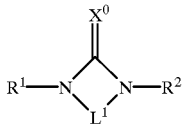

In the formula (S), $X^O$ represents oxygen atom or =NH group. $R^1$ and $R^2$ each independently represent hydrogen atom, an acyl group, a hydrocarbon group or a carbamoyl group. When $X^O$ is oxygen atom, at least one of $R^1$ and $R^2$ is hydrogen atom. $L^1$ represents a divalent organic group necessary for forming acyclic structure.

Preferably, the heat-developable photosensitive material of the present invention further contains, on the side of a support provided with the image-forming layer, at least one kind of nucleating agent.

Preferably the nucleating agent preferably consists of one or more kinds of compounds selected from a substituted alkene derivative represented by the following formula (3), a substituted isoxazole derivative represented by the following formula (4), and a particular acetal compound represented by the following formula (5).

(3)

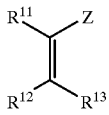

-continued (4)

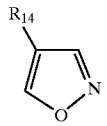

(5)

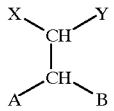

In the formula (3), $R^{11}$, $R^{12}$ and $R^{13}$ each independently represents hydrogen atom or a substituent, and Z represents an electron withdrawing group or a silyl group. In the formula (3), $R^{11}$ and Z, $R^{12}$ and $R^{13}$, $R^{11}$ and $R^{12}$, or $R^{13}$ and Z may be combined with each other to form a ring structure.

In the formula (4), $R^{14}$ represents a substituent.

In the formula (5), X and Y independently represent hydrogen atom or a substituent, A and B each independently represent an alkoxy group, an alkylthio group, an alkylamino group, an aryloxy group, an arylthio group, an anilino group, a heterocyclyloxy group, a heterocyclylthio group or a heterocyclylamino group, and X and Y, or A and B may be combined with each other to form a ring structure.

Preferably, the heat-developable photosensitive material of the present invention is prepared by adding the organic binder as an aqueous dispersion of a thermoplastic resin.

Preferably, the organic binder comprises a latex of a polymer having a glass transition temperature of −30 to 40° C. in an amount of at least 50% by weight.

According to another aspect of the present invention, there is provided a method for forming an image, which comprises the steps of heating the aforementioned heat-developable photosensitive material of the present invention at a temperature of 80° C. to a temperature lower than 120° C. for 5 seconds or more in such a way that an image is not formed, and subjecting the heat-developable photosensitive material to heat development at a temperature of 110° C. or higher to form an image.

PREFERRED EMBODIMENT OF THE INVENTION

Figure 1:
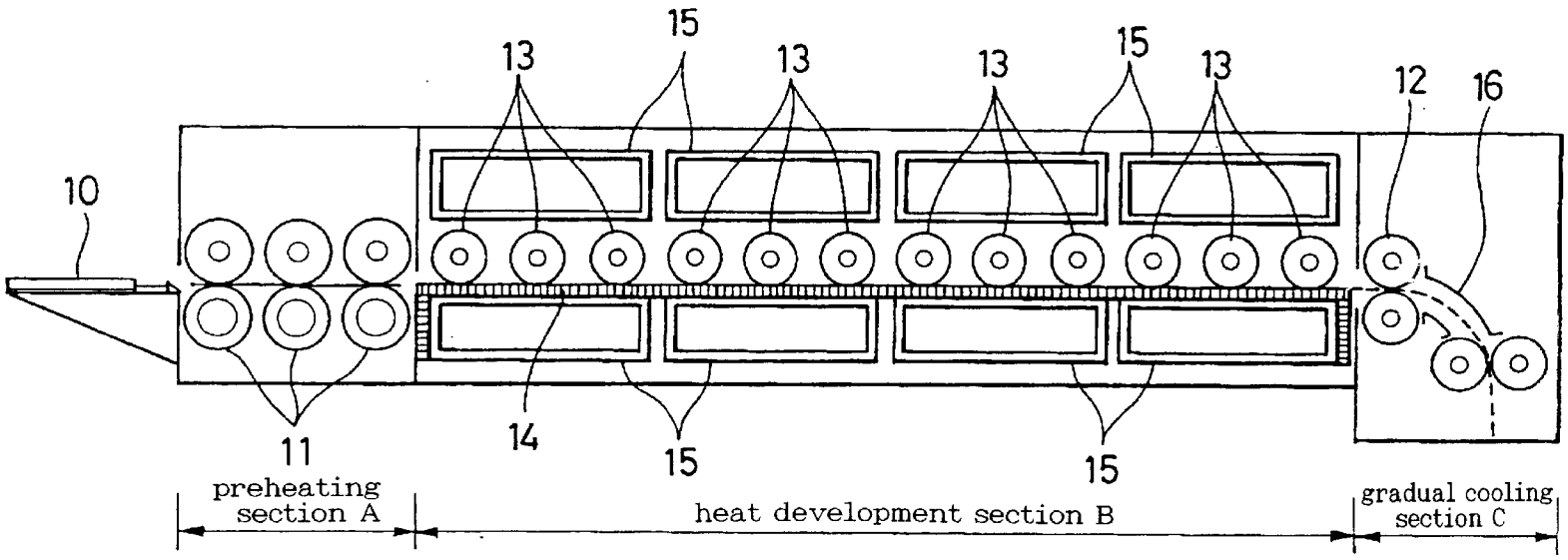
FIG. 1 is a side view of an exemplary heat developing apparatus used for the present invention. In the FIGURE, there are shown a heat-developable photosensitive material 10, carrying-in roller pairs 11, carrying-out roller pairs 12, rollers 13, a flat surface 14, heaters 15, and guide panels 16. The apparatus consists of a preheating section A, a heat development section B, and a gradual cooling section C.

Embodiments of the heat-developable photosensitive material the present invention and methods for practicing the same will be explained in detail below.

The heat-developable photosensitive material of the invention has at least one photosensitive image-forming layer comprising an organic silver salt, a photosensitive silver halide, a reducing agent and an organic binder (also referred to as "image-forming layer" or "photosensitive layer"), and contains, in at least one of the photosensitive image-forming layer and a layer adjacent to the photosensitive image-forming layer, a first halogen-releasing precursor having at least one dissociative or hydrophilic substituent and a second hydrophobic halogen-releasing precursor. By using these two kinds of halogen-releasing precursors in combination, stable performance can be obtained irrespective of variation of heat development condition. In contrast, if only one of the halogen-releasing precursors is used, fluctuation of photographic performance depending on the heat development condition becomes significant.

In a preferred embodiment of the heat-developable photosensitive material of the present invention, a cyclic ketone or cyclic imine compound represented by the formula (S) is used. By using a compound represented by the formula (S) in combination with the aforementioned halogen-releasing precursors, fluctuation of photographic performance caused by storage before light exposure can be suppressed, and fluctuation of photographic performance caused by variation of storage condition in storage environment and so forth, in particular, caused by a high temperature and high humidity environment, can be reduced.

The present invention also relates to a method for forming an image, which comprises heating the aforementioned heat-developable photosensitive material of the present invention at a temperature of 80° C. to a temperature lower than 120° C. for 5 seconds or more in such a way that an image is not formed, and subjecting the heat-developable photosensitive material to heat development at a temperature of 110° C. or higher to form an image. By using such an image formation method, images of low fog and high Dmax can be obtained, and thus fluctuation of photographic performance caused by variation of development environment can be reduced.

The first halogen-releasing precursor (referred to as the "first precursor" hereinafter) will be explained hereafter. The first precursor is preferably a compound represented by the following formula (1).

(1)

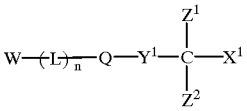

In the formula (1), $Z^1$ and $Z^2$ each independently represent a halogen atom such as fluorine, chlorine, bromine and iodine. It is preferred that both of $Z^1$ and $Z^2$ represent bromine atom.

In the formula (1), $X^1$ is hydrogen atom or an electron withdrawing group. The electron withdrawing group used herein is a substituent having a Hammett's substituent constant σp of a positive value, and specific examples thereof include cyano group, an alkoxycarbonyl group, an aryloxycarbonyl group, a carbamoyl group, a sulfamoyl group, an alkylsulfonyl group, an arylsulfonyl group, a halogen atom, an acyl group, a heterocyclic group and so forth. In the formula (1), $X^1$ is preferably hydrogen atom or a halogen atom, and the most preferred is bromine atom.

In the formula (1), $Y^1$ is —CO— or —$SO_2$—, and is preferably —$SO_2$—.

In the formula (1), Q represents an arylene group or a divalent heterocyclic group.

The arylene group represented by Q in the formula (1) is preferably a monocyclic or condensed ring arylene group having 6–30 carbon atoms, preferably a monocyclic or condensed ring arylene group having 6–20 carbon atoms. Examples thereof include, for example, phenylene, naphthylene and so forth, and it is particularly preferably a phenylene group. The arylene group represented by Q may have a substituent. The substituent may be any group so long as it does not adversely affect photographic performance. Examples thereof include, for example, a halogen atom (fluorine atom, chlorine atom, bromine atom or iodine atom), an alkyl group (including an aralkyl group, a cycloalkyl group, an active methine group and so forth), an alkenyl group, an alkynyl group, an aryl group, a heterocyclic group (includeing N-substituted nitrogen-containing heterocyclic group), a heterocyclic group containing a quaternized nitrogen atom (e.g., pyridinio group), an acyl group, an alkoxycarbonyl group, an aryloxycarbonyl group, a carbamoyl group, carboxy group or a salt thereof, an imino group, an imino group substituted at N atom, a thiocarbonyl group, a carbazoyl group, cyano group, a thiocarbamoyl group, an alkoxy group (including a group containing repeats of ethyleneoxy group or propyleneoxy group unit), an aryloxy group, a heterocyclyloxy group, an acyloxy group, an (alkoxy or aryloxy)carbonyloxy group, a carbamoyloxy group, a sulfonyloxy group, an acylamino group, a sulfonamido group, a ureido group, a thioureido group, an imido group, an (alkoxy or aryloxy)carbonylamino group, a sulfamoylamino group, a semicarbazide group, a thiosemicarbazide group, a hydrazino group, a quatenary ammonio group, an (alkyl or aryl)sulfonylureido group, nitro group, an (alkyl, aryl or heterocyclyl)thio group, an acylthio group, an (alkyl or aryl)sulfonyl group, an (alkyl or aryl)sulfinyl group, slufo group or a salt thereof, a sulfamoyl group, a phosphoryl group, a group containing phosphoramide or phosphoric acid ester structure, a silyl group and so forth. These substituents may further be substituted with these substituents. Particularly preferred substituents on the arylene group represented by Q in the formula (1) are an alkyl group, an alkoxy group, an aryloxy group, a halogen atom, cyano group, carboxyl group or a salt thereof, a salt of slufo group and phosphoric acid group.

In the formula (1), the heterocycle of the divalent heterocyclic group represented by Q may be a saturated or unsaturated 5- to 7-membered heterocycle containing at least one of N, O and S atoms. The heterocycle may consist of a single ring, or it may form a condensed ring with another ring or other rings. Examples of the heterocycle in the heterocyclic group represented by Q include, for example, rings of pyridine, pyrazine, pyrimidine, benzothiazole, benzimidazole, thiadiazole, quinoline, isoquinoline, triazole, triazine and so forth. These may have a substituent, and examples of the substituent include, for example, those mentioned for the arylene group represented by Q.

In the formula (1), Q is preferably an arylene group, and is particularly preferably a phenylene group.

In the formula (1), L represents a linking group such as an alkylene group (including an alkylidene group and a cyclic group, and having preferably 1–30 carbon atoms, more preferably 1–20 carbon atoms, particularly preferably 1–10 carbon atoms), an arylene group (having preferably 6–30 carbon atoms, more preferably 6–20 carbon atoms, particularly preferably 6–10 carbon atoms), an alkenylene group (having preferably 2–30carbon atoms, more preferably 2–20 carbon atoms, particularly preferably 2–10 carbon atoms), an alkynylene group (having preferably 2–30 carbon atoms, more preferably 2–20 carbon atoms, particularly preferably 2–10 carbon atoms), a heterocyclic group (having preferably 1–30 carbon atoms, more preferably 1–20 carbon atoms, particularly preferably 1–10 carbon atoms), —O—, —NR—, —CO—, —COO—, —OCOO—, —NRCO—, —NRCONR—, —OCONR—, —S—, —SO—, —$SO_2$—, —$SO_2$NR—, a group containing a phosphorus atom, a group consisting of a combination of these groups (the group represented by R is hydrogen atom, an alkyl group which may have a substituent, or an aryl group which may have a substituent).

The linking group represented by L in the formula (1) may have a substituent, and examples of the substituent include, for example, those mentioned for the arylene group represented by Q.

The linking group represented by L in the formula (1) is preferably an alkylene group, arylene group, —O—, —NRCO—, —$SO_2$NR— group, or a group consisting of a combination of these groups. It may be partly cyclized when it is possible. n is 0 or 1.

W in the formula (1) represents carboxyl group or a salt thereof (Na, K, ammonium salt etc.), slufo group or a salt thereof (Na, K, ammonium salt etc.), phosphoric acid group or a salt thereof (Na, K, ammonium salt etc.), hydroxyl group, a quaternary ammonium group (for example, tetrabutylammonium, trimethylbenzylammonium etc.) or a polyethyleneoxy group. W is preferably carboxyl group or a salt thereof, a salt of slufo group, or hydroxyl group.

Specific examples of the compound represented by the formula (1) will be shown below. However, the scope of the present invention is not limited to these examples.

(P-1)

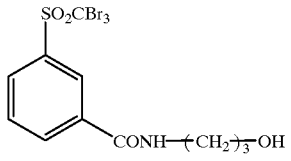

(P-2)

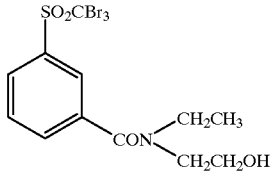

(P-3)

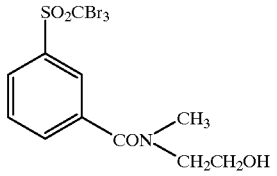

(P-4)

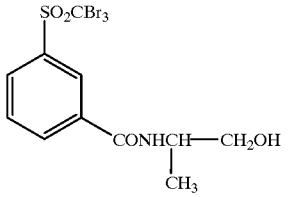

(P-5)

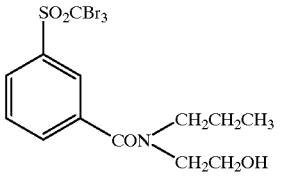

-continued
(P-6)
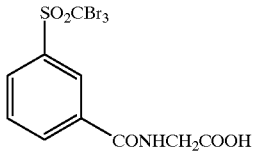
(P-7)
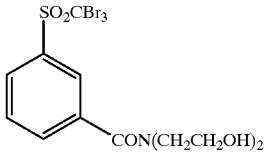
(P-8)
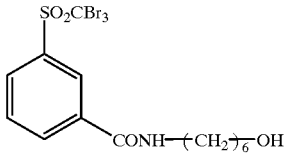
(P-9)
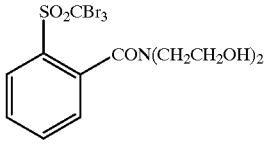
(P-10)
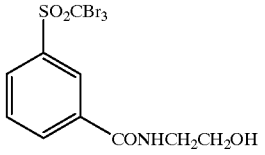
(P-11)
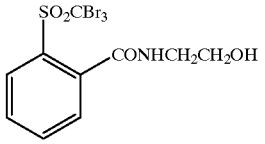
(P-12)
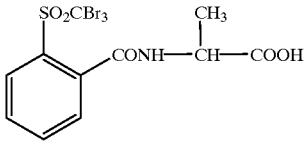
(P-13)
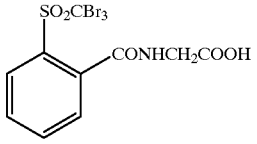
(P-14)
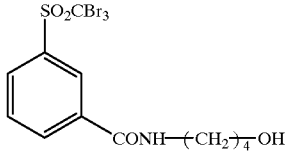
-continued
(P-15)
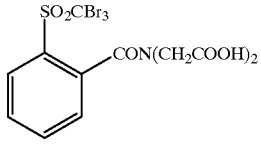
(P-16)
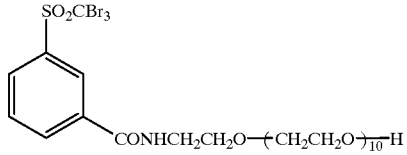
(P-17)
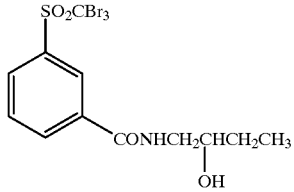
(P-18)
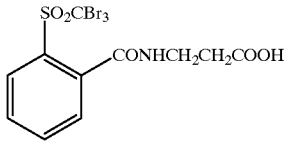
(P-19)
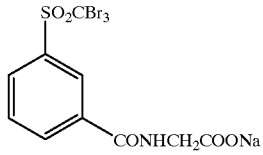
(P-20)
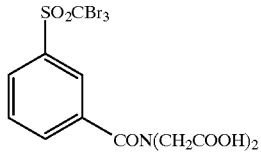
(P-21)
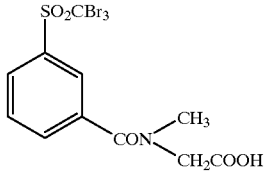
(P-22)
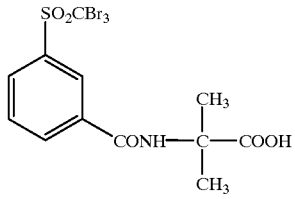

-continued
(P-23)
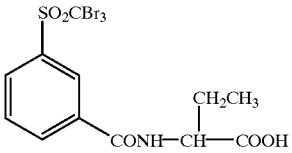
(P-24)
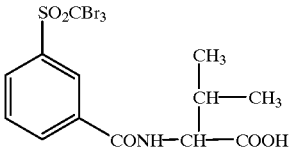
(P-25)
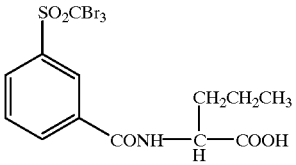
(P-26)
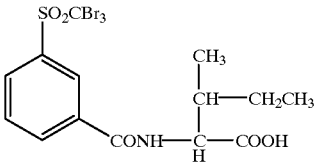
(P-27)
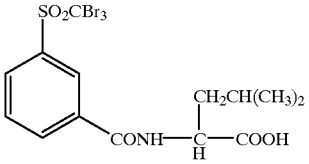
(P-28)
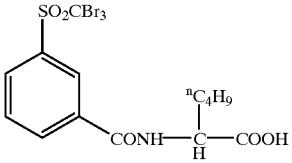
(P-29)
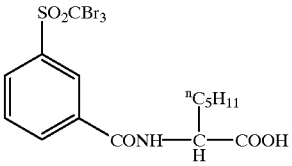
(P-30)
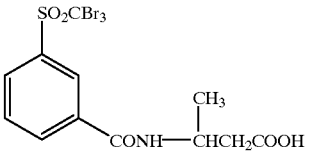
(P-31)
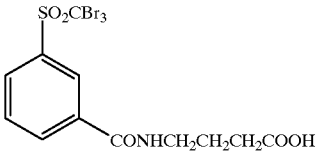
-continued
(P-32)
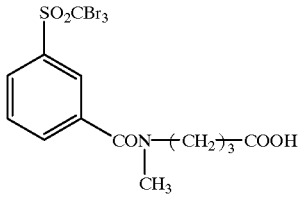
(P-33)
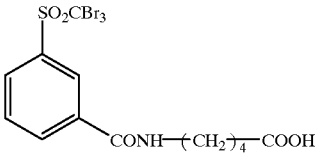
(P-34)
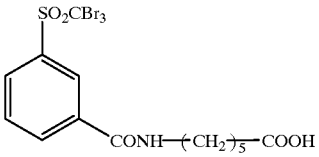
(P-35)
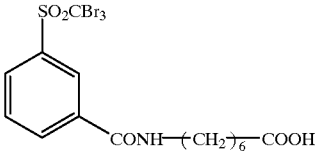
(P-36)
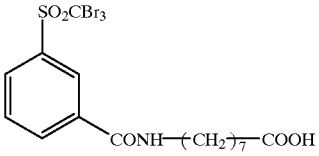
(P-37)
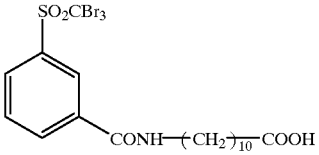
(P-38)
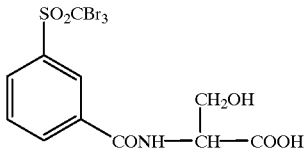
(P-39)
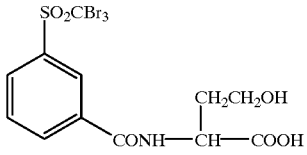

-continued
(P-40)
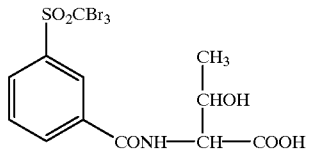
(P-41)
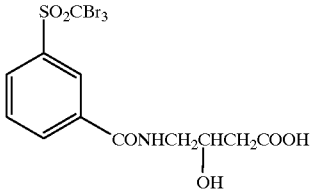
(P-42)
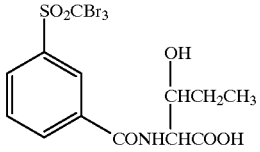
(P-43)
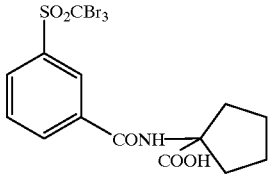
(P-44)
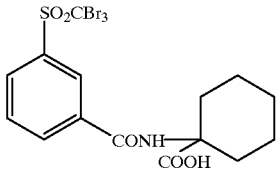
(P-45)
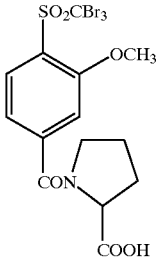
(P-46)
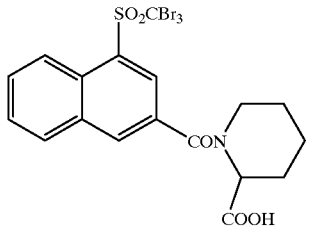
-continued
(P-47)
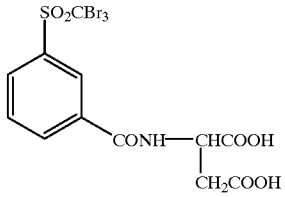
(P-48)
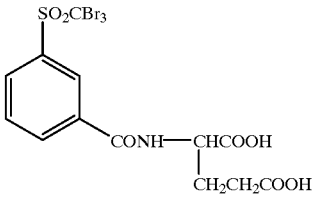
(P-49)
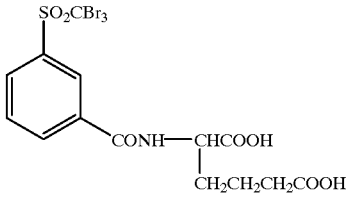
(P-50)
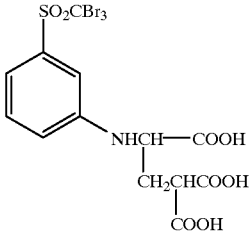
(P-51)
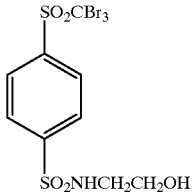
(P-52)
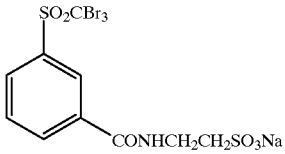
(P-53)
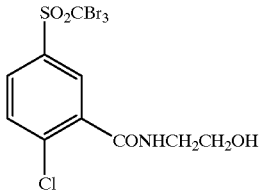

-continued
(P-54)
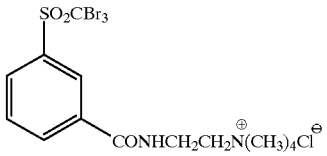
(P-55)
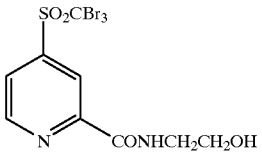
(P-56)
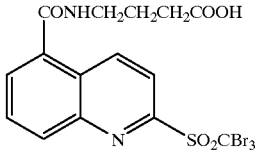
(P-57)
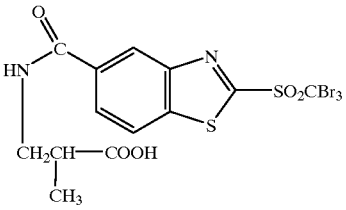
(P-58)
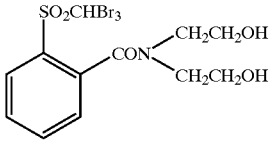
(P-59)
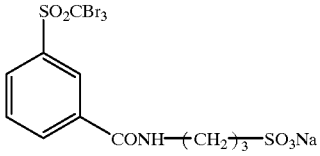
(P-60)
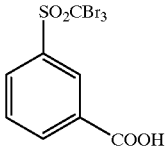
(P-61)
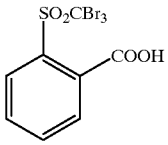
-continued
(P-62)
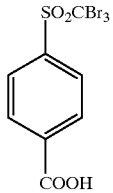
(P-63)
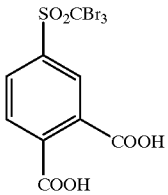
(P-64)
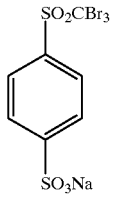
(P-65)
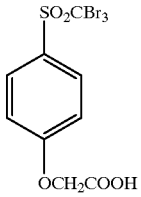
(P-66)
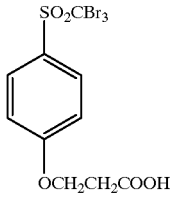
(P-67)
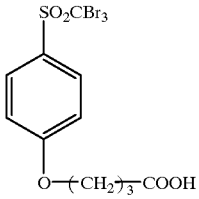
(P-68)
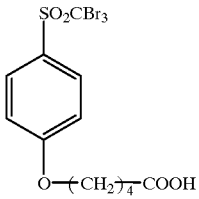

-continued
(P-69)
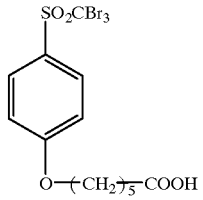
(P-70)
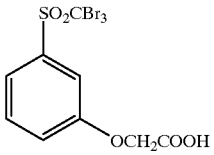
(P-71)
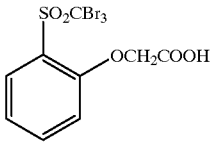
(P-72)
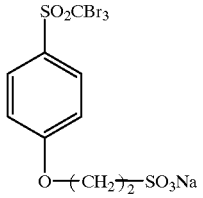
(P-73)
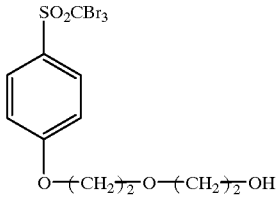
(P-74)
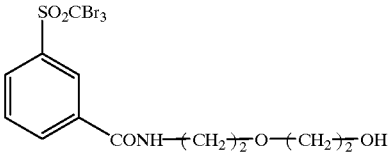
(P-75)
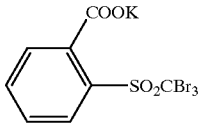
(P-76)
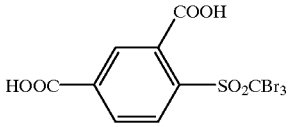
-continued
(P-77)
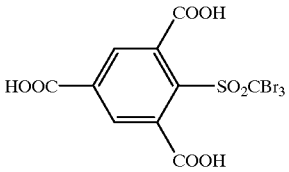
(P-78)
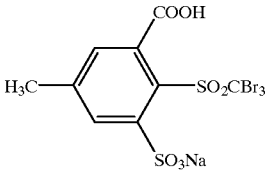
(P-79)
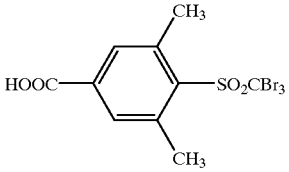
(P-80)
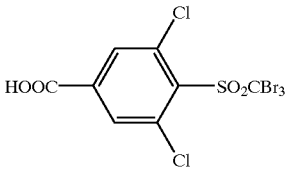
(P-81)
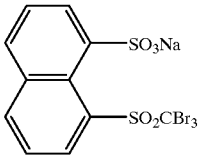
(P-82)
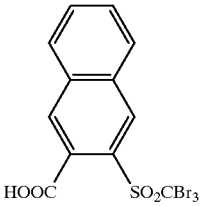
(P-83)
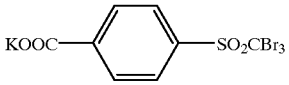
(P-84)
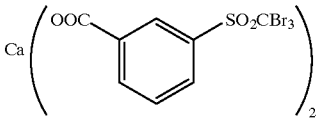
(P-85)
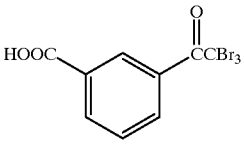

-continued
(P-86)
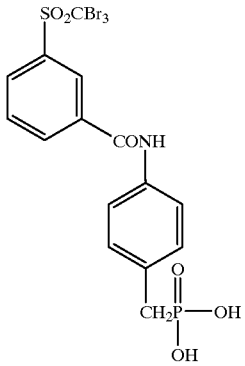
(P-87)
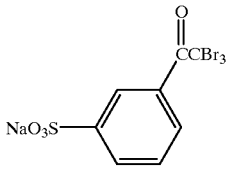
(P-88)
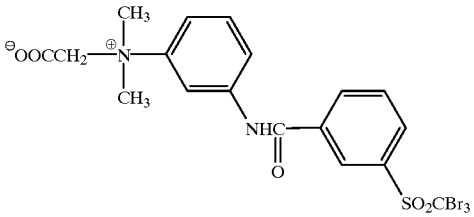
(P-89)
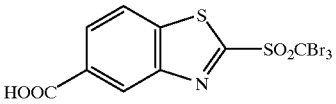
(P-90)
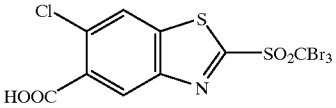
(P-91)
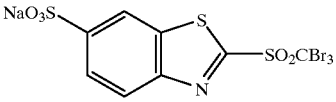
(P-92)
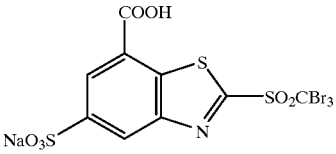
(P-93)
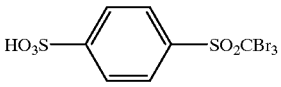
-continued
(P-94)
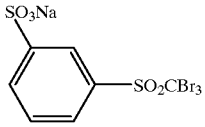
(P-95)
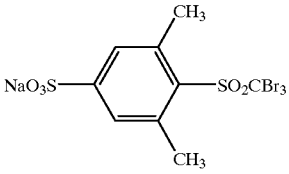
(P-96)
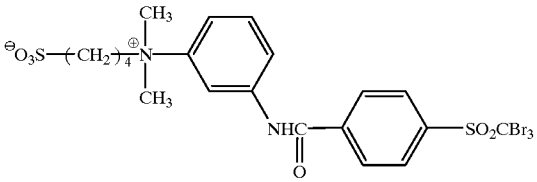
(P-97)
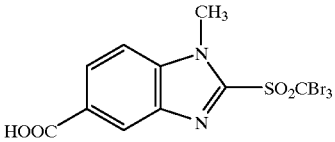
(P-98)
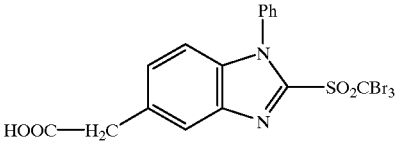
(P-99)
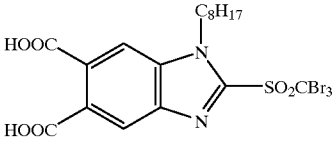
(P-100)
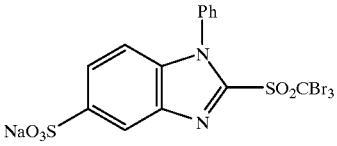
(P-101)
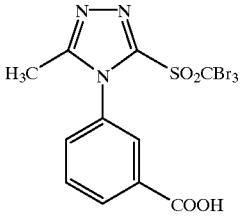

-continued
(P-102)
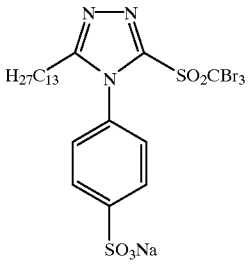
(P-103)
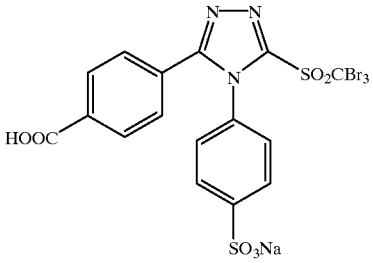
(P-104)
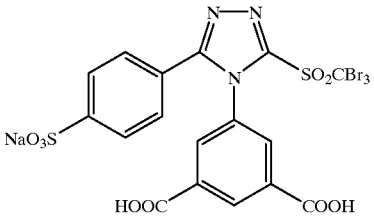
(P-105)
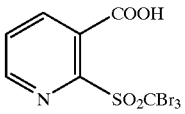
(P-106)
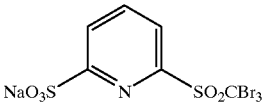
(P-107)
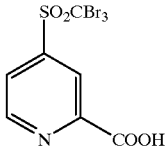
(P-108)
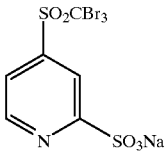
(P-109)
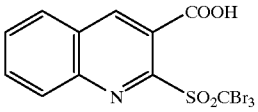
-continued
(P-110)
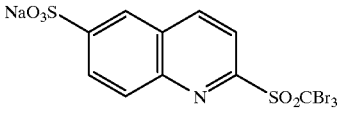
(P-111)
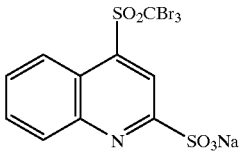
(P-112)
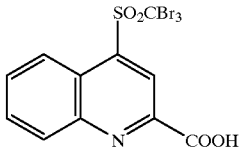
(P-113)
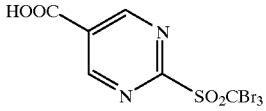
(P-114)
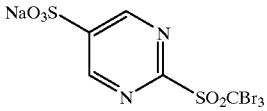
(P-115)
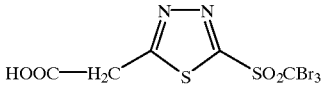
(P-116)
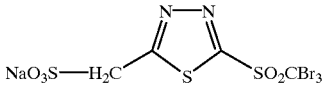
(P-117)
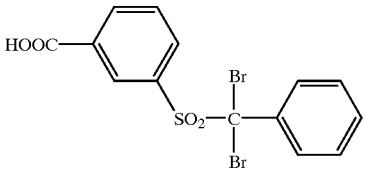
(P-118)
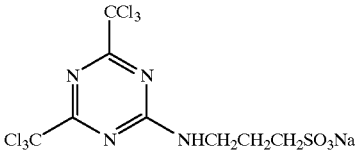
The compound represented by the formula (1) preferably used in the present invention can readily be synthesized through ordinary synthesis reactions in the organic chemistry. Typical synthetic methods will be explained below.

Synthesis Example 1

(P-60)

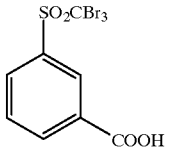

(A)

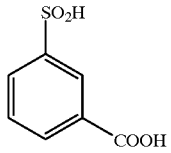

(B)

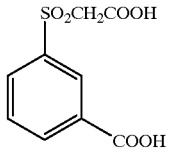

(P-7)

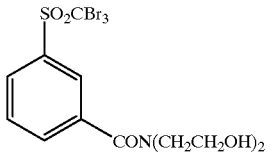

(C)

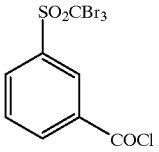

(P-6)

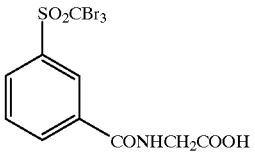

Synthesis of Exemplary Compound (P-60)

(1) Synthesis of Intermediate Compound (B)

Compound (A) (93 g), which is a commercially available compound, sodium hydroxide (43 g), sodium chloroacetate (123 g) and potassium iodide (10 g) were dissolved in water (300 ml), and stirred at 80° C. for 2 hours. After the internal temperature was lowered to 30° C., the solution was added with concentrated hydrochloric acid (50 ml). After the reaction mixture was stirred for a while, crystals were deposited. The crystals were taken by suction filtration and dried to obtain 80 g of Intermediate compound (B) as white crystals.

(2) Synthesis of Exemplary Compound (P-60)

To a solution of NaOH (57 g) in water (500 ml), bromine (33 ml) was added dropwise at room temperature, and then an aqueous solution of Intermediate compound (B) (24 g) and NaOH (8 g) in water (100 ml) was added dropwise at room temperature. The deposited crystals were taken by filtration, and the obtained crystals were added to diluted hydrochloric acid and filtered. The crystals were fully washed with water and dried to obtain 30 g of Exemplary compound (P-60) as white crystals.

Synthesis Example 2

Synthesis of Exemplary Compound (P-7)

(1) Synthesis of Intermediate Compound (C)

Exemplary compound (P-60) (30 g) and DMF (dimethylformamide, 1 ml) were dissolved in thionyl chloride (100 ml) and stirred at 70° C. for 30 minutes. Then, excessive thionyl chloride was evaporated under reduced pressure to obtain 31 g of Intermediate compound (C) as white crystals.

(2) Synthesis of Exemplary Compound (P-7)

A solution of diethanolamine (4.7 g) in methanol (50 ml) was cooled on ice, and added with Intermediate compound (C) (4.1 g). After the mixture was stirred for 5 minutes, 50 ml of water was added to the mixture. As a result, white crystals were deposited. The crystals were taken by filtration and dissolved in a small amount of DMAc (dimethylacetamide), and added with methanol slowly. As a result, crystals were deposited. These crystals were taken by filtration and dried to obtain 4.0 g of Exemplary compound (P-7) as white crystals.

Synthesis Example 3

Synthesis of Exemplary Compound (P-6)

Intermediate compound (C) (20 g) was added to a solution of glycine (15 g), $NaHCO_3$ (17 g), water (100 ml) and THF (tetrahydrofuran, 100 ml), and the mixture was stirred for 5 minutes at room temperature. The reaction mixture was neutralized by adding diluted hydrochloric acid, and added with water (200 ml). The deposited crystals were taken by filtration. The obtained crude crystals were dissolved in a small amount of DMAc, and added with methanol until crystals were deposited. The crystals were taken by filtration and dried to obtain 22 g of Exemplary compound (P-6) as white crystals.

The compound represented by the formula (1) used for the present invention may be used by dissolving said compound in water or a suitable organic solvent, for example, alcohol such as methanol, ethanol, propanol, and fluorinated alcohol, ketone such as acetone, methyl ethyl ketone, and methyl isobutyl ketone, dimethylformamide, dimethyl sulfoxide, methyl cellosolve or the like. As for a compound having an acidic group, it can be neutralized with equivalent alkali and added as a salt.

The compound may also be used as an emulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compound may be used after dispersion of a powder of the compound in an appropriate solvent such as water by using a ball mill, a colloid mill, a sand grinder mil, MANTON GAULIN, a microfluidizer, or by means of ultrasonic wave according to a known method for solid dispersion.

The compound represented by the formula (1) may be added to any layers on a support provided on the side of the image-forming layer, i.e., the image-forming layer and/or the other layers provided on the same side. The compound may preferably be added to the image-forming layer and a layer adjacent thereto. The compound may be used alone, or as any combination of two or more kinds of the compound.

The second halogen-releasing precursor (referred to as the "second precursor" hereinafter) will be explained hereafter. The second precursor is a hydrophobic compound not having a substituent substantially dissociating in films or a hydrophilic group imparting water-solubility. The second precursor is preferably a compound represented by the following formula (2).

(2)

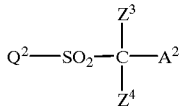

In the formula, $Q^2$ represents an aryl group or a heterocyclic group, which may have a substituent. $Z^3$ and $Z^4$ each independently represent a halogen atom. $A^2$ represents hydrogen atom or an electron withdrawing group.

The compound will be explained in more detail. The aryl group represented by $Q^2$ in the formula is preferably a monocyclic or condensed ring aryl group having 6–30 carbon atoms, preferably a monocyclic or condensed ring aryl group having 6–20 carbon atoms. For example, it may be phenyl group, naphthyl group or the like, particularly preferably phenyl group.

The heterocyclic group represented by $Q^2$ in the formula is 3- to 10-membered, saturated or unsaturated heterocyclic group containing at least one atom selected from nitrogen (N), oxygen (O) and sulfur (S). The heterocyclic group may be monocyclic or may form a condensed ring with another or other rings.

Illustrative examples of the heterocyclic group include thienyl, furyl, pyrrolyl, pyrazolyl, pyridyl, pyrazinyl, pyrimidinyl, pyridazinyl, indolizinyl, isoindolizinyl, 3H-indolyl, indolyl, 1H-indazolyl, purinyl, 4H-quinolizinyl, isoquinolyl, quinolyl, phthalazinyl, naphthyridinyl, quinoxalinyl, quinazolinyl, cinnolinyl, pteridinyl, carbazolyl, β-carbonylyl, phenanthridinyl, acridinyl, perimidinyl, phenanthrolinyl, phenazinyl, phenarsazinyl, phenothiazinyl, furazanyl, phenoxazinyl, isochromanyl, chromanyl, pyrrolidinyl, pyrrolinyl, imidazolidinyl, imidazolinyl, pyrazolidinyl, pyrazolinyl, piperidyl, piperazinyl, indolinyl, isoindolinyl, quinuclidinyl, morpholinyl, triazolyl, tetrazolyl, thiadiazolyl, benzimidazolyl, benzoxazolyl, benzothiazolyl, benzotriazolyl, triazinyl, uracil, triazopyrimidinyl and so forth. Preferably, $Q^2$ is thienyl, pyridyl, isoquinolyl, quinolyl, triazolyl, benzimidazolyl or benzothiazolyl.

In the formula, the aryl group or heterocyclic group represented by $Q^2$ may have a substituent other than the $—SO_2—C(Z^3)(Z^4)A^2$ group. Any generally known substituents may be used so long as they do not adversely affect the photographic performance. Examples of the substituent include, for example, a linear, branched or cyclic alkyl group having preferably 1–20, more preferably 1–12, particularly preferably 1–4 carbon atoms (for example, methyl, ethyl, iso-propyl, t-butyl, n-octyl, t-amyl, cyclohexyl etc.), an alkenyl group having preferably 2–20, more preferably 2–12, particularly preferably 2–8 carbon atoms (for example, vinyl, allyl, 2-butenyl, 3-pentenyl etc.), an alkynyl group having preferably 2–20, more preferably 2–12, particularly preferably 2–8 carbon atoms (for example, propargyl, 3-pentynyl etc.), an aryl group having preferably 6–30, more preferably 6–20, particularly preferably 6–12 carbon atoms (for example, phenyl, p-methylphenyl, naphthyl etc.), an amino group having preferably 0–20, more preferably 0–10, particularly preferably 0–6 carbon atoms (for example, amino, methylamino, dimethylamino, diethylamino, dibenzylamine etc.), an alkoxy group having preferably 1–20, more preferably 1–12, particularly preferably 1–8 carbon atoms (for example, methoxy, ethoxy, butoxy etc.), an aryloxy group having preferably 6–20, more preferably 6–16, particularly preferably 6–12 carbon atoms (for example, phenyloxy, 2-naphthyloxy etc.), an acyl group having preferably 1–20, more preferably 1–16, particularly preferably 1–12 carbon atoms (for example, acetyl, benzoyl, formyl, pivaloyl etc.), an alkoxycarbonyl group having preferably 2–20, more preferably 2–16, particularly preferably 2–12 carbon atoms (for example, methoxycarbonyl, ethoxycarbonyl etc.), an aryloxycarbonyl group having preferably 7–20, more preferably 7–16, particularly preferably 7–10 carbon atoms (for example, phenoxycarbonyl etc.) an acyloxy group having preferably 1–20, more preferably 2–16, particularly preferably 2–10 carbon atoms (for example, acetoxy, benzoyloxy etc.), an acylamino group having preferably 1–20, more preferably 2–16, particularly preferably 2–10 carbon atoms (for example, acetylamino, benzoylamino etc.), an alkoxycarbonylamino group having preferably 2–20, more preferably 2–16, particularly preferably 2–12 carbon atoms (for example, methoxycarbonylamino etc.), an aryloxycarbonylamino group having preferably 7–20, more preferably 7–16, particularly preferably 7–12 carbon atoms (for example, phenyloxycarbonylamino etc.), a sulfonylamino group having preferably 1–20, more preferably 1–16, particularly preferably 1–12 carbon atoms (for example, methanesulfonylamino, benzenesulfonylamino etc.), a sulfamoyl group having preferably 0–20, more preferably 0–16, particularly preferably 0–12 carbon atoms (for example, sulfamoyl, methylsulfamoyl, dimethylsulfamoyl, phenylsulfamoyl etc.), a carbamoyl group having preferably 0–20, more preferably 0–16, particularly preferably 0–12 carbon atoms (for example, carbamoyl, diethylcarbamoyl, phenylcarbamoyl etc.), a ureido group having preferably 1–20, more preferably 1–16, particularly preferably 1–12 carbon atoms (for example, ureido, methylureido, phenylureido etc.), an alkylthio group having preferably 1–20, more preferably 1–16, particularly preferably 1–12 carbon atoms (for example, methylthio, ethylthio etc.), an arylthio group having preferably 6–20, more preferably 6–16, particularly preferably 6–12 carbon atoms (for example, phenylthio etc.), a sulfonyl group having preferably 1–20, more preferably 1–16, particularly preferably 1–12 carbon atoms (for example, mesyl, benzenesulfonyl, tosyl etc.), a sulfinyl group having preferably 1–20, more preferably 1–16, particularly preferably 1–12 carbon atoms (for example, methanesulfonyl, benzenesulfonyl etc.), a phosphoramide group having preferably 1–20, more preferably 1–16, particularly preferably 1–12 carbon atoms (for example, diethylphosphoramide, phenylphosphoramide etc.), hydroxyl group, mercapto group, a halogen atom (for example, fluorine atom, chlorine atom, bromine atom, iodine atom), cyano group, sulfo group or a salt thereof, carboxyl group or a salt thereof, nitro group, hydroxamic group, sulf into group, hydrazino group, sulfonylthio group, thiosulfonyl group, a heterocyclic group (for example, imidazolyl, pyridyl, furyl, piperidyl, morpholyl etc.), disulfide group, a polyethyleneoxy group, a quaternary ammonium group and so forth. These substituents may further be substituted.

$Z^3$ and $Z^4$ each independently represent a halogen atom, preferably bromine atom.

$A^2$ represents hydrogen atom or an electron withdrawing group, preferably hydrogen atom or bromine atom, particularly preferably bromine atom.

These compounds may be used as a combination of two or more kinds of the compound.

Specific examples of the "second precursor" used for the present invention will be shown below. However, the scope of the present invention is not limited to these examples.

II-1
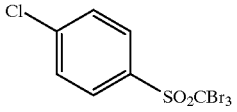
II-2
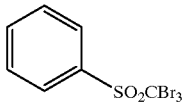
II-3
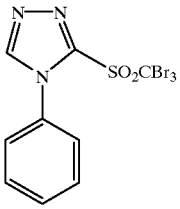
II-4
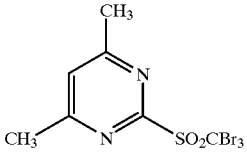
II-5
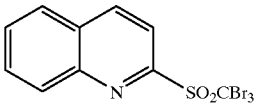
II-6
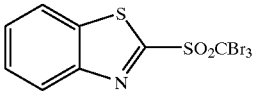
II-7
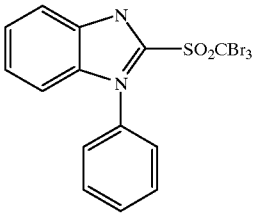
II-8
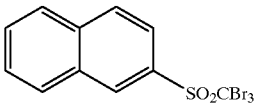
II-9
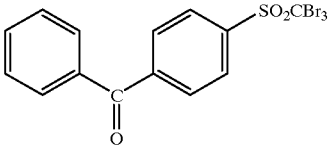
II-10
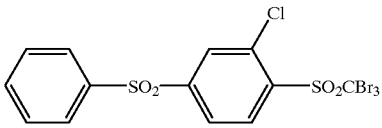
-continued
II-11
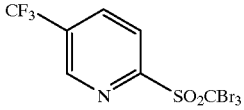
II-12
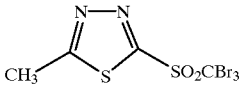
II-13
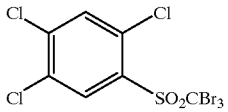
II-14
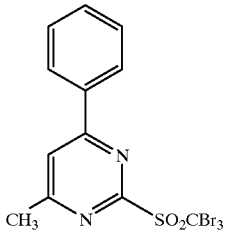
II-15
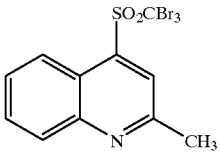
II-16
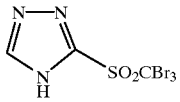
II-17
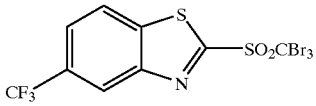
II-18
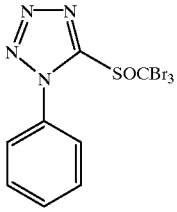
II-19
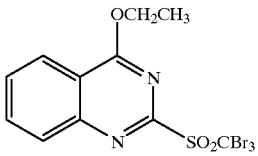
II-20
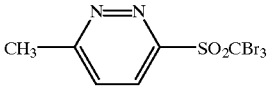

-continued

II-21

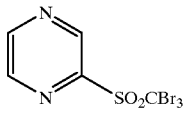

II-22

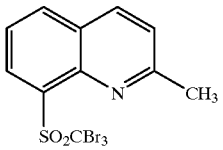

II-23

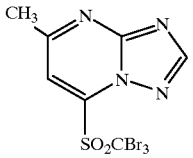

II-24

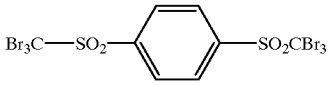

II-25

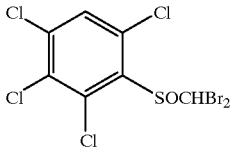

II-26

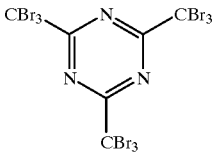

II-27

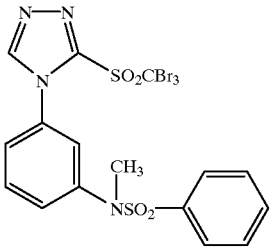

II-28

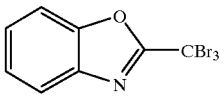

II-29

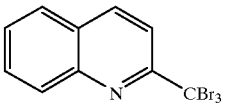

II-30

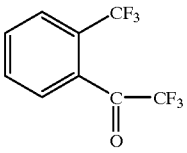

-continued

II-31

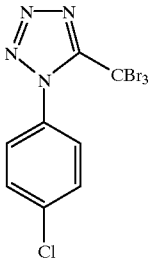

II-32

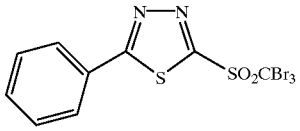

II-33

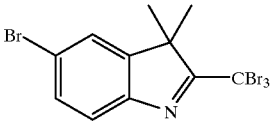

II-34

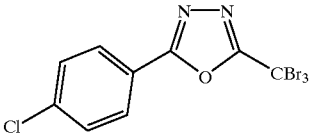

II-35

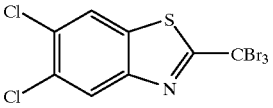

II-36

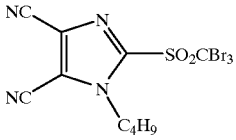

II-37

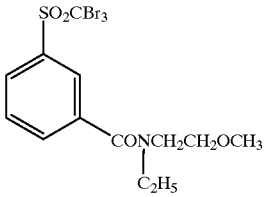

II-38

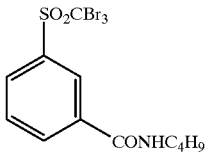

The "second precursor" used for the present invention is used in a desired amount for obtaining desired performance such as sensitivity and fog. The second precursor is preferably added in an amount of $10^{-4}$ to 1 mol, more preferably $10^{-3}$ to $5\times10^{-1}$ mol, per mole of non-photosensitive silver salt in the image-forming layer.

The "first precursor" used for the present invention is used in a desired amount for obtaining desired performance such as sensitivity and fog. However, it is preferably added in an amount of $5\times10^{-5}$ to 1 mol, more preferably $2\times10^{-4}$ to $5\times10^{-1}$ mol, per mole of non-photosensitive silver salt in the image-forming layer.

The amount of the "first precursor" to be used relative to the "second precursor" is, in molar percentage, 0.05% to 200%, preferably 0.5% to 100%.

The first precursor and the second precursor may be added to the same layer or different layers. For example, the second precursor can be added to the image-forming layer, and the first precursor can be added to a non-image-forming layer adjacent to the image-forming layer, for example, a protective layer, an intermediate layer, an undercoat layer or the like, or vice versa. Of course, the both of the precursors may also be added to the image-forming layer. Preferably, the second precursor is added to the image-forming layer, and the first precursor is added to a non-image-forming layer (i.e., non-photosensitive layer) adjacent to the image-forming layer. In this case, each precursor is separately added each of a coating solution for image-forming layer and coating solution for non-image-forming layer. This improves stability of the coating solution for image-forming layer over time, compared with the case where the both of the precursors are added to the coating solution for image-forming layer.

The "second precursor" used for the present invention is hydrophobic, and water-insoluble. It may be added by dissolving it in an appropriate organic solvent such as alcohol (e.g., methanol, ethanol, propanol, fluorinated alcohol), ketone (e.g., acetone, methyl ethyl ketone), dimethylformamide, dimethyl sulfoxide or methyl cellosolve, and adding the solution to a coating solution, so that it should be present in a film as microcrystallines after the film is dried. Alternatively, the compound may also be used as an emulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compound may be added to a coating solution as a fine solid dispersion of the compound in a suitable solvent such as water, which is prepared by using a dispersion medium such as glass beads, zirconia beads or zirconia silicate beads, and a known dispersion machine such as a ball mill, colloid mill and sand mill or a dispersion machine utilizing ultrasonic wave.

The second precursor is particularly preferably added as a solid dispersion. It can be added with a stably uniform grain size by preliminary preparing a fine solid dispersion and adding it, and therefore it does not cause aggregation in a coating solution, and fluctuation of performance. Thus, addition as a solid dispersion is advantageous. In particular, when an aqueous dispersion of a thermoplastic resin is used as a binder of the photosensitive image-forming layer, the addition as a solid dispersion is the most preferred. At this time, it is preferable to add also the reducing agent as a solid dispersion. Average grain size of the second precursor in a solid dispersion is preferably 0.05 to 5 $\mu$m, more preferably 0.1 to 1 $\mu$m. Average grain size of the reducing agent in a solid dispersion is also preferably 0.05 to 5 $\mu$m, more preferably 0.1 to 1 $\mu$m.

The "first precursor" used for the present invention is preferably used by being dissolved in water or an appropriate organic solvent such as alcohol (e.g., methanol, ethanol, propanol, fluorinated alcohol), ketone (e.g., acetone, methyl ethyl ketone), dimethylformamide, dimethyl sulfoxide or methyl cellosolve. In particular, when an aqueous dispersion of a thermoplastic resin is used as a binder of the photosensitive image-forming layer, the addition as an aqueous solution is the most preferred. In this case, in order to increase solubility of the aqueous solution, a water-miscible organic solvent such as an alcohol (e.g., methanol, ethanol, propanol, fluorinated alcohol), a ketone (e.g., acetone, methyl ethyl ketone) and dimethylformamide may be supplemented. The supplemented organic solvent is used preferably in an amount of 50% by volume or less of the volume of water.

In the present invention, it is preferable to use the compound represented by the formula (S). The cyclic compound represented by the formula (S) will be explained in more detail. The groups represented by $R^1$ and $R^2$ include hydrogen atom, an acyl group, a hydrocarbon group and a carbamoyl group. As the hydrocarbon group, preferred are an alkyl group (including aralkyl group) and an aryl group. As the groups represented by $R^1$ and $R^2$, preferred are hydrogen atom, a substituted or unsubstituted acyl group having 1–10 carbon atoms (e.g., acetyl, propionyl etc.), a substituted or unsubstituted alkyl group having 1–10 carbon atoms (e.g., methyl, ethyl, propyl, benzyl etc.), a substituted or unsubstituted aryl group having 6–10 carbon atoms (e.g., phenyl, 4-ethoxyphenyl, naphthyl etc.) and a substituted or unsubstituted carbamoyl group (e.g., carbamoyl, N,N-dimethylcarbamoyl etc.), and particularly preferred are hydrogen atom, an alkyl group having 1–3 carbon atoms and a carbamoyl group. Further, $R^1$ and $R^2$ may represent a hydrocarbon group which is a derivatized group of the cyclic compound represented by the formula (S). $X^O$ represents oxygen atom or imino group (=NH). When $X^O$ represents oxygen atom, at least one of $R^1$ and $R^2$ is hydrogen atom.

The divalent group represented by $L^1$ is a non-metallic atom group necessary for forming a nitrogen-containing heterocyclic structure. $L^1$ itself may contain a cyclic structure therein, and it may form a condensed ring together with a part of the following structure in the formula (S).

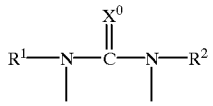

As $L^1$, for example, ethylene, trimethylene and the following structure are preferred.

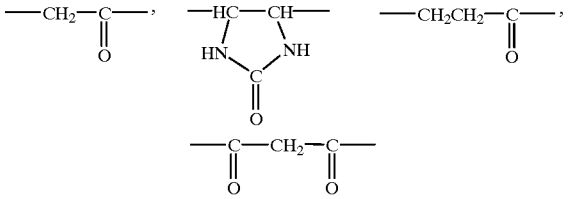

The aforementioned examples of $L^1$ may be substituted with methyl group, amino group, ureido group, methylene group (=$CH^2$) or the like.

Specific examples of the cyclic compound represented by the formula (S) will be shown below. However, the scope of the present invention is not limited to these examples.

(S-1)
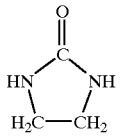
(S-2)
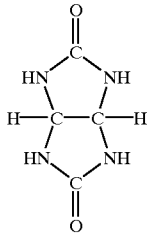
(S-3)
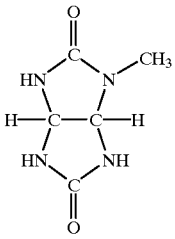
(S-4)
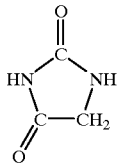
(S-5)
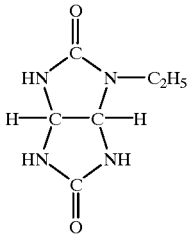
(S-6)
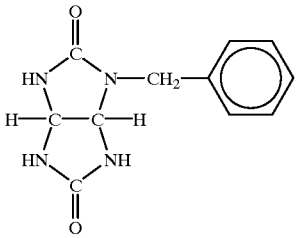
(S-7)
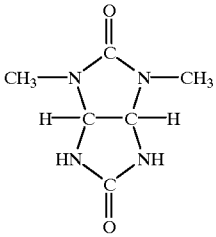
-continued
(S-8)
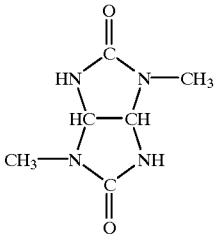
(S-9)
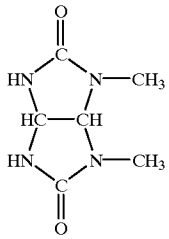
(S-10)
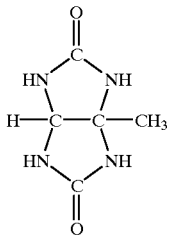
(S-11)
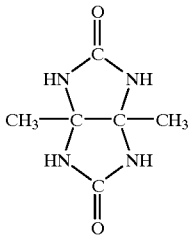
(S-12)
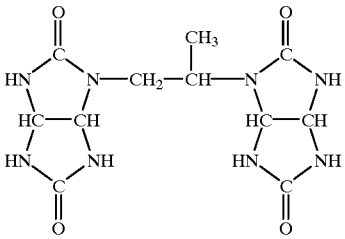
(S-13)
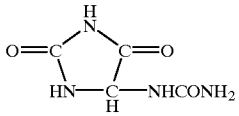
(S-14)
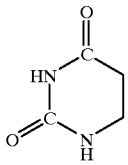

-continued (S-15)

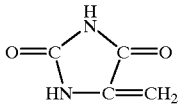

(S-16)

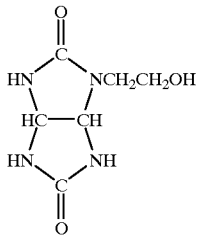

(S-17)

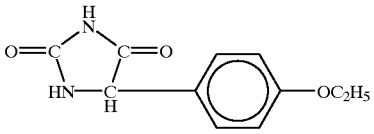

(S-18)

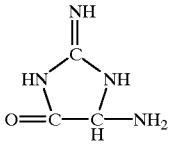

(S-19)

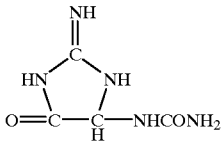

(S-20)

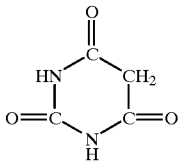

(S-21)

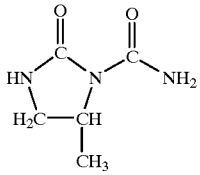

(S-22)

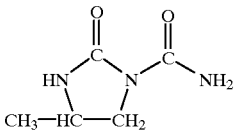

(S-23)

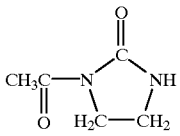

-continued (S-24)

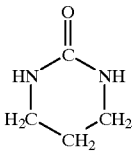

These cyclic compounds are known in the art as agents for preventing deterioration of photographic performance by formaldehyde gas. It was quite interesting and difficult to expect that such compounds were used in combination with the aforementioned organic halogen compound of the formula (1) in heat-developable photosensitive materials and exhibited marked effect on prevention of fog and sensitivity fluctuation during storage in heat-developable photosensitive materials utilizing a nucleating agent. Specific examples of this class of compounds are included in the compounds disclosed in JP-A-61-73150, JP-A-58-10738, JP-A-50-87028 and so forth.

These compounds are commercially available, and can be synthesized by the methods disclosed in, for example, British Patent No. 717,287, U.S. Pat. Nos. 2,731,472, 3,187,004, JP-A-58-79248 and so forth. These compounds may be used as a combination of two or more of them.

The cyclic compound preferably used in the present invention can be used by adding it to at least one of an upper layer as for the image-forming layer (e.g., protective layer), the image-forming layer containing silver halide emulsion, an intermediate layer, an undercoat layer and other auxiliary layers of the heat-developable photosensitive material.

In order to add the cyclic compound preferably used in the present invention to those layers, the compound, per se, can be added to a coating solution, or it can be added to a coating solution after dissolved in a solvent such as water and alcohol. The cyclic compound is suitably added in an amount of 0.001 g to 1 g, particularly preferably 0.005 g to 0.5 g, per 1 $m^2$ of the heat-developable photosensitive material.

In the present invention, it is preferable to use a nucleating agent. Nucleating agents that can be used will be explained. As the nucleating agent, various known compounds can be used. There have been known, for example, hydrazine compounds such as those compounds disclosed in U.S. Pat. Nos. 5,464,738, 5,496,695, 5,512,411, 5,536,622, JP-B-6-77138 (the term "JP-B" as used herein means a "published Japanese patent application"), JP-B-6-93082, JP-A-6-230497, JP-A-6-289520, JP-A-6-313951, JP-A-7-5610, JP-A-77783, JP-A-7-104426 and so forth; the acrylonitrile derivatives disclosed in U.S. Pat. Nos. 5,545,515 and 5,635,339; the malondialdehydes disclosed in U.S. Pat. No. 5,654,130; the isoxazoles disclosed in U.S. Pat. No. 5,705,339 and so forth. As development accelerators, there have been known the amine compounds disclosed in U.S. Pat. No. 5,545,505, the hydroxamic acids disclosed in U.S. Pat. No. 5,545,507, the hydrogen donors disclosed in U.S. Pat. No. 5,637,449 and so forth. Those known materials can be used for the present invention. Particularly preferred are compounds selected from substituted alkene derivatives, substituted isooxazole derivatives, and acetal compounds, which are represented by the following formulas (3) to (5).

(3)

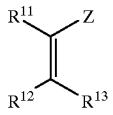

(4)

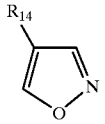

(5)

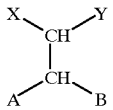

In the formula (3), $R^{11}$, $R^{12}$ and $R^{13}$ each independently represents hydrogen atom or a substituent, and Z represents an electron withdrawing group or a silyl group. In the formula (3), $R^{11}$ and Z, $R^{12}$ and $R^{13}$, $R^{11}$ and $R^{12}$, or $R^{13}$ and Z may be combined with each other to form a ring structure. In the formula (4), $R^{14}$ represents a substituent. In the formula (5), X and Y each independently represent hydrogen atom or a substituent, A and B each independently represent an alkoxy group, an alkylthio group, an alkylamino group, an aryloxy group, an arylthio group, an anilino group, a heterocyclyloxy group, a heterocyclylthio group or a heterocyclylamino group, and X and Y, or A and B may be combined with each other to form a ring structure.

The compound represented by the formula (3) will be explained in detail below.

In the formula (3), $R^{11}$, $R^{12}$ and $R^{13}$ each independently represent hydrogen atom or a substituent, and Z represents an electron withdrawing group or a silyl group. In the formula (3), $R^{11}$ and Z, $R^{12}$ and $R^{13}$, $R^{11}$ and $R^{12}$, or $R^{13}$ and Z may be combined with each other to form a ring structure.

When $R^{11}$, $R^{12}$ or $R^{13}$ represents a substituent, examples of the substituent include a halogen atom (e.g., fluorine atom, chlorine atom, bromide atom, iodine atom), an alkyl group (including an aralkyl group, a cycloalkyl group, active methine group etc.), an alkenyl group, an alkynyl group, an aryl group, a heterocyclic group (including N-substituted nitrogen-containing heterocyclic group), a quaternized nitrogen-containing heterocyclic group (e.g., pyridinio group), an acyl group, an alkoxycarbonyl group, an aryloxycarbonyl group, a carbamoyl group, carboxyl group or a salt thereof, an imino group, an imino group substituted at N atom, a thiocarbonyl group, a sulfonylcarbamoyl group, an acylcarbamoyl group, a sulfamoylcarbamoyl group, a carbazoyl group, an oxalyl group, an oxamoyl group, cyano group, a thiocarbamoyl group, hydroxyl group (or a salt thereof), an alkoxy group (including a group containing ethyleneoxy group or propyleneoxy group repeating unit), an aryloxy group, a heterocyclyloxy group, an acyloxy group, an (alkoxy or aryloxy)carbonyloxy group, a carbamoyloxy group, a sulfonyloxy group, an amino group, an (alkyl, aryl or heterocyclyl)amino group, an acylamino group, a sulfonamido group, a ureido group, a thioureido group, an isothioureido group, an imido group, an (alkoxy or aryloxy)carbonylamino group, a sulfamoylamino group, a semicarbazide group, a thiosemicarbazide group, a hydrazino group, a quaternary ammonio group, an oxamoylamino group, an (alkyl or aryl)sulfonylureido group, an acylureido group, an acylsulfamoylamino group, nitro group, mercapto group, an (alkyl, aryl or heterocyclyl)thio group, an acylthio group, an (alkyl or aryl)sulfonyl group, an (alkyl or aryl)sulfinyl group, sulfo group or a salt thereof, a sulfamoyl group, an acylsulfamoyl group, a sulfonylsulfamoyl group or a salt thereof, a phosphoryl group, a group containing phosphoramide or phosphoric acid ester structure, a silyl group, a stannyl group and so forth.

These substituents may further be substituted with any one or more of the above-described substituents.

The electron withdrawing group represented by Z in the formula (3) is a substituent that gives a positive value of the Hammett's substituent constant σp, and specific examples include cyano group, an alkoxycarbonyl group, an aryloxycarbonyl group, a carbamoyl group, an imino group, an imino group substituted at N atom, a thiocarbonyl group, a sulfamoyl group, an alkylsulfonyl group, an arylsulfonyl group, nitro group, a halogen atom, a perfluoroalkyl group, a perfluoroalkanamido group, a sulfonamido group, an acyl group, a formyl group, a phosphoryl group, carboxyl group (or a salt thereof), sulfo group (or a salt thereof), a heterocyclic group, analkenyl group, analkynyl group, an acyloxy group, an acylthio group, a sulfonyloxy group, an aryl group substituted with the above-described electron withdrawing group and so forth. The heterocyclic group mentioned above is a saturated or unsaturated aromatic or non-aromatic heterocyclic group, and examples include a pyridyl group, a quinolyl group, a pyrazinyl group, a quinoxalinyl group, a benzotriazolyl group, an imidazolyl group, a benzimidazolyl group, a hydantoin-1-yl group, a succinimido group, a phthalimido group and so forth.

The electron withdrawing group represented by Z in the formula (3) may further have one or more substituents, and examples of the substituent include those described as the substituent represented by $R^{11}$, $R^{12}$ or $R^{13}$ in the formula (3).

In the formula (3), $R^{11}$ and Z, $R^{12}$ and $R^{13}$, $R^{11}$ and $R^{12}$, or $R^{13}$ and Z may be combined with each other to form a ring structure. The ring structure formed is a non-aromatic carbon ring or a non-aromatic heterocycle.

The preferred scope of the compound represented by the formula (3) will be described below.

The silyl group represented by Z in the formula (3) may preferably be trimethylsilyl group, t-butyldimethylsilyl group, phenyldimethylsilyl group, triethylsilyl group, triisopropylsilyl group, trimethylsilyldimethylsilyl group or the like.

The electron withdrawing group represented by Z in the formula (3) may preferably be a group having a total carbon atom number of from 0 to 30 such as cyano group, an alkoxycarbonyl group, an aryloxycarbonyl group, a carbamoyl group, a thiocarbonyl group, an imino group, an imino group substituted at N atom, a sulfamoyl group, an alkylsulfonyl group, an arylsulfonyl group, nitro group, a perfluoroalkyl group, an acyl group, a formyl group, a phosphoryl group, an acyloxy group, an acylthio group or a phenyl group substituted with one or more arbitrary electron withdrawing groups, more preferably cyano group, an alkoxycarbonyl group, a carbamoyl group, a thiocarbamoyl group, an imino group, an imino group substituted at N atom, a sulfamoyl group, an alkylsulfonyl group, an arylsulfonyl group, an acyl group, a formyl group, a phosphoryl group, a trifluoromethyl group, or a phenyl group substituted with one or more arbitrary electron withdrawing group, particularly preferably cyano group, a formyl group, an acyl group, an alkoxycarbonyl group, an imino group, an imino group substituted at N atom or a carbamoyl group.

The group represented by Z in the formula (3) is preferably an electron withdrawing group.

The substituent represented by $R^{11}$, $R^{12}$ or $R^{13}$ in the formula (3) may preferably be a group having a total carbon atom number of from 0 to 30, and specific examples of the group include the same groups as those explained as the electron withdrawing group represented by Z in the formula (3), as well as an alkyl group, an alkenyl group, hydroxyl group (or a salt thereof), mercapto group (or a salt thereof), an alkoxy group, an aryloxy group, a heterocyclyloxy group, an alkylthio group, an arylthio group, a heterocyclylthio group, an amino group, an alkylamino group, an arylamino group, a heterocyclylamino group, a ureido group, an acylamino group, a sulfonamido group and a substituted or unsubstituted aryl group and the like.

In the formula (3), $R^{11}$ is preferably the same group as those explained as the electron withdrawing group represented by Z in the formula (3), a substituted or unsubstituted aryl group, an alkenyl group, an alkylthio group, an arylthio group, an alkoxy group, an acylamino group, hydrogen atom, or a silyl group. More preferably, $R^{11}$ is an electron withdrawing group, an aryl group, an alkenyl group or an acylamino group.

When $R^{11}$ represents an electron withdrawing group, the electron withdrawing group may preferably be a group having a total carbon atom number of from 0 to 30 such as cyano group, nitro group, an acyl group, a formyl group, an alkoxycarbonyl group, an aryloxycarbonyl group, a thiocarbonyl group, an imino group, an imino group substituted at N atom, an alkylsulfonyl group, an arylsulfonyl group, a carbamoyl group, a sulfamoyl group, a trifluoromethyl group, a phosphoryl group, carboxyl group (or a salt thereof), a saturated or unsaturated heterocyclic group, more preferably cyano group, an acyl group, a formyl group, an alkoxycarbonyl group, a carbamoyl group, an imino group, an imino group substituted at N atom, a sulfamoyl group, carboxyl group (or a salt thereof) or a saturated or unsaturated heterocyclic group, particularly preferably cyano group, a formyl group, an acyl group, an alkoxycarbonyl group, a carbamoyl group or a saturated or unsaturated heterocyclic group.

When $R^{11}$ represents an aryl group, the aryl group is preferably a substituted or unsubstituted phenyl group having a total carbon atom number of from 6 to 30. The substituent may be any substituent, and an electron withdrawing substituent is preferred.

In the formula (3), $R^{11}$ is more preferably an electron withdrawing group or an aryl group.

The substituent represented by $R^{12}$ or $R^{13}$ in the formula (3) may preferably be the same group as those explained as the electron withdrawing group represented by Z in the formula (3), as well as an alkyl group, hydroxyl group (or a salt thereof), mercapto group (or a salt thereof), an alkoxy group, an aryloxy group, a heterocyclyloxy group, an alkylthio group, an arylthio group, a heterocyclylthio group, an amino group, an alkylamino group, an anilino group, a heterocyclylamino group, an acylamino group, a substituted or unsubstituted phenyl group or the like.

In the formula (3), it is more preferred that one of $R^{12}$ and $R^{13}$ is hydrogen atom and the other is a substituent. The substituent may preferably be an alkyl group, hydroxyl group (or a salt thereof), mercapto group (or a salt thereof), an alkoxy group, an aryloxy group, a heterocyclyloxy group, an alkylthio group, an arylthio group, a heterocyclylthio group, an amino group, an alkylamino group, an anilino group, a heterocyclylamino group, an acylamino group (particularly, a perfluoroalkanamido group), a sulfonamido group, a substituted or unsubstituted phenyl group, a heterocyclic group or the like, more preferably hydroxyl group (or a salt thereof), mercapto group (or a salt thereof), an alkoxy group, an aryloxy group, a heterocyclyloxy group, an alkylthio group, an arylthio group, a heterocyclylthio group, an amino group or a heterocyclic group, particularly preferably hydroxyl group (or a salt thereof), an alkoxy group or a heterocyclic group.

In the formula (3), it is also preferred that Z and $R^{11}$ or $R^{12}$ and $R^{13}$ form a ring structure. The ring structure formed is a non-aromatic carbon ring or a non-aromatic heterocycle, preferably a 5-, 6- or 7-membered ring structure having a total carbon atom number, including those of substituents thereon, of from 1 to 40, more preferably from 3 to 30.

The compound represented by the formula (3) is more preferably a compound wherein Z represents a cyano group, a formyl group, an acyl group, an alkoxycarbonyl group, an imino group or a carbamoyl group, $R^{11}$ represents an electron withdrawing group or an aryl group, and one of $R^{12}$ and $R^{13}$ represents hydrogen atom and the other represents hydroxyl group (or a salt thereof), mercapto group (or a salt thereof), an alkoxy group, an aryloxy group, a heterocyclyloxy group, an alkylthio group, an arylthio group, a heterocyclylthio group or a heterocyclic group. A class of most preferable compounds represented by the formula (3) are constituted by those wherein Z and $R^{11}$ are combined with each other to form a non-aromatic 5-, 6- or 7-membered ring structure, and one of $R^{12}$ and $R^{13}$ represents hydrogen atom and the other represents hydroxyl group (or a salt thereof), mercapto group (or a salt thereof), an alkoxy group, an aryloxy group, a heterocyclyloxy group, an alkylthio group, an arylthio group, a heterocyclylthio group, an amino group or a heterocyclic group. In such compounds, Z which forms a non-aromatic ring structure together with $R^{11}$ is preferably an acyl group, a carbamoyl group, an oxycarbonyl group, a thiocarbonyl group or a sulfonyl group, and $R^{11}$ is preferably an acyl group, a carbamoyl group, an oxycarbonyl group, a thiocarbonyl group, a sulfonyl group, an imino group, an imino group substituted at N atom, an acylamino group, a carbonylthio group or the like.

Specific examples of the 5- to 7-membered non-aromatic cyclic structure formed by Z and $R^{11}$ are, for example, indane-1,3-dione ring, pyrrolidine-2,4-dione ring, pyrazolidine-3,5-dione ring, oxazolidine-2,4-dione ring, 5-pyrazolone ring, imidazolidine-2,4-dione ring, thiazolidine-2,4-dione ring, oxolane-2,4-dione ring, thiolane-2,4-dione ring, 1,3-dioxane-4,6-dione ring, cyclohexane-1,3-dione ring, 1,2,3,4-tetrahydroquinoline-2,4-dione ring, cyclopentane-1,3-dione ring, isoxazolidine-3,5-dione ring, barbituric acid ring, 2,3-dihydrobenzofuran-3-one ring, pyrazolotriazole ring (for example, 7H-pyrazolo[1,5-b][1,2,4]triazole, 7H-pyrazolo[5,1-c][1,2,4]triazole, 7H-pyrazolo[1,5-a]benzimidazole etc.), pyrrolotriazole ring (for example, 5H-pyrrolo[1,2-b][1,2,4]triazole, 5H-pyrrolo[2,1-c][1,2,4]triazole etc.), 2-cyclopentene-1,4-dione ring, 2,3-dihydrobenzothiophen-3-one-1,1-dioxide ring, chroman-2,4-dione ring, 2-oxazolin-5-one ring, 2-imidazolin-5-one ring, 2-thiazolin-5-one ring, 1-pyrrolin-4-one ring, 5-oxothiazolidine-2-thione ring, 4-oxothiazolidine-2-thione ring, pyrrolopyrimidinone ring, 1,3-dithiolane ring, thiazolidine ring, 1,3-dithietane ring, 1,3-dioxolane ring and so forth. Among these, preferred are indane-1,3-dione ring, pyrrolidine-2,4-dione ring, pyrazolidine-3,5-dione ring, 5-pyrazolone ring, barbituric acid ring, 2-oxazolin-5-one ring and so forth.

The compound represented by the formula (4) will be described below.

In the formula (4), examples of the substituent represented by $R^{14}$ include those explained as the substituent represented by $R^{11}$, $R^{12}$ or $R^{13}$ in the formula (3).

The substituent represented by $R^{14}$ may preferably be an electron withdrawing group or an aryl group. Where $R^{14}$ represents an electron withdrawing group, the electron withdrawing group may preferably be a group having a total carbon atom number of from 0 to 30, such as cyano group, nitro group, an acyl group, a formyl group, an alkoxycarbonyl group, an aryloxycarbonyl group, an alkylsulfonyl group, an arylsulfonyl group, a carbamoyl group, a sulfamoyl group, a perfluoroalkyl group, a trifluoromethyl group, a phosphoryl group, an imino group, a sulfonamide group, or a saturated or unsaturated heterocyclic group, more preferably cyano group, an acyl group, a formyl group, an alkoxycarbonyl group, a carbamoyl group, a sulfamoyl group, an alkylsulfonyl group, an arylsulfonyl group, a sulfonamide group or a heterocyclic group, particularly preferably cyano group, a formyl group, an acyl group, an alkoxycarbonyl group, a carbamoyl group or a heterocyclic group.

Where $R^{14}$ represents an aryl group, the aryl group may preferably be a substituted or unsubstituted phenyl group having a total carbon atom number of from 6 to 30. Examples of the substituent include those described as the substituent represented by $R^{11}$, $R^{12}$ or $R^{13}$ in the formula (3). An electron withdrawing group is preferred.

$R^{14}$ is particularly preferably cyano group, an alkoxycarbonyl group, a carbamoyl group, a heterocyclic group or a substituted or unsubstituted phenyl group, and most preferably cyano group, a heterocyclic group or an alkoxycarbonyl group.

The compound represented by the formula (5) will be described in detail below.

In the formula (5), X and Y each independently represent hydrogen atom or a substituent, and A and B each independently represent an alkoxy group, an alkylthio group, an alkylamino group, an aryloxy group, an arylthio group, an anilino group, a heterocyclylthio group, a heterocyclyloxy group or a heterocyclylamino group, and X and Y or A and B may be combined with each other to form a ring structure.

Examples of the substituent represented by X or Y in the formula (5) include those described as the substituent represented by $R^{11}$, $R^{12}$ or $R^{13}$ in the formula (3). Specific examples include an alkyl group (including a perfluoroalkyl group and trichloromethyl group), an aryl group, a heterocyclic group, a halogen atom, cyano group, nitro group, an alkenyl group, an alkynyl group, an acyl group, a formyl group, an alkoxycarbonyl group, an aryloxycarbonyl group, an imino group, an imino group substituted at N atom, a carbamoyl group, a thiocarbonyl group, an acyloxy group, an acylthio group, an acylamino group, an alkylsulfonyl group, an arylsulfonyl group, a sulfamoyl group, a phosphoryl group, carboxyl group (or a salt thereof), sulfo group (or a salt thereof), hydroxyl group (or a salt thereof), mercapto group (or a salt thereof), an alkoxy group, an aryloxy group, a heterocyclyloxy group, an alkylthio group, an arylthio group, a heterocyclylthio group, an amino group, an alkylamino group, an anilino group, a heterocyclylamino group, a silyl group and the like.

These groups may further have one or more substituents. X and Y may be combined with each other to form a ring structure, and the ring structure formed may be either a non-aromatic carbon ring or a non-aromatic heterocycle.

In the formula (5), the substituent represented by X or Y may preferably be a substituent having a total carbon number of from 1 to 50, more preferably from 1 to 35, such as cyano group, an alkoxycarbonyl group, an aryloxycarbonyl group, a carbamoyl group, an imino group, an imino group substituted at N atom, a thiocarbonyl group, a sulfamoyl group, an alkylsulfonyl group, an arylsulfonyl group, nitro group, a perfluoroalkyl group, an acyl group, a formyl group, a phosphoryl group, an acylamino group, an acyloxy group, an acylthio group, a heterocyclic group, an alkylthio group, an alkoxy group, an aryl group or the like.

In the formula (5), X and Y are more preferably cyano group, nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an imino group substituted at N atom, a phosphoryl group, a trifluoromethyl group, a heterocyclic group, a substituted phenyl group or the like, particularly preferably cyano group, an alkoxycarbonyl group, a carbamoyl group, an alkylsulfonyl group, an arylsulfonyl group, an acyl group, an acylthio group, an acylamino group, a thiocarbonyl group, a formyl group, an imino group, an imino group substituted at N atom, a heterocyclic group, a phenyl group substituted by an arbitrary electron withdrawing group or the like.

X and Y are also preferably combined with each other to form a non-aromatic carbon ring or a non-aromatic heterocycle. The ring structure formed is preferably a 5-, 6- or 7-membered ring having a total carbon atom number of from 1 to 40, more preferably from 3 to 30. Examples of the ring structure formed by X and Y are similar to those exemplified for the non-aromatic 5- to 7-membered ring that can be formed by Z and $R^{11}$ bonded together, and the preferred scope thereof are also similar to that of the ring structure formed by Z and $R^{11}$. Those rings may further have a substituent. Preferred examples of the substituent include an acyl group, a carbamoyl group, an oxycarbonyl group, a thiocarbonyl group, a sulfonyl group, an imino group, an imino group substituted at N atom, an acylamino group, a carbonylthio group and so forth.

In the formula (5), A and B each independently represent an alkoxy group, an alkylthio group, an alkylamino group, an aryloxy group, an arylthio group, an anilino group, a heterocyclylthio group, a heterocyclyloxy group or a heterocyclylamino group, which may be combined with each other to form a ring structure. The substituents represented by A and B in the formula (5) are preferably a group having a total carbon atom number of from 1 to 40, more preferably from 1 to 30, and the group may further have one or more substituents.

In the formula (5), A and B are more preferably combined with each other to form a ring structure. The ring structure formed is preferably a 5-, 6- or 7-membered non-aromatic heterocycle having a total carbon atom number of from 1 to 40, more preferably from 3 to 30. Examples of a structure formed by the linking of A and B (—A—B—) include —O—$(CH_2)_2$—O—, —O—$(CH_2)_3$—O—, —S—$(CH_2)_2$—S—, —S—$(CH_2)_3$—S—, —S-ph-S—, —N$(CH_3)$—$(CH_2)_2$—O—, —N$(CH_3)$—$(CH_2)_2$—S—, —O—$(CH_2)_2$—S—, —O—$(CH_2)_3$—S—, —N$(CH_3)$-ph-O—, —N$(CH_3)$-ph-S—, —N(ph)-$(CH_2)_2$—S— and the like.

In the compounds represented by the formulas (3), (4) and (5) for use in the present invention, an group capable of adsorbing to silver halide may be introduced. Examples of the adsorbing group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercaptoheterocyclic group and a triazole group. The adsorbing group to silver halide may be formed as a precursor. Examples of the precursor include the groups described in JP-A-2-285344.

In the compounds represented by the formulas (3), (4) and (5) for use in the present invention, a ballast group or a polymer commonly used in the field of immobile photographic additives such as a coupler, may be introduced. The compounds in which the ballast group is introduced may be preferred for the present invention. The ballast group is a group having 8 or more carbon atoms and being relatively inactive in the photographic performance. Examples of the ballast group include an alkyl group, an aralkyl group, an alkoxy group, a phenyl group, an alkylphenyl group, a phenoxy group, an alkylphenoxy group and the like. Examples of the polymer include those described in JP-A-1-100530 and the like.

The compounds represented by the formulas (3), (4) and (5) for use in the present invention may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclyl)thio group, or a dissociative group capable of dissociation by a base (e.g., carboxy group, sulfo group, an acylsulfamoyl group, a carbamoylsulfamoyl group), preferably a group containing an ethyleneoxy group or a propyleneoxy group as a repeating unit, or an (alkyl, aryl or heterocyclyl)thio group. Specific examples of these groups include the compounds described in JP-A-63-29751, U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, JP-A-63-234246, JP-A-2-285344, JP-A-1-100530, JP-A-7-234471, JP-A-5-333466, JP-A-6-19032, JP-A-6-19031, JP-A-5-45761, U.S. Pat. Nos. 4,994,365and4,988,604, JP-A-3-259240, JP-A-7-5610, JP-A-7-244348 and German Patent No. 4,006,032.

Particularly useful compounds used for the present invention as the nucleating agent are the substituted alkene derivatives represented by the formula (3). Among those, further useful compounds are those compounds of the formula (3) wherein Z and $R^{11}$ are combined with each other to form a 5- to 7-membered non-aromatic ring structure, and one of $R^{12}$ and $R^{13}$ represents hydrogen atom, and the other represents hydroxyl group (or a salt thereof), mercapto group (or a salt thereof), an alkoxy group, an aryloxy group, a heterocyclyloxy group, an alkylthio group, an arylthio group, a heterocyclylthio group, an amino group or a heterocyclic group.

Specific examples of the compounds represented by the formulas (3), (4) and (5) for use in the present invention are shown below. However, the scope of the present invention is not limited to the following compounds.

C-1

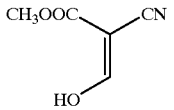

C-2

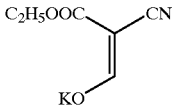

C-3

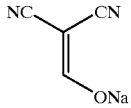

C-4

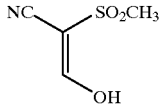

C-5

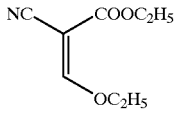

C-6

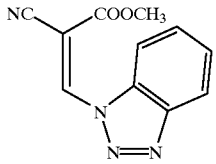

C-7

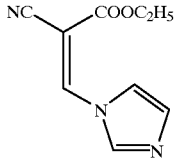

C-8

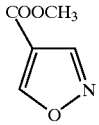

C-9

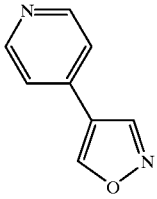

C-10

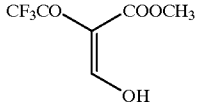

-continued
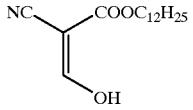
C-11
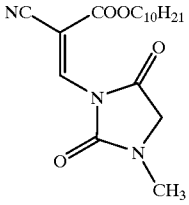
C-12
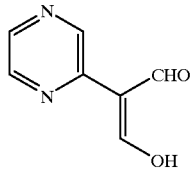
C-13
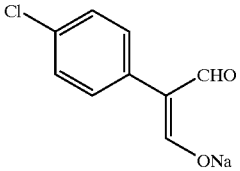
C-14
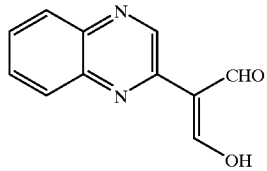
C-15
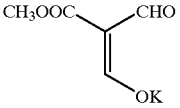
C-16
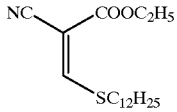
C-17
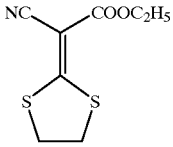
C-18
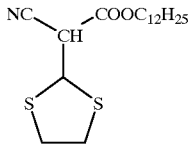
C-19
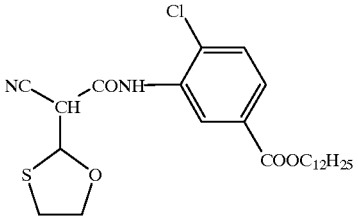
C-20
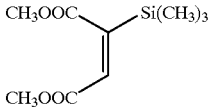
C-21
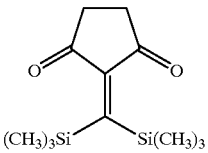
C-22
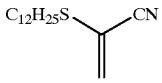
C-23
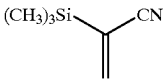
C-24
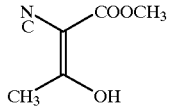
C-25
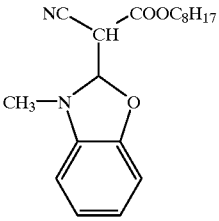
C-26

-continued
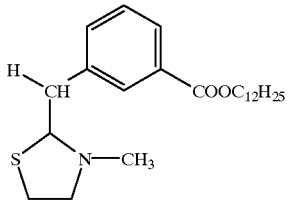
C-27
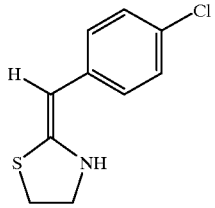
C-28
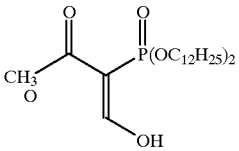
C-29
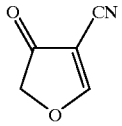
C-30
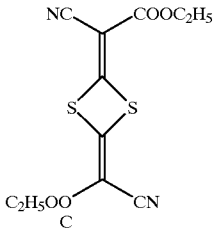
C-31
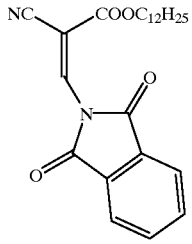
C-32
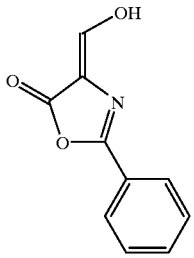
C-33
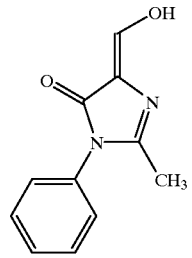
C-34
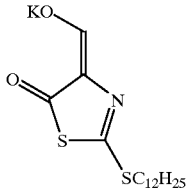
C-35
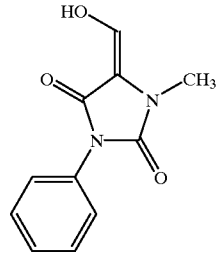
C-36
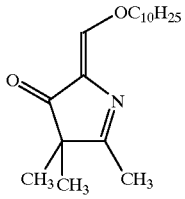
C-37
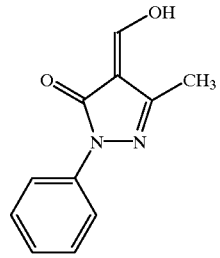
C-38

-continued
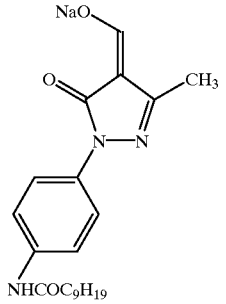
C-39
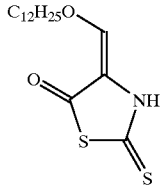
C-40
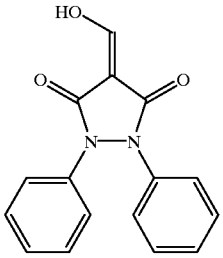
C-41
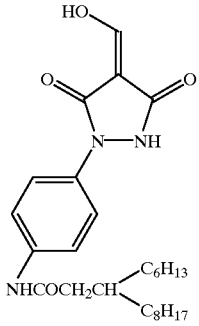
C-42
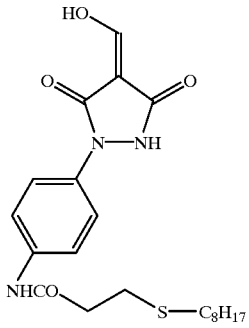
C-43
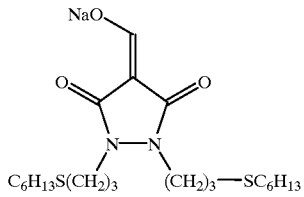
C-44
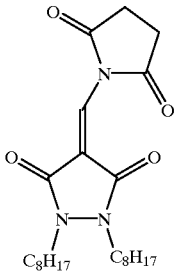
C-45
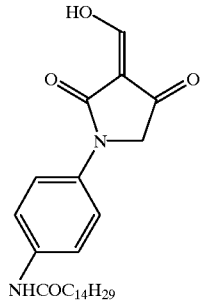
C-46

-continued
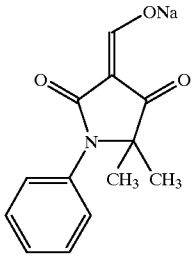
C-47
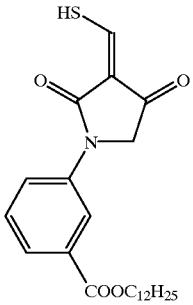
C-48
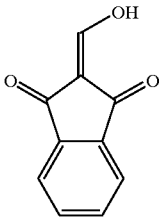
C-49
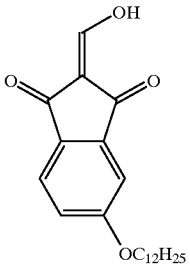
C-50
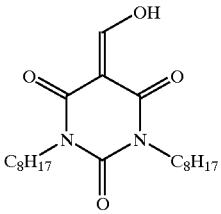
C-51
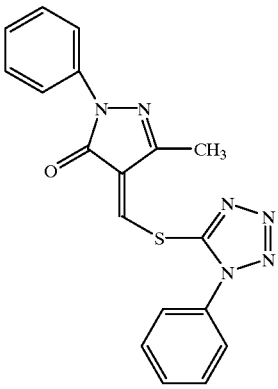
C-52
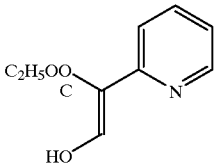
C-53
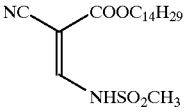
C-54
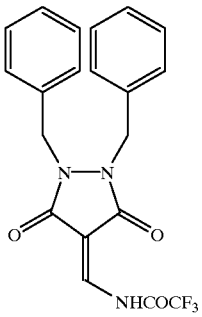
C-55
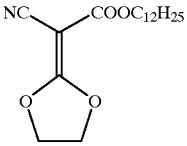
C-56

-continued
C-57
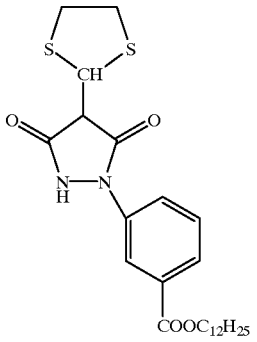
C-58
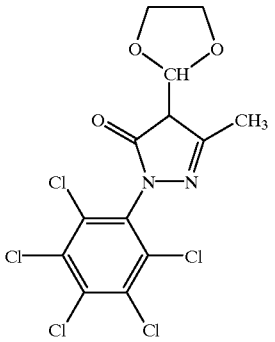
C-59
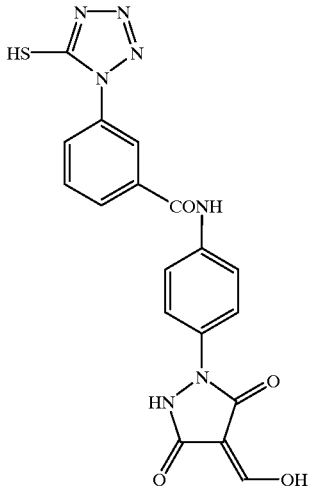
C-60
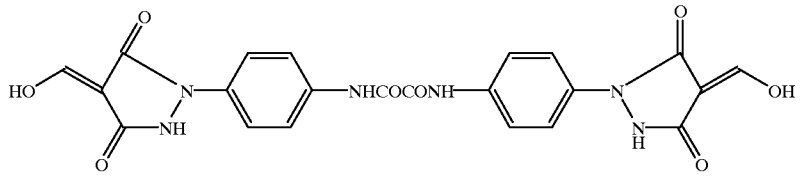
C-61
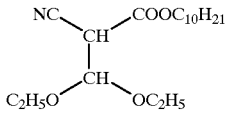
C-62
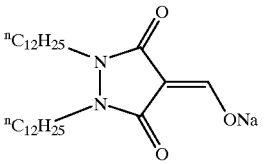
C-63
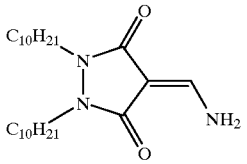
C-64
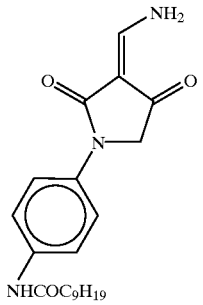

-continued
C-65
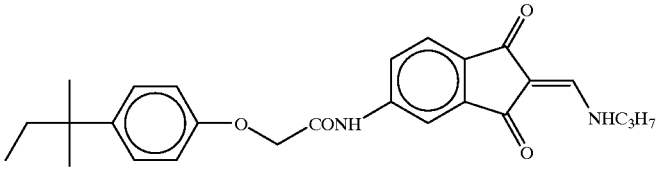
C-66
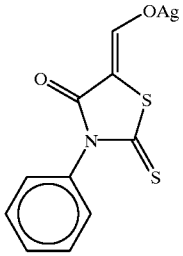
C-67
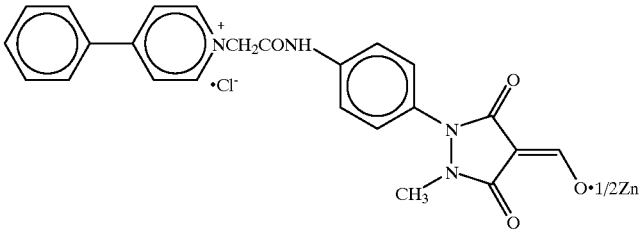
C-68
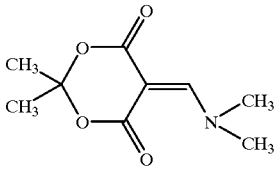
C-69
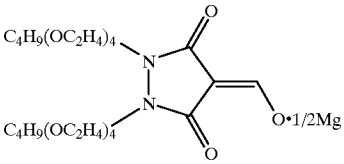
C-70
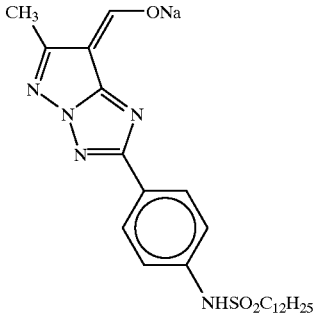
C-71
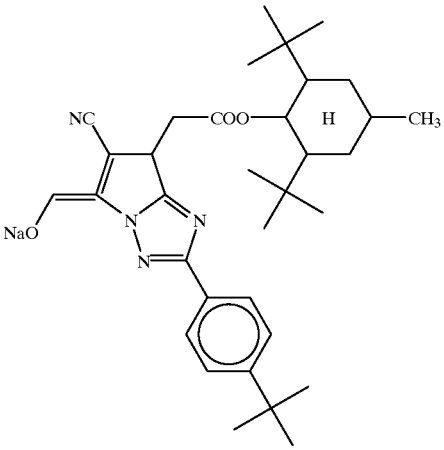

-continued

C-72

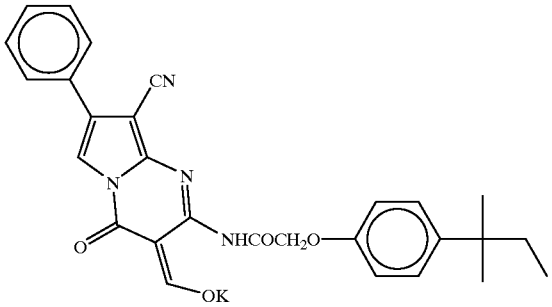

C-73

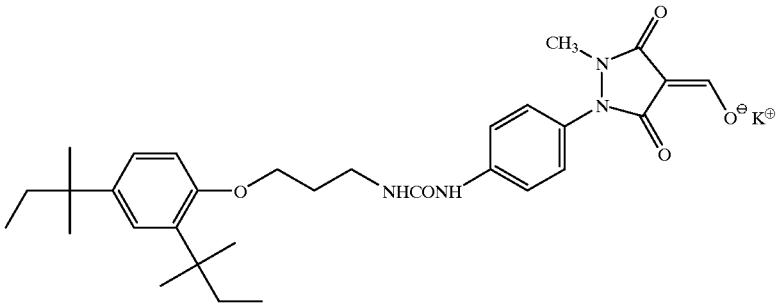

C-62

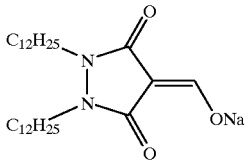

C-74

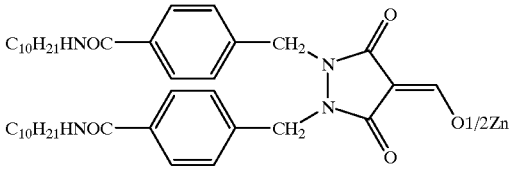

C-75

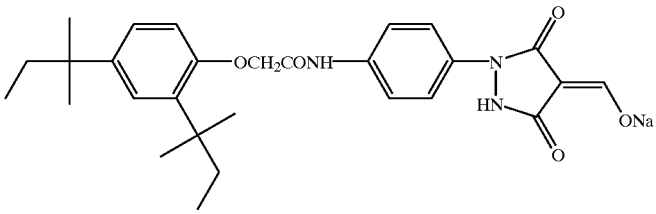

The compounds represented by formulas (3), (4) and (5) can be easily synthesized according to known methods. For example, the compounds may be synthesized by referring to the methods described in U.S. Pat. Nos. 5,545,515, 5,635,339 and 5,654,130, International Patent Publication W097/34196 or Japanese Patent Application Nos. 9-354107, JP-A-11-133546 and JP-A-11-95365.

The compounds represented by the formulas (3), (4) and (5) may be used alone or in combination of two or more compounds. In addition to these compounds, any of the compounds described in U.S. Pat. Nos. 5,545,515, 5,635,339, 5,654,130, 5,705,324, International Patent Publication WO97/34196, U.S. Pat. No. 5,686,228 or Japanese Patent Application Nos. 8-279962, 9-228881, JP-A-10-161270, JP-A-11-119372, Japanese Patent Application No. 9-354107, JP-A-11-133546, JP-A-11-119372, JP-A-11-109546, JP-A-11-95365, JP-A-11-95366 and JP-A-11-149136 may also be used in combination.

The compounds represented by the formulas (3), (4) and (5) for use in the present invention may be used after being dissolved in water or an appropriate organic solvent such as alcohol (e.g., methanol, ethanol, propanol, fluorinated alcohol), ketone (e.g., acetone, methyl ethyl ketone), dimethylformamide, dimethyl sulfoxide or methyl cellosolve.

The compounds may also be used as an emulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compounds may be used after dispersion of a powder of the compounds in an appropriate solvent such as water by using a ball mill, a colloid mill or the like, or by means of ultrasonic wave according to a known method for solid dispersion.

The compounds represented by the formulas (3), (4) and (5) for use in the present invention may be added to any layers on a support provided on the side of the image-forming layer, i.e., the image-forming layer and the other layers provided on the same side. The compounds may preferably be added to the image-forming layer or a layer adjacent thereto.

The amount of the compounds represented by the formulas (3), (4) and (5) for use in the present invention is preferably from $1\times10^{-6}$ to 1 mol, more preferably from $1\times10^{-5}$ to $5\times10^{-1}$ mol, most preferably from $2\times10^{-5}$ to $2\times10^{-1}$ mol, per mole of silver.

In the present invention, a hydrazine derivative may be used as the nucleating agent. Further, the aforementioned nucleating agents may be used in combination with a hydrazine derivative. In such a case, those hydrazine derivatives mentioned below are preferably used. The hydrazine derivatives that can be used for the present invention can be synthesized by various methods described in the patent documents mentioned below.

Examples of the hydrazine derivatives include, for example, the various hydrazine derivatives disclosed in JP-A-10-161270; the compounds represented by (Chem. 1) of JP-B-6-77138, specifically, the compounds described at pages 3 and 4 of the publication; the compounds represented by the formula (I) of JP-B-6-93082, specifically, Compounds 1 to 38 described at pages 8 to 18 of the publication; the compounds represented by the formulas (4), (5) and (6) of JP-A-6-230497, specifically, Compounds 4-1 to 4-10 described at pages 25 and 26, Compounds 5-1 to 5-42 described at pages 28 to 36 and Compounds 6-1 to 6-7 described at pages 39 and 40 of the publication; the compounds represented by the formulas (1) and (2) of JP-A-6-289520, specifically, Compounds 1-1) to 1-17) and 2-1) described at pages 5 to 7 of the publication; the compounds represented by (Chem. 2) and (Chem. 3) of JP-A-6-313936, specifically, compounds described at pages 6 to 19 of the publication; the compound represented by (Chem. 1) of JP-A-6-313951, specifically, the compounds described at pages 3 to 5 of the publication; the compound represented by the formula (I) of JP-A-7-5610, specifically, Compounds I-1 to I-38 described at pages 5 to 10 of the publication; the compounds represented by the formula (II) of JP-A-7-77783, specifically, Compounds II-1 to II-102 described at pages 10 to 27 of the publication; the compounds represented by the formulas (H) and (Ha) of JP-A-7-104426, specifically, Compounds H-1 to H-44 described at pages 8 to 15 of the publication; the compounds characterized by having in the vicinity of the hydrazine group an anionic group or a nonionic group capable of forming an intramolecular hydrogen bond with hydrogen atom of hydrazine, described in JP-A-9-22082, particularly, the compounds represented by the formulas (A), (B), (C), (D), (E) and (F), specifically, Compounds N-1 to N-30 described in the publication; the compound represented by the formula (1) described in JP-A-9-22082, specifically, Compounds D-1 to D-55 described in the publications; various hydrazine derivatives described at pages 25 to 34 of Kochi Gijutsu (Known Techniques), pages 1 to 207, Aztech (issued on Mar. 22, 1991); and Compounds D-2 and D-39 described in JP-A-62-86354 (pages 6 and 7).

These hydrazine derivatives for use in the present invention may be used after being dissolved in an appropriate organic solvent such as alcohol (e.g., methanol, ethanol, propanol, fluorinated alcohol), ketone (e.g., acetone, methyl ethyl ketone), dimethylformamide, dimethyl sulfoxide or methyl cellosolve.

The compounds may also be used as an emulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compounds may be used after dispersion of a powder of the compounds in water by using a ball mill, a colloid mill, or by means of ultrasonic wave according to a known method for solid dispersion.

The hydrazine derivatives that are used for the present invention may be added to any layers on a support provided on the side of the image-forming layer, i.e., the image-forming layer or other binder layers provided on the same side. The compounds may preferably be added to the image-forming layer or a binder layer adjacent thereto.

The amount of the hydrazine derivatives is preferably from $1\times10^{-6}$ to 1 mol, more preferably from $1\times10^{-5}$ to $5\times10^{-1}$ mol, particularly preferably from $2\times10^{-5}$ to $2\times10^{-1}$ mol, per mole of silver.

In the present invention, a contrast accelerator may be used in combination with the above-described nucleating agent for the formation of an ultrahigh contrast image. For example, amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1-CN-13; hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14 may be used.

Method for preparation and addition as well as amounts of the aforementioned contrast accelerators may be applied as those described in the patent publications cited above.

In the present invention, an acid formed by hydration of diphosphorus pentoxide or a salt thereof is preferably used together with the nucleating agent. Examples of the acid formed by hydration of diphosphorus pentoxide or a salt thereof include metaphosphoric acid (salt), pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium orthodihydrogenphosphate, sodium hexametaphosphate, ammonium hexametaphosphate and so forth.

The acid formed by hydration of diphosphorus pentoxide or a salt thereof that can be preferably used for the present invention is added to the image-forming layer or a binder layer adjacent thereto in order to obtain the desired effect with a small amount.

The acid formed by hydration of diphosphorus pentoxide or a salt thereof may be used in a desired amount (coating amount per 1 $m^2$ of the photosensitive material) depending on the desired performance including sensitivity and fog, preferably in an amount of 0.1–500 $mg/m^2$, more preferably 0.5–100 $mg/m^2$.

The reducing agent used for the present invention will be explained hereafter.

The heat-developable photosensitive material of the present invention contains a reducing agent for the organic silver salt. The reducing agent for organic silver salt may be any substance, preferably an organic substance, which reduces the silver ion to metal silver. Conventional photographic developers such as phenidone, hydroquinone and catechol are useful. A hindered phenol reducing agent is preferred. The reducing agent may also be a so-called precursor that is modified so as to effectively exhibit the function only at the time of development.

For the heat-developable photosensitive material using an organic silver salt, variety of reducing agents are disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-

108654, JP-A-56-146133, JP-A-57-82828, JP-A-57-82829, JP-A-6-3793, U.S. Pat. Nos. 3,667,9586, 3,679,426, 3,751,252, 3,751,255, 3,761,270, 3,782,949, 3,839,048, 3,928,686 and 5,464,738, German Patent No. 2,321,328, European Patent 692732 and the like. Examples include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid such as a combination of 2,2'-bis(hydroxymethyl)propionyl-β-phenylhydrazine with an ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl) methane; combinations of a bis-β-naphthol with a 1,3-dihydroxybenzene derivative (e.g., 2,4-dihydroxybenzophenone, 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethyl-hexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols such as tocopherol. Particularly preferred reducing agents are bisphenols and chromanols.

In the present invention, the reducing agent may be added in any form, for example, as a solution, powder, solid fine grain dispersion or the like. The solid fine grain dispersion is performed using a known pulverizing means (e.g., a ball mill, a vibrating ball mill, a sand mill, a colloid mill, a jet mill, a roller mill). At the time of solid fine grain dispersion, a dispersion aid may also be used.

Particularly preferred reducing agents are compounds that have at least one phenolic hydroxyl group and its ortho position is substituted with a substituent other than hydrogen atom. They may contain one phenol ring, or two or more phenol rings in their molecules. Specific examples of the particularly preferred reducing agents are those disclosed in the JP-A-9-274274, [0062] to [0074], and more specifically, the compounds of [Chem. 28] to [Chem. 32] falling within formulas (Ia), (Ib), (IIa), (IIb), (III), (IVa), (IVb) and the like.

The layer to be added with the reducing agent may be any layer on the side of the image-forming layer.

The amount of the reducing agent in the present invention may preferably be $1\times10^{-3}$ to 10 mol, particularly from $10^{-2}$ to 1.5 mol, per mole of silver.

According to the present invention, the molar ratio of the reducing agent and the nucleating agent may preferably be selected from the range of from $1:10^{-3}$ to $1:10^{-1}$.

When an additive known as a "color-tone adjustor" capable of improving an image is added, an optical density may sometimes increase. The color-tone adjustor may also be sometimes advantageous in forming a black silver image. The color-tone adjustor may preferably be added in the side having an image-forming layer in an amount of from 0.1 to 50% by mole, more preferably from 0.5 to 20% by mole per mole of silver. The color-tone adjustor may be a so-called precursor that is modifired to effectively act only at the time of development.

For the heat-developable photosensitive material using an organic silver salt, a wide variety of color-tone adjustors are disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent No. 1,380,795, Belgian Patent No. 841910 and the like. Examples of the color-tone adjustor include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and certain photobleaching agents, such as N,N'-hexamethylenebis(1-carbamoyl-3,5-dimethylpyrazole), 1,8-(3,6-diazaoctane)bis(iso-thiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative such as phthalic acid, 4-methylphthalic acid, 4-nitrophthalic acid, and tetrachlorophthalic acid anhydride; phthalazine, phthalazine derivatives such as 4-(1-naphthyl)phthalazine, 6-chlorophthalazine, 5,7-dimethoxyphthalazine, 6-isopropylphthalazine, 6-iso-butyl phthalazine, 6-tert-butylphthalazine, 5,7-dimethyphthalazine, and 2,3-dihydrophthalazine and metal salts thereof; combinations of aphthalazine or derivatives thereof and a phthalic acid derivative such as phthalic acid, 4-methylphthalic acid, 4-nitrophthalic acid, and tetrachlorophthalic acid anhydride; quinazolinedione, benzoxazine and naphthoxazine derivatives; rhodium complexes which function not only as a color-tone adjustor but as a halide ion source for the formation of silver halide at the site, such as ammonium hexachlororhodate(III), rhodium bromide, rhodium nitrate and potassium hexachlororhodate(III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione, and 6-nitro-1,3-benzoxazin-2,4-dione; pyrimidines and asymmetric triazines such as 2,4-dihydroxpyrimidine and 2-hydroxy-4-aminopyrimidine; and azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene and the like.

The color-tone adjustor for use in the present invention may be added in any form, for example, as a solution, a powder, a solid fine grain dispersion and the like. The solid fine grain dispersion is performed using a known pulverization means (e.g., a ball mill, a vibrating ball mill, a sand mill, a colloid mill, a jet mill, a roller mill). In the solid fine grain dispersion, a dispersion aid may also be used.

The heat-developable photosensitive material of the present invention preferably has a film surface pH of 6.0 or less, more preferably 5.5 or less, further preferably 5.3 or less, before heat development in order to reduce fog caused by storage. While the lower limit is not particularly limited, it is normally around 3.

For controlling the film surface pH, an organic acid such as phthalic acid derivatives or a nonvolatile acid such as sulfuric acid, and a volatile base such as ammonia are preferably used to lower the film surface pH. In particular, ammonia is preferred to achieve a low film surface pH, because it is highly volatile and therefore it can be removed before coating or heat development.

The film surface pH of the heat-developable photosensitive material of the present invention is preferably measured as follows. A 2.5 cm×2.5 cm sample of the heat-developable photosensitive material before heat development is folded into a boat shape. The 300 $\mu$l of distilled water is dropped onto the image-forming layer side of the sample, and left stand for 30 minutes. Then, pH of the dropped water is measured by pH BOY-P2 (semiconductor type pH meter, Shin-Dengen Kogyo Co., Ltd.) over 1 minute.

In the present invention, the image-forming layer contains an organic binder. As the organic binder, there can be used conventionally known various synthetic polymers (for example, cellulose derivatives such as cellulose acetate, cellulose acetate butyrate, sodium salt of craboxymethylcellulose (CMC) and hydroxycellulose, vinyl polymers such as polyvinyl alcohol, polyvinyl acetate, polyvinyl butyral and polyvinyl formal), gelatin, agar, polysaccharides and so forth. In the present invention, at least one of the image-forming layers is preferably an image-forming layer in which 50% by weight or more of the total binder is formed from an aqueous dispersion of thermoplastic resin. Such an aqueous dispersion of thermoplastic resin may be used not only for the image-forming layer, but also for a protective layer, backing layer or the like. It is preferably used, in particular, when the heat-developable photosensitive material of the present invention is used for printing applications, in which dimensional change causes a problem.

The aqueous dispersion of thermoplastic resin preferably used for the present invention may be any one of those in which a polymer is emulsified in a dispersion medium, those obtained by emulsion-polymerization, those obtained by micell dispersion, those in which a polymer has a partially hydrophilic structure in their molecule so as to allow molecular dispersion of molecular chain themselves and so forth. Those aqueous dispersions are generally referred to as polymer latex in its broad sense. Details of polymer latex are described in Gosei Jushi Emulsion (Synthetic Resin Emulsion), compiled by Taira Okuda and Hiroshi Inagaki, issued by Kobunshi Kanko Kai (1978), Gosei Latex no Oyo (Application of Synthetic Latex), compiled by Takaaki Sugimura, Yasuo Kataoka, Souichi Suzuki and Keiji Kasahara, issued by Kobunshi Kanko Kai (1993), and Soichi Muroi, Gosei Latex no Kagaku (Chemistry of Synthetic Latex), Kobunshi Kanko Kai (1970) and the like. The dispersion particles preferably have an average particle size of from 1 to 50,000 nm, more preferably from 5 to 1,000 nm. The particle size distribution of the dispersed particles is not particularly limited, and the dispersed particles may have a broad particle size distribution or a monodisperse particle size distribution.

As the aqueous dispersion of thermoplastic resin used for the present invention, a so-called core/shell type latex may be used, as well as the normal polymer latex having a uniform structure. Where the core/shell latex is used, preferable properties may sometimes be obtained when a core and a shell have different glass transition temperatures.

The thermoplastic resin used as the binder in the heat-developable photosensitive material of the present invention has a glass transition temperature (Tg) of which preferred range may be different among those for the protective layer, the backing layer and the image-forming layer. In the image-forming layer, the glass transition temperature is preferably 40° C. or lower, more preferably from −30° C. to 40° C., so as to accelerate the diffusion of the photographically useful materials during the heat development. In the protective layer and the backing layer, the glass transition temperature is preferably 25° C. to 70° C., because the protective layer and the backing layer are brought into contact with various instruments.

The polymer latex for use in the present invention preferably has a minimum film-forming temperature (MFT) of from −30 to 90° C., more preferably from 0 to 70° C. In order to control the minimum film-forming temperature, a film-forming aid may be added. The film-forming aid is also called a transient plasticizer and it is an organic compound (usually an organic solvent) capable of reducing the minimum film-forming temperature of the polymer latex. Such an organic compound is described in Souichi Muroi, Gosei Latex no Kagaku (Chemistry of Synthetic Latex), Kobunshi Kanko Kai (1970).

The polymer species of the polymer latex for use in the present invention may be of acrylic resin, vinyl acetate resin, polyester resin, polyurethane resin, rubber-based resin, vinyl chloride resin, vinylidene chloride resin, polyolefin resin or a copolymer thereof. The polymer may be a straight-chained polymer, a branched polymer or a cross-linked polymer. The polymer may be a so-called homopolymer obtained by polymerizing a single kind of monomers or may be a copolymer obtained by polymerizing two or more kinds of monomers. The copolymer may be either a random copolymer or a block copolymer. The polymer preferably has a number average molecular weight of from 5,000 to 1,000,000,more preferably on the order of from 10,000 to 100,000. If the molecular weight is too small, the image-forming layer is deficient in the mechanical strength, whereas if it is excessively large, the film-forming property is disadvantageously poor.

Specific examples of the aqueous dispersion of thermoplastic resin (polymer latex) used as a binder in the image-forming layer of the heat-developable photosensitive material of the present invention include a methyl methacrylate/ethyl acrylate/methacrylic acid copolymer latex, methyl methacrylate/2-ethylhexyl acrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex and vinylidene chloride/ethyl acrylate/ acrylonitrile/methacrylic acid copolymer latex. Such polymers are also commercially available and examples of the polymer which can be used include acrylic resins such as CEBIAN A-4635, 46583, 4601 (all produced by Dicel Kagaku Kogyo Co., Ltd), Nipol Lx811, 814, 821, 820, 857 (all produced by Nippon Zeon Co., Ltd.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc.), Nipol Lx416, 410, 438C, 2507 (all produced by Nippon Zeon Co., Ltd.); vinyl chloride resins such as G351, G576 (both produced by Nippon Zeon Co., Ltd.); vinylidene chloride resins such as L502, L513 (both produced by Asahi Chemical Industry Co., Ltd.), ARON D7020, D5040, D5071 (all produced by Mitsui Toatsu Co., Ltd.); and olefin resins such as CHEMIPEARL S120 and SAb100 (both produced by Mitsui Petrochemical Industries, Ltd.) and the like. These polymers may be used alone or if desired, as a blend of two or more thereof.

The image-forming layer of the present invention preferably contains the aforementioned polymer latex in an amount of 50% by weight or more, more preferably 70% by weight or more, based on the total binder.

If desired, the image-forming layer may contain a hydrophilic polymer in an amount of 50% by weight or less, preferably 10% by weight, of the total binder, such as gelatin, polyvinyl alcohol, methyl cellulose, hydroxypropyl cellulose, carboxymethyl cellulose and hydroxypropylmethyl cellulose. The amount of the hydrophilic polymer added is preferably 30% by weight or less, more preferably 15% by weight or less of the total binder in the image-forming layer.

The image-forming layer (photographic layer) in the present invention is preferably formed by coating an aqueous coating solution and then drying the coating solution. The term "aqueous" as used herein means that water content of the solvent (dispersion medium) in the coating solution is 60% by weight or more. In the coating solution, the component other than water may be a water-miscible organic solvent such as methyl alcohol, ethyl alcohol, isopropyl alcohol, methyl cellosolve, ethyl cellosolve, dimethylformamide, and ethyl acetate. Examples of the solvent composition include water/methanol=90/10, water/methanol=70/30, water/ethanol=90/10, water/isopropanol=90/10, water/dimethylformamide=95/5, water/methanol/dimethylformamide=80/15/5 and water/methanol/dimethylformamide=90/5/5 (the numerals are in % by weight) as well as water alone.

The total amount of the binder in the image-forming layer according to the present invention is preferably from 0.2 to 30 g/m$^2$, more preferably from 1 to 15 g/m$^2$ of the photosensitive material. Each layer may contain a crosslinking agent for crosslinking, surfactant for improving coatability and the like.

In the present invention, the image-forming layer or another layer adjacent thereto preferably contains a phthalic acid derivative such as phthalic acid, 4-methylphthalic acid, tetrachlorophthalic acid, tetrafluorophthalic acid, 3-methylphthalic acid, 3,5-dimethylphthalic acid, 4,5-dichlorophthalic acid, 3-phenylphthalic acid and 3-nitrophthalic acid.

The phthalic acid derivative may be added to any of a photosensitive layer such as the image-forming layer and a non-photosensitive layer such as a protective layer on the image-forming layer side.

The phthalic acid derivative can be added in an amount of from $10^{-4}$ to 1 mol, preferably from $10^{-3}$ to 0.3 mol, more preferably from $10^{-3}$ to 0.1 mol, per mole of silver. The phthalic acid derivatives may be used alone, or as any combination of two or more kinds of them.

The phthalic acid derivative may be added in any form, for example, as a solution, powder, solid fine grain dispersion or the like. The solid fine grain dispersion is performed using a known pulverizing means (e.g., a ball mill, a vibrating ball mill, a sand mill, a colloid mill, a jet mill, a roller mill). At the time of solid fine grain dispersion, a dispersion aid may also be used.

The silver halide emulsion and/or organic silver salt for use in the present invention can be further prevented from the production of additional fog or can be stabilized against the reduction in sensitivity during the stock storage, by an antifoggant, a stabilizer or a stabilizer precursor. Examples of antifoggants, stabilizers and stabilizer precursors which can be appropriately used alone or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechol described in U.S. Pat. No. 3,235,652, oximes, nitrons and nitroindazoles described in British Patent No. 623,448, polyvalent metal salts described in U.S. Pat. No. 2,839,405, thiuroniumsalts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, and phosphorus compounds described in U.S. Pat. No. 4,411,985.

Antifoggants which are preferably used in the present invention are organic halides other than the compounds of the formulas (1) and (2), and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, U.S. Pat. Nos. 5,340,712, 5,369,000 and 5,464,737.

The antifoggant preferably used in the present invention may be added in any form of a solution, a powder and a solid fine grain dispersion. The solid fine grain dispersion is performed using a known pulverization means (e.g., ball mill, vibration ball mill, sand mill, colloid mill, jet mill, roller mill etc.). In the solid fine grain dispersion, a dispersion aid may also be used.

Although not necessary for practicing the present invention, it is advantageous in some cases to add a mercury (II) salt as an antifoggant to the emulsion layer (image-forming layer). Preferred mercury (II) salts to this purpose are mercury acetate and mercury bromide. The addition amount of mercury for use in the present invention is preferably from $1\times10^{-9}$ to $1\times10^{-3}$ mol, more preferably from $1\times10^{-8}$ to $1\times10^{-4}$ mol, per mol of silver coated.

The heat-developable photosensitive material of the present invention may contain a benzoic acid for the purpose of achieving high sensitivity or preventing fog. The benzoic acid for use in the present invention may be any benzoic acid derivatives but preferred examples of the structure include the compounds described in U.S. Pat. Nos. 4,784,939, 4,152,160, JP-A-9-329865, JP-A-9-329864, JP-A-9-281637 and so forth. The benzoic acid for use in the present invention may be added to any site of the light-sensitive material but the layer to which the benzoic acid is added is preferably a layer on the side having the photosensitive layer, more preferably an organic silver salt-containing layer. The benzoic acid for use in the present invention may be added at any stage during the preparation of the coating solution. In the case of adding the benzoic acid to an organic silver salt-containing layer, it may be added at any stage from the preparation of the organic silver salt until the preparation of the coating solution but is preferably added in the period after the preparation of the organic silver salt and immediately before the coating. The benzoic acid for use in the present invention may be added in any form of a powder, a solution and a fine particle dispersion, or may be added as a solution containing a mixture of the benzoic acid with other additives such as a sensitizing dye, a reducing agent and a color tone adjustor. The benzoic acid for use in the present invention may be added in any amount, preferably in an amount of $10^{-6}$ to 2 mol, more preferably from $10^{-3}$ to 0.5 mol, per mole of silver.

The heat-developable photosensitive material of the present invention may contain a mercapto compound, a disulfide compound or a thione compound, for example, to control the development by inhibition or acceleration, to improve spectral sensitization efficiency, and to improve storage stability before or after the development.

When a mercapto compound is used in the present invention, a mercapto compound having any chemical structure may be used, and those represented by Ar—SM or Ar—S—S—Ar are preferred, wherein M is hydrogen atom or an alkali metal atom, and Ar is an aromatic ring or condensed aromatic ring containing one or more nitrogen, sulfur, oxygen, selenium or tellurium atoms. Preferably, the heteroaromatic ring may be benzimidazole, naphthimidazole, benzothiazole, naphthothiazole, benzoxazole, naphthoxazole, benzoselenazole, benzotellurazole, carbazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g., Br, Cl), hydroxyl, amino, carboxyl, an alkyl group (e.g., alkyl having one or more carbon atoms, preferably from 1 to 4 carbon atoms), an alkoxy group (e.g., alkoxy having one or more carbon atoms, preferably from 1 to 4 carbon atoms), and an aryl group (which may have one or more substituents). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methyl-pyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-{3-(5-mercaptotetrazolyl)phenyl}urea, 2-mercapto-4-phenyloxazole, N-[3-(mercaptoacetylamino)propyl] carbazole and the like. However, the present invention is not limited to these examples.

The amount of the mercapto compound may preferably be from 0.0001 to 1.0 mol, more preferably from 0.001 to 0.3 mol based on one mole of silver in the emulsion layer.

The photosensitive silver halide used in the present invention will be explained in detail hereafter.

The photosensitive silver halide for use in the present invention is not particularly limited as for the halogen composition, and silver chloride, silver chlorobromide, silver bromide, silver iodobromide, and silver chloroiodobromide may be used. The halide composition may have a uniform distribution in the grains, or the compositions may change stepwise or continuously in the grains. Silver halide grains having a core/shell structure maybe preferably used. Core/shell grains having preferably a double to quintuple structure, more preferably a double to quadruple structure may be used. A technique for localizing silver bromide on silver chloride or silver chlorobromide may also be preferably used.

For the preparation of the photosensitive silver halide used for the present invention, methods well known in the art, e.g., the methods described in Research Disclosure, No. 17029 (June, 1978) and U.S. Pat. No. 3,700,458, can be used. More specifically, applicable methods for the present invention include a method comprising the step of adding a halogen-containing compound to a ready prepared organic silver salt to convert a part of silver of the organic silver salt into a photosensitive silver halide, and a method comprising the step of preparing photosensitive silver halide grains by adding a silver-supplying compound and a halogen-supplying compound to a solution of gelatin or another polymer and then mixing the prepared grains with an organic silver salt. In particular, the latter method is preferred for the present invention. As for a grain size of the photosensitive silver halide, smaller grains are desirable to prevent cloudiness of the photosensitive material after image formation. Specifically, the grain size may preferably be not greater than 0.20 $\mu$m, preferably from 0.01 to 0.15 $\mu$m, more preferably from 0.02 to 0.12 $\mu$m. The term "grain size" used herein means "ridge length" of silver halide grains when the silver halide grains are regular crystals in cubic or octahedral form. Where silver halide grains are tabular grains, the term means the diameter of a circle having the same area as a projected area of the main surface of the tabular grain. Where the silver halide grains are irregular crystals, such as spherical or rod-like grains, the term means the diameter of a sphere having the same volume as the grain.

Examples of the form of silver halide grains include a cubic form, octahedral form, tabular form, spherical form, rod-like form and potato-like form. In particular, cubic grains and tabular grains are preferred for the present invention. When tabular silver halide grains are used, an average aspect ratio may be from 100:1 to 2:1, preferably from 50:1 to 3:1. Silver halide grains having round corners are also preferably used in the present invention. Surface index (Miller index) of outer surfaces of the photosensitive silver halide grains is not particularly limited. However, it is desirable that [100] face be present in a high proportion that can achieve high spectral sensitizing efficiency when a spectral sensitizing dye adsorbed thereto. The proportion of [100] face may be not lower than 50%, preferably at least 65%, and more preferably at least 80%. The proportion of [100] face can be determined using the method described in T. Tani, J. Imaging Sci., 29, 165 (1985), where the difference in adsorption of a sensitizing dye to [111] face and [100] face is utilized.

The photosensitive silver halide grain for use in the present invention preferably contains a metal or metal complex of Group VII or VIII (group 7 to 10) in the periodic table of elements. The metal or center metal of the metal complex of Group VII or VIII of the periodic table is preferably rhodium, rhenium, ruthenium, osmiumoriridium. The metal complex may be used alone, or two or more complexes with the same or different metals may also be used in combination. The metal complex content is preferably from $10^{-9}$ to $10^{-2}$ mol, more preferably from $10^{-8}$ to $10^{-4}$ mol based on one mole of silver. More specifically, the metal complexes having the structures described in JP-A-7-225449 may be used.

As the rhodium compound preferably used in the present invention, a water-soluble rhodium compound may be used. Examples include a rhodium (III) halogenide compounds and rhodium complex salts having a halogen, an amine or an oxalate as a ligand, such as hexachlororhodium(III) complex salt, pentachloroaquorhodium(III) complex salt, tetrachlorodiaquorhodium(III) complex salt, hexabromorhodium(III) complex salt, hexaamminerhodium (III) complex salt and trioxalatorhodium(III) complex salt. The rhodium compound is used after being dissolved in water or an appropriate solvent, and a method commonly used for stabilizing the rhodium compound solution may be applied, for example, a method comprising the step of adding an aqueous solution of hydrogen halide (e.g., hydrochloric acid, hydrobromic acid, hydrofluoric acid) or alkali metal halide (e.g., KCl, NaCl, KBr, NaBr) may be used. Instead of the use of a water-soluble rhodium, different silver halide grains doped beforehand with rhodium may be added and dissolved at the time of preparation of silver halide.

The amount of the rhodium compound is preferably from $1\times10^{-8}$ to $5\times10^{-4}$ mol, more preferably from $5\times10^{-8}$ to $1\times10^{-5}$ mol based on one mole of silver halide.

The rhodium compound may be appropriately added at the time of preparation of the silver halide emulsion grains or at any stage before the coating of the emulsion. The rhodium compound may preferably be added at the time of formation of the emulsion and incorporated in the silver halide grain.

The rhenium, ruthenium or osmium for use in the present invention is added in the form of a water-soluble complex salt described in JP-A-63-2042, JP-A-1-285941, JP-A-2-20852 and JP-A-2-20855. Particularly preferred examples are six-coordinate complex salts represented by the following formula:

$$[ML_6]^{n-}$$

wherein M represents Ru, Re or Os, L represents a ligand, and n represents 0, 1, 2, 3 or 4.

In this case, the counter ion plays no important role and an ammonium or alkali metal may be is used.

Preferred examples of the ligand include a halide ligand, a cyanide ligand, a cyan oxide ligand, a nitrosyl ligand, a thionitrosyl ligand and the like. Specific examples of the complex for use in the present invention are shown below. However, the scope of the present invention is not limited to these examples.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{-}$ | $[RUCl_5(H_2O)]^{2-}$ |
| $[RUCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]^{2-}$ |

-continued

| | | |
|---|---|---|
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(O)_2(CN)_4]^{4-}$ | |

The amount of these compound is preferably from $1\times10^{-9}$ to $1\times10^{-4}$ mol, most preferably from $1\times10^{-8}$ to $1\times10^{-5}$ mol based on one mole of silver halide.

These compounds may be added appropriately at the time of preparation of silver halide emulsion grains or at any stage before the coating of the emulsion. The compounds are preferably added at the time of formation of the emulsion and incorporated in silver halide grains.

For the addition of the compound during the grain formation of silver halide for incorporation in silver halide grains, examples of applicable methods include, for example, a method where a metal complex powder or an aqueous solution of the complex dissolved with NaCl or KCl is added to a water-soluble salt or water-soluble halide solution during the grain formation, a method where the compound is added as a "third" solution at the time of simultaneous mixing of a silver salt and a halide solution to prepare silver halide grains by the simultaneous mixing of the three solutions, or a method where a necessary amount of an aqueous metal complex solution is poured into a reaction vessel during the grain formation. Among these, the method is preferred which comprises the step of adding a metal complex powder or an aqueous solution of the complex dissolved with NaCl or KCl to a water-soluble halide solution.

In order to add the compound to the surface of the grain, a necessary amount of an aqueous metal complex solution may be charged into a reaction vessel immediately after the grain formation, during or after completion of the physical ripening, or at the time of chemical ripening.

As the iridium compound preferably used in the present invention, various compounds may be used. Examples include hexachloroiridium, hexammineiridium, trioxalatoiridium, hexacyanoiridium, pentachloronitrosyliridium and the like. The iridium compound is used after being dissolved in water or an appropriate solvent, and a method commonly used for stabilizing the iridium compound solution, more specifically, a method comprising the step of adding an aqueous solution of hydrogen halide (e.g., hydrochloric acid, hydrobromic acid, hydrofluoric acid) or alkali metal halide (e.g., KCl, NaCl, KBr, NaBr) may be used. Instead of using a water-soluble iridium, different silver halide grains doped beforehand with iridium may be added and dissolved at the time of preparation of silver halide.

The silver halide grain for use in the present invention may further contain a metal atom such as cobalt, iron, nickel, chromium, palladium, platinum, gold, thallium, copper and lead. In the case of cobalt, iron, chromium or ruthenium compound, a hexacyano metal complex is preferably used. Specific examples include ferricyanate ion, ferrocyanate ion, hexacyanocobaltate ion, hexacyanochromate ion and hexacyanoruthenate ion. However, the present invention is not limited to these examples. The metal complex may be added, for example, uniformly in the silver halide grain, or may be added in a higher concentration in the core part, or may be added in a higher concentration in the shell part, and a way of the addition of the metal complex is not particularly limited.

The above-described metal is used preferably in an amount of from $1\times10^{-9}$ to $1\times10^{-4}$ mol based on one mole of silver halide. The metal may be converted into a metal salt in the form of a simple salt, a composite salt or a complex salt, and added at the time of preparation of grains.

The photosensitive silver halide grain may be desalted by water washing according to a method known in the art, such as noodle washing and flocculation. The grain may or may not be desalted in the present invention.

The silver halide emulsion for use in the present invention is preferably subjected to chemical sensitization. The chemical sensitization may be performed by using a known method such as sulfur sensitization, selenium sensitization, tellurium sensitization or noble metal sensitization. These sensitization method may be used alone or in any combination. When these sensitization methods are used in combination, a combination of sulfur sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization, for example, are preferred.

The sulfur sensitization used in the present invention is usually performed by adding a sulfur sensitizer and stirring the emulsion at a high temperature of 40° C. or higher for a given time. A known compound may be used as the sulfur sensitizer, and examples include a sulfur compound contained in gelatin, as well as various sulfur compounds such as thiosulfates, thioureas, thiazoles and rhodanines. Preferred sulfur compounds are thiosulfate and thiourea compounds. The amount of the sulfur sensitizer varies depending on various conditions such as pH and a temperature at the chemical ripening and the size of silver halide grain. A preferred amount may be from $10^{-7}$ to $10^{-2}$ mol, more preferably from $10^{-5}$ to $10^{-3}$ mol based on one mole of silver halide.

As the selenium sensitizer for use in the present invention, a known selenium compound may be used. The selenium sensitization is usually performed by adding a labile and/or non-labile selenium compound and stirring the emulsion at a high temperature of 40° C. or higher for a given time. Examples of the labile selenium compound include the compounds described in JP-B-44-15748, JP-B-43-13489, JP-A-4-25832, JP-A-4-109240 and JP-A-4-324855. Among them, particularly preferred compounds are those represented by formulas (VIII) and (IX) of JP-A-4-324855.

The tellurium sensitizer for use in the present invention is a compound of forming silver telluride, presumably working as a sensitization nucleus, on the surface or inside of a silver halide grain. The rate of the formation of silver telluride in a silver halide emulsion can be examined according to a method described in JP-A-5-313284. Examples of the tellurium sensitizer include diacyl tellurides, bis(oxycarbonyl) tellurides, bis(carbamoyl) tellurides, diacyl tellurides, bis (oxycarbonyl) ditellurides, bis(carbamoyl) ditellurides, compounds having a P═Te bond, tellurocarboxylates, Te-organyltellurocarboxylic acid esters, di(poly)tellurides, tellurides, tellurols, telluroacetals, tellurosulfonates, compounds having a P—Te bond, Te-containing heterocyclic rings, tellurocarbonyl compounds, inorganic tellurium compounds, colloidal tellurium and the like. Specific examples thereof include the compounds described in U.S. Pat. Nos. 1,623,499, 3,320,069 and 3,772,031, British Patent Nos. 235,211, 1,121,496, 1,295,462 and 1,396,696, Canadian Patent No. 800,958, JP-A-4-204640, JP-A-4-271341, JP-A-4-333043, JP-A-5-303157, J. Chem. Soc. Chem. Commun., 635 (1980), ibid., 1102 (1979), ibid., 645 (1979), J. Chem. Soc. Perkin. Trans., 1, 2191 (1980), S. Patai (compiler), The Chemistry of Organic Selenium and Tellurium Compounds, Vol. 1 (1986), and ibid., Vol. 2 (1987) and the like. The compounds represented by formulas (II), (III) and (IV) of JP-A-5-313284 are particularly preferred.

The amount of the selenium or tellurium sensitizer used in the present invention varies depending on silver halide grains used, chemical ripening conditions or the like. The amount is usually from $10^{-8}$ to $10^{-2}$ mol, preferably from $10^{-7}$ to $10^{-3}$ mol based on one mole of silver halide. The conditions for chemical sensitization in the present invention are not particularly limited. In general, pH of from 5 to 8, pAg of from 6 to 11, preferably from 7 to 10 may be applied, and a temperature may be from 40 to 95° C., preferably from 45 to 85° C.

Noble metal sensitizers used for the present invention include gold, platinum, palladium, iridium and so forth. Gold sensitization is preferred. A gold sensitizer used for gold sensitization of the silver halide emulsion used in the present invention may have a gold oxidation number of either +1 valence or +3 valence, and gold compounds commonly used as a gold sensitizer can be used. Representative examples thereof include chloroauric acid, potassium chloroaurate, auric trichloride, potassium auric thiocyanate, potassium iodoaurate, tetracyanoauric acid, ammonium aurothiocyanate, pyridyltrichlorogold, gold sulfide and so forth. While the addition amount of the gold sensitizer may vary depending on various conditions, it is added, in general, in an amount of $10^{-7}$ to $10^{-2}$ mol, preferably $10^{-7}$ to $10^{-3}$ mol, more preferably $10^{-6}$ to $5\times10^{-4}$ mol, per mole of silver halide.

In the silver halide emulsion for use in the present invention, a cadmium salt, sulfite, lead salt or thallium salt may be allowed to coexist during the formation or physical ripening of the silver halide grains.

In the present invention, reduction sensitization may be used. Specific examples of the compound used in the reduction sensitization include an ascorbic acid, thiourea dioxide, stannous chloride, aminoiminomethanesulfinic acid, a hydrazine derivative, a borane compound, a silane compound and a polyamine compound. The reduction sensitization may be performed by ripening the grains while keeping the emulsion at a pH of 7 or more or at a pAg of 8.3 or less. The reduction sensitization may also be performed by introducing a single addition part of silver ion during the formation of grains.

To the silver halide emulsion of the present invention, a thiosulfonic acid compound may be added by the method described in European Patent 293917A.

The silver halide emulsion may be used alone in the photosensitive material of the present invention, or two or more of them may be used in combination (for example, those having different average grain sizes, different halogen compositions, or different crystallization properties, or those produces under different sensitization conditions).

The amount of the photosensitive silver halide used in the present invention may preferably be from 0.01 to 0.5 mol, more preferably from 0.02 to 0.3 mol, and more preferably from 0.03 to 0.25 mol based on per mole of the organic silver salt. Examples of a method and conditions for mixing the photosensitive silver halide with a separately prepared organic silver salt include, for example, a method of mixing the silver halide grains and the organic silver salt by means of a high-speed stirrer, a ball mill, a sand mill, a colloidal mill, a vibration mill, a homogenizer or the like, or a method of adding a ready prepared photosensitive silver halide to an organic silver salt at any stage of its preparation. However, the mixing method and conditions are not particularly limited so long as the advantages of the invention can be fully achieved.

The organic silver salt which can be used in the present invention is relatively stable against light, but forms a silver image when it is heated at 80° C. or higher in the presence of an exposed photocatalyst (e.g., a latent image of photosensitive silver halide) and a reducing agent. The organic silver salt may be any organic substance containing a source capable of reducing the silver ion. A silver salt of an organic acid, particularly a silver salt of a long chained aliphatic carboxylic acid (having from 10 to 30, preferably from 15 to 28 carbon atoms) is preferred. A complex of an organic or inorganic silver salt, whose ligand has a complex stability constant of from 4.0 to 10.0, is also preferred. The silver-supplying substance may constitute preferably from about 5 to 70% by weight of the image-forming layer. Examples of preferred organic silver salt include a silver salt of an organic compound having a carboxyl group. Examples include an aliphatic carboxylic acid silver salt and an aromatic carboxylic acid silver salt. However, the present invention is not limited to these examples. Preferred examples of the aliphatic carboxylic acid silver salt include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and a mixture thereof.

In the present invention, among these organic silver salts and combinations of the organic silver salts, an organic silver salt having a silver behenate content of 75 mol % or more, more preferably 85 mol % of more is preferred. The term "silver behenate content" as used herein means a partial ratio in mol of the silver behenate to the organic silver salt used. Preferred examples of the organic silver salt other than silver behenate, contained in the organic silver salt for use in the present invention include the above-described organic silver salts.

Silver salts of compounds having mercapto or thione group and derivatives thereof may also be used as the organic silver salt. Preferred examples of these compounds include a silver salt of 3-mercapto-4-phenyl-1,2,4-triazole, silver salt of 2-mercaptobenzimidazole, silver salt of 2-mercapto-5-aminothiadiazole, silver salt of 2-(ethylglycolamido)benzothiazole, silver salts of thioglycolic acids such as silver salts of S-alkylthioglycolic acids wherein the alkyl group has 12 to 22 carbon atoms, silver salts of dithiocarboxylic acids such as silver salt of dithioacetic acid, silver salts of thioamides, silver salt of 5-carboxyl-1-methyl-2-phenyl-4-thiopyridine, silver salts of mercaptotriazines, silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thione compounds such as silver salt of 3-(3-carboxyethyl)-4-methyl-4-thiazoline-2-thione as described in U.S. Pat. No. 3,301,678. Compounds containing an imino group may also be used. Preferred examples of such a compound include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Various silver acetylide compounds as described, for example, in U.S. Pat. Nos. 4,761,361 and 4,775,613 may also be used.

The organic acid silver salt preferred in the present invention is prepared by reacting an alkali metal salt (e.g., Na salt, K salt, Li salt) solution or suspension of the above-described organic acid with silver nitrate. The organic acid alkali metal salt for use in the present invention can be obtained by treating the organic acid with an alkali. The preparation of the organic acid silver salt for use in the present invention may be performed batchwise or continuously in any appropriate reaction vessel while stirring, and the stirring may be effected by any stirring method according to the required properties of the grain. The organic acid silver salt is preferably prepared by a method of gradually or rapidly adding an aqueous silver nitrate solution to the reaction vessel containing an organic acid alkali metal solution or suspension, a method of gradually or rapidly adding a previously prepared organic acid alkali metal salt solution or suspension to the reaction vessel containing an aqueous silver nitrate solution, or a method of previously preparing an aqueous silver nitrate solution and an organic acid alkali metal salt solution or suspension and simultaneously adding those solutions to the reaction vessel.

The aqueous silver nitrate solution and the organic acid alkali metal salt solution or suspension may have any concentration so as to control the grain size of the organic acid silver salt prepared and may be added at any addition rate. The aqueous silver nitrate solution and the organic acid alkali metal salt solution or suspension each may be added by a method of adding the solution at a constant rate or a method of adding the solution while increasing or decreasing the addition rate with any time function. The solution may also be added to the liquid surface or in the liquid of the reaction solution. When an aqueous silver nitrate solution and an organic acid alkali metal salt solution or suspension are previously prepared and then simultaneously added to a reaction vessel, either of the aqueous silver nitrate solution and the organic acid alkali metal salt solution or suspension may be added in advance but the aqueous silver nitrate solution is preferably added in advance by a precedence degree of from 0 to 50 vol %, more preferably from 0 to 25 vol %, of the entire addition amount. Furthermore, a method of adding the solution while controlling the pH or silver potential of the reaction solution during the reaction described in JP-A-9-127643 may be preferably used.

The pH of the aqueous silver nitrate solution and the organic acid alkali metal salt solution or suspension added may be adjusted according to the required properties of the grain. For adjusting the pH, any acid or alkali may be added. Furthermore, depending on the required property of the grain, for example, in order to control the grain size of the organic acid silver salt prepared, the temperature in the reaction vessel may be appropriately selected. The temperature of the aqueous silver nitrate solution and the organic acid alkali metal salt solution or suspension added may also be appropriately controlled. In order to ensure the liquid flowability of the organic acid alkali metal salt solution or suspension, the solution is preferably heat-insulated by heating at 50° C. or more.

The organic acid silver salt for use in the present invention is preferably prepared in the presence of a tertiary alcohol. The tertiary alcohol preferably has a total carbon number of 15 or less, more preferably 10 or less. Examples of preferred tertiary alcohols include tert-butanol. However, tert-butanol that can be used for the present invention is not limited to it.

The tertiary alcohol for use in the present invention may be added in any timing during the preparation of the organic acid silver salt. The tertiary alcohol is preferably added at the time of preparation of the organic acid alkali metal salt to dissolve the organic alkali metal salt. The tertiary alcohol for use in the present invention may be added in any amount of from 0.01 to 10 in terms of the weight ratio to $H_2O$ used as a solvent at the preparation of the organic acid silver salt but preferably added in an amount of from 0.03 to 1 in terms of the weight ratio to $H_2O$.

Although the shape of the organic silver salt is not particularly limited, an acicular crystal form having a short axis and a long axis is preferred. In the present invention, the short axis is preferably from 0.01 to 0.20 μm, more preferably from 0.01 to 0.15 μm, and the long axis is preferably from 0.10 to 5.0 μm, more preferably from 0.10 to 4.0 μm. The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, further preferably 50% or less, particularly preferably 30% or less. The shape of the organic silver salt can be determined from a transmission electron microscope image of organic silver salt dispersion. Another method for determining the monodispesibility is a method involving obtaining the standard deviation of a volume weight average diameter of the organic silver salt. The percentage (coefficient of variation) of the value obtained by dividing the standard deviation by the volume weight average diameter is preferably 100% or less, more preferably 80% or less, further preferably 50% or less, particularly preferably 30% or less. As a measurement method, for example, the grain size can be determined by irradiating organic silver salt dispersed in a solution with a laser ray and determining an autocorrelation function of the fluctuation of the scattered light on the basis of the change in time (volume weight average diameter). The average grain size determined by this method is preferably from 0.05 to 10.0 μm, more preferably from 0.1 to 5.0 μm, further preferably from 0.1 to 2.0 μm, as a solid fine grain dispersion.

The organic silver salt that can be used in the present invention is preferably desalted. The desalting method is not particularly limited and any known method may be used. Known filtration methods such as centrifugal filtration, suction filtration, ultrafiltration and flocculation washing by coagulation may be preferably used.

For obtaining an organic silver salt solid dispersion having a high S/N ratio and a small grain size and being free from coagulation, a preferable example include a dispersion method comprising the steps of converting a water dispersion, that contains an organic silver salt as an image-forming medium and contains substantially no photosensitive silver salt, to a high-speed flow dispersion, and then releasing the pressure.

The dispersion thus obtained is then mixed with an aqueous photosensitive silver salt solution to produce a coating solution containing the photosensitive image-forming medium. The coating solution enables the manufacture of a heat-developable photo sensitive material exhibiting low haze and low fog, and having high sensitivity. When a photosensitive silver salt coexists at the time of dispersing process under a high-pressure and at high-speed flow, fog frequency may increase and sensitivity may often highly decrease. Furthermore, when an organic solvent is used as a dispersion medium instead of water, haze and fog may increase and sensitivity may likely be decreased. When a conversion method where a part of the organic silver salt in the dispersion is converted into a photosensitive silver salt is used instead of the method of mixing an aqueous photosensitive silver salt solution, sensitivity may likely be decreased.

The above-described water dispersion obtained using conversion under a high-pressure and at high-speed flow is substantially free of a photosensitive silver salt. The content thereof is 0.1 mol % or less based on the light-insensitive organic silver salt. A photosensitive silver salt may not be added intentionally.

The solid dispersing apparatus and technique used for performing the above-described dispersion method in the present invention are described indetail, for example, in Toshio Kajiuchi and Hiromoto Usui, Bunsan-Kei Rheology to Bunsanka Gijutsu (Rheology of Dispersion System and Dispersion Technology), pp.357–403, Shinzan Sha Shuppan (1991), and Kagaku Kogaku no Shinpo (Progress of Chemical Engineering), pp. 184–185, compiled by Corporation Kagaku Kogakukai Tokai Shibu, Maki Shoten (1990). The dispersion method used in the present invention comprises steps of supplying a water dispersion containing at least an organic silver salt under a positive pressure by means of a high-pressure pump or the like into a pipeline, passing the dispersion through a narrow slit provided inside the pipeline, and then subjecting the dispersion to rapid pressure reduction to perform fine dispersion.

As for the high-pressure homogenizer which may be used in the present invention, it is considered that the dispersion into fine grains is generally achieved by dispersion forces such as (a) "shear force" generated at the passage of a dispersoid through a narrow slit under a high pressure at a high speed, and (b) "cavitation force" generated at the time of the release of the dispersoid from the high pressure to normal pressure. As the dispersion apparatus of this class, an example include the Golline homogenizer previously used. By using this apparatus, the solution to be dispersed is transported under a high pressure and converted into a high-speed flow through a narrow slit on the cylinder surface, and the energy of the flow allows collision of the flow against the peripheral wall surface to achieve emulsification and dispersion. The pressure applied may generally be from 100 to 600 kg/cm$^2$ and the flow velocity may be from several m/sec to 30 m/sec. In order to increase the dispersion efficiency, some apparatuses are designed wherein a part of a high flow velocity is formed into a serrated shape to increase the frequency of collision. Apparatuses capable of dispersion under a higher pressure and at a higher flow velocity have been developed in recent years, and examples include Microfluidizer (manufactured by Microfluidex International Corporation) and Nanomizer (manufactured by Tokusho Kika Kogyo KK).

Examples of the dispersing apparatus which can be suitably used in the present invention include Microfluidizer M-110S-EH (with G10Z interaction chamber), M-110Y (with H10Z interaction chamber), M-140K (with G10Z interaction chamber), HC-5000 (with L30Z or H230Z interaction chamber) and HC-8000 (with E230Z or L30Z interaction chamber), all manufactured by Microfluidex International Corporation.

By using these apparatuses, an aqueous dispersion containing at least an organic silver salt is transported under a positive pressure by means of a high-pressure pump or the like into the pipeline, and the solution is passed though a narrow slit provided inside the pipeline to apply a desired pressure. Then, the pressure in the pipeline is rapidly released to the atmospheric pressure to apply a rapid pressure change to the dispersion to obtain an optimal organic silver salt dispersion for use in the present invention.

In advance of the dispersion operation, the stock solution is preferably subjected to preparatory dispersion. The preparatory dispersion may be performed using a known dispersion means (for example, a high-speedmixer, a homogenizer, a high-speed impact mill, a Banbary mixer, a homomixer, a kneader, a ball mill, a vibrating ball mill, a planetary ball mill, an attriter, a sand mill, a bead mill, a colloid mill, a jet mill, a roller mill, a tronemill or a high-speedstonemill). Other than the mechanical dispersion, the stock solution may be coarsely dispersed in a solvent by controlling pH and thereafter formed into fine grains in the presence of a dispersion aid by changing pH. At this time, the solvent used for the coarse dispersion maybe an organic solvent. The organic solvent is usually removed after the completion of fine grain formation.

In dispersing process of the organic silver salt for use in the present invention, dispersion having a desired grain size may be obtained by controlling the flow velocity, the difference in the pressure before and after at the pressure dropping and the frequency of the processing. From viewpoints of photographic performance and the grain size, the flow velocity is preferably from 200 to 600 m/sec and the difference in the pressure at the pressure dropping is preferably from 900 to 3,000 kg/cm$^2$, and more preferably, the flow velocity is from 300 to 600 m/sec, and the difference in the pressure at the pressure dropping is from 1,500 to 3,000 kg/cm$^2$. The frequency of the dispersion processing may be appropriately chosen as required, and is usually from 1 to 10 times. From a viewpoint of productivity, the frequency is approximately from 1 to 3 times. The water dispersion under a high pressure is preferably not warmed at a high temperature from viewpoints of dispersibility and photographic performance. At a high temperature above 90° C., a grain size may readily become large and fog may be increased. Accordingly, in the present invention, the water dispersion is preferably kept at a temperature of from 5to 90° C., more preferably from 5 to 80° C., and most preferably from 5 to 65° C., by providing a cooling step before the conversion into a high pressure and high flow velocity, after the pressure drop, or both before the conversion and after the pressure drop. It is particularly effective to provide the cooling step at the time of dispersion under a high pressure of from 1,500 to 3,000 kg/cm$^2$. The cooler may be appropriately selected from a double pipe, a double piper using a static mixer, a multi-tubular exchanger and a coiled heat exchanger, depending on an amount of heat exchange to be treated. The size, wall thickness or material of a pipe may be appropriately selected to increase heat exchange efficiency depending on an applied pressure. In addition, depending on an amount of heat exchange, a refrigerant used in the cooler may be a well water at 20° C. or a chilled water at from 5 to 10° C. cooled by a refrigerator, and if desired, a refrigerant such as ethylene glycol/water at −30° C. may also be used.

In the dispersion operation of the present invention, the organic silver salt is preferably dispersed in the presence of a dispersant (dispersion aid) soluble in an aqueous solvent. Examples of the dispersion aid include synthetic anion polymers such as polyacrylic acid, copolymer of acrylic acid, maleic acid copolymer, maleic acid monoester copolymer and acrylomethylpropanesulfonic acid copolymer, semisynthetic anion polymers such as carboxymethyl starch and carboxymethyl cellulose, anionic polymers such as alginic acid and pectic acid, compounds described in JP-A-7-350753, known anionic, nonionic or cationic surface active agents, known polymers such as polyvinyl alcohol, polyvinyl pyrrolidone, carboxymethyl cellulose, hydroxypropyl cellulose and hydroxypropylmethyl cellulose, and naturally-occurring polymer compounds such as gelatin, and these may be appropriately selected and used. Polyvinyl alcohols and water-soluble cellulose derivatives are particularly preferred.

The dispersing aid is generally mixed with the organic silver salt in a form of powder or wet cake before the dispersing process, and fed as slurry into a dispersing apparatus. The dispersing aid may be mixed with the organic silver salt beforehand, and then the mixture may be subjected to a treatment such as by heating or with a solvent to form an organic silver salt powder or wet cake. The pH may be controlled with a suitable pH modifier before, during or after the dispersing operation.

Other than the mechanical dispersion, the organic silver salt can be made into microparticles by roughly dispersing the salt in a solvent through pH control, and then changing the pH in the presence of a dispersant. For the operation, an organic solvent may be used as a solvent for the rough dispersion, and such organic solvent can be removed after the formation of grains.

The dispersion prepared can be stored with stirring to prevent precipitation of the grains during storage, or stored in a highly viscous state by means of a hydrophilic colloids (e.g., a jelly state formed with gelatin). Furthermore, the dispersion may contain a preservative in order to prevent proliferation of microorganisms during storage.

The organic silver salt solid fine grain dispersion for use in the present invention comprises at least an organic silver salt and water. The ratio of the organic silver salt to water is not particularly limited. However, the organic silver salt preferably accounts for from 5 to 50% by weight, more preferably from 10 to 30% by weight of the entire dispersion. A dispersion aid is preferably used as described above but it is preferably used in a minimum amount within the range suitable for attaining a minimum grain size, specifically, in an amount of from 0.5 to 30% by weight, more preferably from 1 to 15% by weight, based on the organic silver salt.

In the present invention, a photosensitive material may be produced by mixing an organic silver salt water dispersion and a photosensitive silver salt water dispersion. The mixing ratio of the organic silver salt and the photosensitive silver salt may be selected according to the purpose. The ratio of the photosensitive silver salt to the organic silver salt is preferably from 1 to 30 mol %, more preferably from 3 to 20 mol %, still more preferably from 5 to 15 mol %. In the mixing, it is preferred to mix two or more organic silver salt water dispersions with two or more photosensitive silver salt water dispersions, so that the photographic properties can be controlled.

The organic silver salt for use in the present invention may be used in any desired amount, and is preferably used in an amount of from 0.1 to 5 g/m$^2$, more preferably from 1 to 3 g/m$^2$, in terms of silver.

In the present invention, metal ions selected from Ca, Mg, Zn and Ag are preferably added to the non-photosensitive organic silver salt. The metal ions selected from Ca, Mg, Zn and Ag are preferably added to the non-photosensitive organic silver salt in the form of a water-soluble metal salt, not a halide compound. Specifically, they are preferably added in the form of nitrate or sulfate. Addition of halide is not preferred, since it degrade image storability, i.e., so-called printing-out property, of the photosensitive material against light (indoor light, sun light etc.) after the development. Therefore, in the present invention, it is preferable to add the ions in the form of water-soluble metal salts, which are not the aforementioned halide compound.

The metal ions selected from Ca, Mg, Zn and Ag may be added any time after the formation of the non-photosensitive organic silver salt grains until immediately before the coating operation, for example, immediately after the formation of grains, before dispersion, after dispersion, before and after the formation of coating solution and so forth. They are preferably added after dispersion, or before or after the formation of coating solution.

The metal ions selected from Ca, Mg, Zn and Ag are preferably added in an amount of $10^{-3}$ to $10^{-1}$ mol, particularly $5\times10^{-3}$ to $5\times10^{-2}$ mol, per mol of non-photosensitive organic acid silver salt.

The image-forming layer (preferably, photosensitive layer) for use in the present invention may contain, as a plasticizer or a lubricant, polyhydric alcohols (for example, glycerins and diols described in U.S. Pat. No. 2,960,404), fatty acids or esters described in U.S. Pat. Nos. 2,588,765 and 3,121,060, and silicone resins described in British Patent No. 955,061.

The heat-developable photosensitive material of the present inventionmay have a surface protective layer, for example, to prevent adhesion of the image-forming layer.

The surface protective layer used in the present invention may contain any polymers as a binder. The surface protective layer may preferably contain a polymer having carboxyl residues in an amount of from 100 mg/m$^2$ to 5 g/m$^2$. Examples of the polymer having carboxyl residues include, for example, natural polymers (e.g., gelatin, alginic acid), modified natural polymers (e.g., carboxymethyl cellulose, phthalized gelatin), synthetic polymers (e.g., polymethacrylate, polyacrylate, poly(alkyl methacrylate)/acrylate copolymer, polystyrene/polymethacrylate copolymer) and the like. The content of the carboxyl residue in the polymers is preferably from 10 mmol to 1.4 mol per 100 g of the polymer. The carboxylic acid residues may form salts with alkali metal ions, alkaline earth metal ions, organic cations and the like.

As the binder of the protection layer, latex of a polymer having a glass transition temperature of 25° C. to 70° C. is preferably used. Such polymer latex is preferably used in an amount of 50% by weight or more, more preferably 70% by weight or more, of the total binder of the protective layer. In the present invention, at least one protective layer of such characteristics is preferably provided. Binder composition, coating method and so forth of the protective layer may be similar to those of the image-forming layer. As the polymer latex for the protection layer, preferably used are acrylate, styrene, acrylate/styrene, vinyl chloride, and vinylidene chloride polymer latexes. Specifically, preferably used are VONCORT R 3370, 4280 and Nipol Lx857 as acrylate resins, methyl (meth)acrylate/2-ethylhexyl (meth)acrylate/hydroxyethyl (meth)acrylate/styrene/(meth)acrylic acid copolymer, Nipol G576 as a vinyl chloride resin, AROND5071 as a vinylidene chloride resin.

The total amount of the binders in the protective layers used for the present invention is 0.2 to 5.0 g/m$^2$, more preferably 0.5 to 4.0 g/m$^2$.

For the surface protective layer for use in the present invention, any anti-adhesion material can be used. Examples of the anti-adhesion material include wax, silica particles, styrene-containing elastomeric block copolymer (e.g., styrene/butadiene/styrene, styrene/isoprene/styrene), cellulose acetate, cellulose acetate butyrate, cellulose propionate and a mixture thereof. The surface protective layer may also contain a crosslinking agent for forming cross-linkage or a surface active agent for improving coating property.

The image-forming layer or the protective layer for the image-forming layer according to the present invention may contain a light-absorbing material and a filter dye described in U.S. Pat. Nos. 3,253,921, 2,274,782, 2,527,583 and 2,956,879. The dyes can be mordanted as described in, for example, U.S. Pat. No. 3,282,699. The filter dye is preferably used in such an amount that there should be obtained absorbance at an exposure wavelength of from 0.1 to 3, particularly preferably from 0.2 to 1.5.

The photosensitive layer for use in the present invention may contain a dye or a pigment of various types to improve color tone or prevent irradiation. Any dye or pigment may be used in the photosensitive layer for use in the present invention, and examples thereof include pigments and dyes described in the color index. Specific examples thereof include organic pigments and inorganic pigments such as pyrazoloazole dyes, anthraquinone dyes, azo dyes, azomethine dyes, oxonol dyes, carbocyanine dyes, styryl dyes, triphenylmethane dyes, indoaniline dyes, indophenol dyes and phthalocyanines. Preferred examples of the dye for use in the present invention include anthraquinone dyes (e.g., Compounds 1 to 9 described in JP-A-5-341441, Compounds 3-6 to 3-18 and 3-23 to 3-38 described in JP-A-5-165147), azomethine dyes (e.g., Compounds 17 to 47 described in JP-A-5-341441), indoaniline dyes (e.g., Compounds 11 to 19 described in JP-A-5-289227, Compound 47 described in JP-A-5-341441, Compounds 2-10 and 2-11 described in JP-A-5-165147) and azo dyes (Compounds 10 to 16 described in JP-A-5-341441). These dyes may be added in any form, for example, as a solution, emulsified product or solid fine grain dispersion, or as a dye mordanted with a polymer mordant. The amount of the compound may be determined depending on a desired amount of absorption. In general, the compound is preferably used in an amount of from 1 $\mu$g to 1 g per square meter of the photosensitive material.

The heat-developable photosensitive material of the present invention is preferably a so-called single-sided photosensitive material comprising a support having on one side thereof at least one photosensitive layer containing a silver halide emulsion and on the other side thereof a backing layer.

In the present invention, the backing layer preferably has a maximum absorption of from about 0.3 to 2.0 in a desired wavelength range. Where the desired range is from 750 to 1,400 nm,the backing layer may preferably have an optical density of from 0.005 to less than 0.5 at from 360 to 750 nm, and more preferably act as an antihalation layer having optical density of from 0.001 to less than 0.3. Where the desired range is less than 750 nm, the backing layer may preferably be an antihalation layer having a maximum absorption of from 0.3 to 2.0 in a desired range of wavelength before the formation of an image, and an optical density of from 0.005 to less than 0.3 at from 360 to 750 nm after the formation of an image. The method for decreasing the optical density after the formation of an image to the above-described range is not particularly limited. For example, a method for reducing the density through decoloration of a dye by heating as described in Belgian Patent No. 733,706, or a method for reducing the density using decoloration by light irradiation as described in JP-A-54-17833 may be used.

When antihalation dyes are used in the present invention, the dyes may be any compounds so far that they have an intended absorption in a desired wavelength region and sufficiently low absorption in a visible region, and also provide an absorption spectral property desired for the aforementioned backing layer. Examples of such dye include, as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the treatment, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734 and U.S. Pat. Nos. 4,088,497, 4,283,487, 4,548,896 and 5,187,049. However, the scope of the present invention is not limited to these examples.

The binder suitable for the backing layer of the present invention may be transparent or translucent, and generally colorless. Examples include natural polymers and synthetic resins including homopolymers and copolymers, and other film-forming media. Specific examples include, for example, gelatin, gum arabic, poly(vinyl alcohol), hydroxyethyl cellulose, cellulose acetate, cellulose acetate butyrate, poly(vinylpyrrolidone), casein, starch, poly(acrylic acid), poly(methyl methacrylate), poly(vinyl chloride), poly (methacrylic acid), copoly(styrene-maleic anhydride), copoly(styrene-acrylonitrile), copoly(styrene-butadiene), poly(vinyl acetals) (e.g., poly(vinyl formal), poly(vinyl butyral)), poly(esters), poly(urethanes), phenoxy resin, poly (vinylidene chloride), poly(epoxides), poly(carbonates), poly(vinyl acetate), cellulose esters and poly(amides). The binder may be coated and formed after being dissolved in water or an organic solvent or in the form of an emulsion.

The single-sided photosensitive material of the present invention may contain, in the surface protective layer for the photosensitive emulsion layer (preferably image-forming layer) and/or the backing layer or in the surface protective layer for the backing layer, a matting agent to improve transferability. The matting agent is, in general a fine particle of a water-insoluble organic or inorganic compound. Any matting agent may be employed, and those well known in the art may be used, such as organic matting agents described in U.S. Pat. Nos. 1,939,213, 2,701,245, 2,322,037, 3,262,782, 3,539,344 and 3,767,448, or inorganic matting agents described in U.S. Pat. Nos. 1,260,772, 2,192,241, 3,257,206, 3,370,951, 3,523,022 and 3,769,020. Specific examples of the organic compound which can be used as the matting agent include, for example, water-dispersible vinyl polymers such as polymethyl acrylate, polymethyl methacrylate, polyacrylonitrile, acrylonitrile/α-methylstyrene copolymer, polystyrene, styrene/divinylbenzene copolymer, polyvinyl acetate, polyethylene carbonate and polytetrafluoroethylene; cellulose derivatives such as methyl cellulose, cellulose acetate and cellulose acetate propionate; starch derivatives such as carboxy starch, carboxynitrophenyl starch and urea/formaldehyde/starch reaction product; and gelatin hardened with a known hardening agent and hardened gelatin subjected to coacervation hardening so as to be a microcapsule hollow particle. Examples of the inorganic compound include, for example, silicon dioxide, titanium dioxide, magnesium dioxide, aluminum oxide, barium sulfate, calcium carbonate, silver chloride desensitized by a known method, silver bromide desensitized by a known method, glass, diatomaceous earth and the like. The aforementioned matting agents may be used as a mixture of different kinds of substances. The size and shape of the matting agent are not particularly limited and the matting agent may have any particle size. A matting agent having a particle size of preferably from 0.1 to 30 μm may be used to carry out the present invention. The matting agent may have either a narrow or broad particle size distribution. The matting agent may greatly affect the haze of the photosensitive layer or surface gloss of a coated layer, and accordingly, the particle size, shape and particle size distribution may preferably be controlled to meet a desired purpose at the preparation of the matting agent or by mixing several matting agents.

In the present invention, the backing layer preferably contains a matting agent. The matting degree of the backing layer is preferably 10 to 1,200 seconds, further preferably from 50 to 700 seconds as indicated by the Beck's smoothness.

In the present invention, the matting agent may preferably be incorporated in the outermost surface layer of the photosensitive material or a layer which functions as the outermost surface layer, or alternatively, in a layer close to the outer surface or a layer which acts as a so-called protective layer. The matting degree on the surface protective layer on the emulsion can be freely chosen so long as the star dust trouble does not occur. The degree may preferably be within a range of from 300 to 10,000 seconds, particularly preferably from 500 to 2,000 seconds as indicated by the Beck's smoothness.

The heat-developable photographic emulsion for use in the present invention is coated on a support to form one or more layers. In the case of a single layer, the layer should contain an organic silver salt, a silver halide, a developer, a binder, and optionally added materials such as a color-tone adjustor, a coating aid and other auxiliary agents. In the case of a double-layer structure, the first emulsion layer (usually a layer adjacent to the support) sdould contain an organic silver salt and a silver halide, and the second layer or both layers should contain some other components. A double-layer structure comprising a single emulsion layer containing all of the components and a protective top coat may also be contemplated. A multi-color heat-developable photosensitive material may have the combination of the above-described two layers for each of the colors, or as described in U.S. Pat. No. 4,708,928, a structure comprising a single layer containing all components. In the case of a multi-dye multi-color photosensitive heat-developable material, a functional or non-functional barrier layer is generally provided between respective emulsion layers (photosensitive layers) to keep the emulsion layer away from each other as described in U.S. Pat. No. 4,460,681.

A backside resistive heating layer described in U.S. Pat. Nos. 4,460,681 and 4,374, 921 may also be used in the photosensitive heat-developable photographic image system of the present invention.

In the present invention, a hardening agent may be used in layers such as the image-forming layer (photosensitive layer), the protective layer, and the backing layer. Examples of the hardening agent include polyisocyanates described in U.S. Pat. No. 4,281,060 and JP-A-6-208193, epoxy compounds described in U.S. Pat. No. 4,791,042, and vinyl sulfone-based compounds described in JP-A-62-89048.

In the present invention, a surface active agent may also be used to improve the coating property or electrostatic charge property. Examples of the surface active agent include nonionic, anionic, cationic and fluorocarbon surface active agents, which may be appropriately chosen and used. Specific examples include fluorocarbon polymer surface active agents described in JP-A-62-170950 and U.S. Pat. No. 5,380,644, fluorocarbon surface active agents described in JP-A-60-244945 and JP-A-63-188135, polysiloxane-based surface active agents described in U.S. Pat. No. 3,885,965, and polyalkylene oxides and anionic surface active agents described in JP-A-6-301140.

The heat-developable photographic emulsion for use in the present invention can generally be coated on a support of various types. Typical examples of the support include polyester film, undercoated polyester film, poly(ethylene terephthalate) film, polyethylene naphthalate film, nitrocellulose film, cellulose ester film, poly(vinyl acetal) film, polycarbonate film, related or resinous material, glass, paper and metal. A flexible substrate, particularly, a paper support coated with baryta and/or partially acetylated α-olefin polymer, preferably, a polymer of an α-olefin having 2 to 10 carbon atoms, such as polyethylene, polypropylene or ethylene/butene copolymer may typically be used. The support may be either transparent or opaque, and preferably be transparent. Among them, a biaxially stretched polyethylene terephthalate (PET) having a thickness of approximately from 75 to 200 μm is particularly preferred.

When a plastic film is passed through a heat-developing apparatus and processed at 80° C. or higher, the film is generally stretched in the dimension. If the processed materials are used as printing photosensitive materials, the stretch causes a serious problem at the time of precision multi-color printing. Accordingly, in the present invention, it is preferred to use a film designed to cause little change in the dimension by relaxing the internal strain remaining in the film at the biaxial stretching and thereby eliminating the heat shrinkage distortion generated during the heat development. For example, polyester, in particular, polyethylene terephthalate, heat-treated at 100 to 210° C., before a heat-developable photographic emulsion is coated thereon is preferably used. A film having a high glass transition point is also preferred, for example, a film of polyether ethyl ketone, polystyrene, polysulfone, polyethersulfone, polyarylate or polycarbonate may be used.

The heat-developable photosensitive material of the invention may have, for antistatic purpose, for example, a layer containing soluble salts (e.g., chlorides and nitrates), an deposited metal layer, a layer containing ionic polymers as described in U.S. Pat. Nos. 2,861,056 and 3,206,312, insoluble inorganic salts as described in U.S. Pat. No. 3,428,451, or tin oxide fine grains as described in JP-A-60-252349 and JP-A-57-104931.

A method for producing color images using the heat-developable photosensitive material of the invention is as described in JP-A-7-13295, page 10, left column, line 43 to page 11, left column, line 40. Stabilizers for color dye images are exemplified in British Patent No. 1,326,889, U.S. Pat. Nos. 3,432,300, 3,698,909, 3,574,627, 3,573,050, 3,764,337, and 4,042,394.

In the present invention, the heat-developable photographic emulsion can be coated by various coating methods including dip coating, air knife coating, flow coating, and extrusion coating using a hopper of the type described in U.S. Pat. No. 2,681,294. If desired, two or more layers may be simultaneously coated by the methods described in U.S. Pat. No. 2,761,791 and British Patent No. 837,095.

In the heat-developable photosensitive material of the invention, there may be contained additional layers, for example, a dye accepting layer for accepting a mobile dye image, an opacifying layer when reflection printing is desired, a protective topcoat layer, and a primer layer well known in the photothermographic art. The photosensitive material of the invention is preferably able to form an image by only a single sheet of the photosensitive material. That is, it is preferred that a functional layer necessary to form an image such as an image receiving layer does not constitute a separate member.

In the present invention, any sensitizing dyes may be used so long that they can spectrally sensitize the silver halide grains at a desired wavelength range when they adsorb on the silver halide particles. As the sensitizing dyes, cyanine dyes, merocyanine dyes, complex cyanine dyes, complex merocyanine dyes, holopolar cyanine dyes, styryl dyes, hemicyanine dyes, oxonole dyes, hemioxonole dyes and the like may be used. Preferable sensitizing dyes which can be used in the present invention are described, for example, in Research Disclosure, Item 17643, IV-A (December, 1978, page 23), Item 1831X (August, 1978, page 437) and also in the references cited therein. In particular, sensitizing dyes having a spectral sensitivity suitable for spectral characteristics of light sources of various laser imagers, scanners, image setters, process cameras and the like can advantageously be chosen.

As examples of spectral sensitization to red light, for example, to so-called red light sources such as He-Ne laser, red semiconductor laser, LED and the like, Compounds I-1 to I-38 disclosed in JP-A-54-18726, Compounds I-1 to I-35 disclosed in JP-A-6-75322, Compounds I-1 to I-34 disclosed in JP-A-7-287338, Dyes 1 to 20 disclosed in JP-B-55-39818, Compounds I-1 to 1-37 disclosed in JP-A-62-284343, Compounds I-1 to I-34 disclosed in JP-A-7-287338 and the like may be used.

To semiconductor laser light sources having a wavelength range of from 750 to 1,400 nm, spectral sensitization can be advantageously achieved by various known dyes including cyanine dyes, merocyanine dyes, styryl dyes, hemicyanine dyes, oxonol dyes, hemioxonol dyes and xanthene dyes. Useful cyanine dyes are cyanine dyes having a basic nucleus such as thiazoline nucleus, oxazoline nucleus, pyrroline nucleus, pyridine nucleus, oxazole nucleus, thiazole nucleus, selenazole nucleus or imidazole nucleus. Useful and preferred merocyanine dyes are merocyanine dyes having the above-described basic nucleus or an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus. The aforementioned cyanine and merocyanine dyes having an imino group or a caboxyl group are particularly effective. The dye may be appropriately chosen from known dyes described in, for example, U.S. Pat. Nos. 3,761,279, 3,719,495 and 3,877,943, British Patent. Nos. 1,466,201, 1,469,117 and 1,422,057, JP-B-3-10391, JP-B-6-52387, JP-A-5-341432, JP-A-6-194781 and JP-A-6-301141.

The dyes most preferably used for the present invention are cyanine dyes having one or more substituents containing a thioether bond (e.g., cyanine dyes described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-A-7-500926 (the abbreviation "JP-W-A" as used herein means an "international application published in Japanese for Japanese national phase"), and U.S. Pat. No. 5,541,054), dye shaving a carboxylic acid group (e.g., dyes disclosed in JP-A-3-163440, JP-A-6-301141, and U.S. Pat. No. 5,441,899), merocyanine dyes, polynuclear merocyanine dyes and polynuclear cyanine dyes (dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-7-146537, JP-A-W-55-50111, British Patent No. 1,467,638, and U.S. Pat. No. 5,281,515) and the like.

Dyes forming J-band are disclosed in U.S. Pat. Nos. 5,510,236, 3,871,887 (Example 5), JP-A-2-96131, JP-A-59-48753 and the like, and they can preferably be used for the present invention.

Each of these sensitizing dyes may be used alone or in any combination. A combination of sensitizing dyes is frequently used, especially for supersensitization. The emulsion may also contain, together with the sensitizing dye, a dye which itself does not have sensitizing effect or a substance which itself does not substantially absorb visible light, but shows supersensitization. Useful sensitizing dyes, combinations of dyes which exhibit supersensitization, and materials which show supersensitization are described in Research Disclosure, Vol.176, 17643, page 23, Item IV-J (December, 1978), JP-B-49-25500, JP-B-43-4933, JP-A-59-19032, JP-A-59-192242 and the like.

The sensitizing dye may be added to the silver halide emulsion by dispersing the dye directly in the emulsion, or alternatively, the dye may be added to the emulsion after being dissolved in a single solvent or a mixed solvent chosen from water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide.

Furthermore, the sensitizing dye may be added according to the following methods: a method disclosed in U.S. Pat. No. 3,469,987 which comprises the step of dissolving a dye in a volatile organic solvent, dispersing the solution in water or hydrophilic colloid, and then adding the dispersion to an emulsion; a method disclosed in JP-B-44-23389, JP-B-44-27555 and JP-B-57-22091 which comprises the step of dissolving a dye in an acid, and adding the solution to an emulsion, or alternatively, preparing an aqueous solution in the presence of an acid or a base, and then adding the aqueous solution to an emulsion; a method disclosed in U.S. Pat. Nos. 3,822,135 and 4,006,025 which comprises the step of forming an aqueous solution or a colloid dispersion of a dye in the presence of a surface active agent, and then adding the solution or the dispersion to an emulsion; a method disclosed in JP-A-53-102733 and JP-A-58-105141 which comprises the step of dispersing a dye directly in hydrophilic colloid, and adding the dispersion to an emulsion; or a method disclosed in JP-A-51-74624 which comprises the step of dissolving a dye using a compound capable of red shifting, and adding the solution to an emulsion. An ultrasonic wave may also be applied to dissolve the dye.

The sensitizing dye for use in the present invention may be added to a silver halide emulsion in any stages heretofore known to be useful in the preparation of an emulsion. The sensitizing dye may be added at any time or in any stages before the coating of the emulsion, for example, in the grain formation process of silver halide and/or before desalting or during the desalting process and/or the time period from desalting until initiation of chemical ripening, as disclosed in U.S. Pat. Nos. 2,735,766, 3,628,960, 4,183,756 and 4,225,666, JP-A-58-184142 and JP-A-60-196749, or immediately before or during the chemical ripening process or in the time period after chemical ripening until coating, as disclosed in JP-A-58-113920. Furthermore, as disclosed in U.S. Pat. No. 4,225,666 and JP-A-58-7629, a single compound or a compound in combination with a structurally different compound may be added in divided portions, for example, one portion is added during grain formation and another is added during or after chemical ripening, or one portion is added before or during chemical ripening and another is added after completion of the chemical ripening. A type of a compound or a type of combination of compounds may be changed during the divided addition.

The amount of the sensitizing dye used in the present invention may be appropriately chosen depending on the performance such as sensitivity or fog. The amount may preferably be from $10^{-6}$ to 1 mol, more preferably from $10^{-4}$ to $10^{-1}$ mol based on one mole of silver halide in the photosensitive layer.

In the present invention, any light exposure apparatus may be used for imagewise light exposure so long as it enables light exposure shorter than $10^{-7}$ second. In general, a light exposure apparatus utilizing a laser diode (LD) or light emitting diode (LED) as a light source is preferably used. In particular, LD is preferred because it can afford high output and high resolution. Any light source may be used so long as it can emit light of electromagnetic wave spectrum within a desired wavelength range. As for LD, for example, there can be used a dye laser, gas laser, solid laser, semiconductor laser and so forth.

In the present invention, the light exposure is preferably performed with overlapped light beams from a light source. The expression of overlapped light beams means that the subscanning pitch width is smaller than the beam diameter. For example, the overlap can be quantitatively expressed, when the beam diameter is expressed with the full-width at half maximum (FWHM) of beam intensity, as FWHM/Subscanning pitch width (overlap coefficient).

In the present invention, the overlap coefficient is preferably 0.2 or higher.

Scanning scheme of the light source of the light exposure apparatus used for the present invention is not particularly limited, and there can be used cylinder outer surface scanning, cylinder inner surface scanning, plane scanning and so forth. Further, the light source may have either a single channel, or multiple channels, and for cylinder outer surface scanning, multiple channels are preferably used.

The heat-developable photosensitive material of the present invention has a low haze at the exposure, and is liable to incur generation of interference fringes. For preventing the generation of interference fringes, a technique of entering a laser ray obliquely with respect to the photosensitive material disclosed in JP-A-5-113548 and a method of using a multimode laser disclosed in International Patent Publication WO95/31754 have been known, and these techniques are preferably used.

A method for forming images according to the present invention will be explained hereinafter.

The heat-developable photosensitive material of the present invention may be developed by any method. The development is usually performed by elevating the temperature of the photosensitive material after imagewise exposure. Preferred embodiments of the heat-developing apparatus include, as a type of contacting a heat-developable photosensitive material with a heat source such as heat roller or heat drum, the heat-developing apparatuses described in JP-B-5-56499, Japanese Patent No.684453, JP-A-9-292695, JP-A-9-297385 and International Patent Publication WO95/30934, and as a non-contacting type, the heat-developing apparatuses described in JP-A-7-13294, International Patent publications WO97/28489, WO97/28488 and WO97/28287. A non-contacting type heat-developing apparatus is particularly preferred. The development temperature may preferably be from 80 to 250° C., more preferably from 100 to 140° C. The development time may preferably be from 1 to 180 seconds, more preferably from 10 to 90 seconds.

For image formation by using the heat-developable photosensitive material of the present invention, preferably used is a method comprising heating the aforementioned heat-developable photosensitive material at a temperature of 80° C. to a temperature lower than 120° C. for 5 seconds or more in such a way that an image is not formed (so-called preheating), and subjecting the material to heat development at a temperature of 110° C. or higher to form an image.

The aforementioned "heating in such a way that an image is not formed" refers to, specifically, heating that affords density increase of 0.05 or less when the density is compared for an exposed portion before and after light exposure for forming black image. The heating temperature for this operation is preferably controlled at a temperature of from 80° C. to a temperature lower than 120° C., because sufficient heating effect cannot be obtained at a temperature lower than 80° C. and hence moisture in the heat-developable photosensitive material cannot be removed, and it is difficult to select a condition not forming an image at a temperature of 120° C. or higher. Further, this heating is performed for 5 seconds or more, because sufficient effect for removing moisture in the heat-developable photosensitive material cannot be obtained by heat treatment for a period shorter than 5 seconds. Normally, the heating is performed for a period of 5 seconds or longer, but shorter than 40 seconds. The heating condition more preferably consists of a temperature of 85° C. to 119° C., particularly preferably 85° C. to 115° C., for 5 to 30 seconds.

On the other hand, the heat development temperature for forming an image should be 110° C. or higher, because such a temperature enables the heat development in a short period of time, i.e., 120 seconds or shorter, and hence such a temperature is preferred in view of realization of quick processing. The heat development is preferably performed at a temperature of 110° C. to 130° C., more preferably 110° C. to 125° C., for 10 seconds to 120 seconds, more preferably 15 seconds to 90 seconds.

An example of the structure of a heat-developing apparatus used for the heat development of the heat-developable photosensitive material of the present invention is shown in FIG. 1. FIG. 1 depicts a side view of a heat-developing apparatus. The apparatus shown in FIG. 1 comprises carrying-in roller pairs 11 (upper rollers are silicone rubber rollers, and lower rollers are aluminum heating rollers), which carry a heat-developable photosensitive material 10 into the heating section while making the material in a flat shape and preheating it, and carrying-out roller pairs 12, which carry out the heat-developable photosensitive material 10 after heat development from the heating section while maintaining the material to be in a flat shape. The heat-developable photosensitive material 10 is heat-developed while it is conveyed by the carrying-in roller pairs 11 and then by the carrying-out roller pairs 12. As a conveying means for carrying the heat-developable photosensitive material 10 under the heat development, multiple rollers 13 is provided in such a way that they are contacted with the side of the image-forming layer, and a flat surface 14 adhered with non-woven fabric (composed of aromatic polyamide, Teflon etc.) or the like is provided on the opposite side so that it should be contacted with the back surface. The heat-developable photosensitive material 10 is conveyed by driving of the multiple rollers 13 contacted with the image-forming layer side, while the back surface slides on the flat surface 14. As a heating means, heaters 15 are provided over the rollers 13 and under the flat surface 14 so that the heat-developable photosensitive material 10 should be heated from the both sides. Examples of the heating means include panel heaters and so forth. While clearance between the rollers 13 and the flat surface 14 may vary depending on the member of the flat surface, it is suitably adjusted to a clearance that allows the conveyance of the heat-developable photosensitive material 10. The clearance is preferably 0–1 mm.

The material of the surface of the rollers 13 and the member of the flat surface 14 may be composed of any materials so long as they have heat resistance and they should not cause any troubles in the conveyance of the heat-developable photosensitive material 10. However, the material of the roller surface is preferably composed of silicone rubber, and the member of the flat surface is preferably composed of non-woven fabric made of aromatic polyamide or Teflon (polytetrafluoroethylene, PTFE). The heating means preferably comprises multiple heaters so that temperature of each heater can be adjusted freely.

The heating section is constituted by a preheating section A comprising the carrying-in roller pairs 11 and a heat development section B comprising the heaters 15. The temperature of the preheating section A located upstream of the heat development section B is preferably selected to be lower than the heat development temperature (for example, by about 10–30° C.), and the temperature and heat development time are desirably adjusted so that they are sufficient for evaporating moisture contained in the heat-developable photosensitive material 10. The temperature is also adjusted to be higher than the glass transition temperature (Tg) of the support of the heat-developable photosensitive material 10 so that uneven development should be prevented.

Moreover, guide panels 16 are provided downstream from the heat development section B, and they constitute a gradual cooling section C together with the carrying-out roller pairs 12. The guide panels 16 are preferably composed of a material of low heat conductivity, and it is preferred that the cooling is performed gradually so as not to cause deformation of the heat-developable photosensitive material 10.

The heat-development apparatus is explained with reference to an example shown in the drawing. However, the apparatus is not limited to the example. For example, the heat-development apparatus used for the present invention may have a variety of structures such as disclosed in JP-A-7-13294. For the multi-stage heating method, which is preferably used in the present invention, the heat-developable photosensitive material may be successively heated at different temperatures in such an apparatus as mentioned above, which is provided with two or more heat sources at different temperatures.

EXAMPLES

The present invention will be specifically explained with reference to the following examples. However, the scope of the present invention is not limited to the following examples.

Example 1

The following layers were provided on a PET base having a thickness of 100 $\mu$m.

| (Coating of backing layers) | |
|---|---|
| First backing layer | |
| Julimer ET-410 (Nihon Junyaku Co., Ltd.) | 38 mg/m$^2$ |
| $SnO_2$/Sb (weight ratio: 9/1, acicular grains, FS-10D, Ishihara Sangyo Kaisha, Ltd.) | 200 mg/m$^2$ |
| Dye A | 20 mg/m$^2$ |
| Matting agent (Polymethyl methacrylate particles, average particle size: 5 $\mu$m) | 10 mg/m$^2$ |
| Crosslinking agent (Denacol EX-614B, Nagase Kasei Co., Ltd.) | 13 mg/m$^2$ |
| Second backing layer | |
| Latex binder | 500 mg/m$^2$ |

-continued

| (Coating of backing layers) | |
|---|---|
| (CHEMIPEARL S-120, Mitsui Petrochemical Industries, Ltd.) | |
| Colloidal silica (Snowtex-C, Nissan Chemical Industries, Ltd.) | 40 mg/m$^2$ |
| Crosslinking agent (Denacol EX-614B, Nagase Kasei Co., Ltd.) | 30 mg/m$^2$ |

The both backing layers were coated successively and dried at 180° C. for 4 minutes, respectively.

(Heat Treatment of Support)

After the backing layers were coated and dried, the support was subjected to a first heat treatment at 130° C. under a tension of 5 kg/cm$^2$ for 10 minutes and a second heat treatment at 40° C. under a tension of 10 kg/cm$^2$ for 15 seconds.

(Preparation of Silver Halide Emulsion)

In 700 ml of water, phthalized gelatin (11 g), potassium bromide (30 mg) and sodium thiosulfonate (10 mg) were dissolved. After the solution was adjusted to pH 5.0 at a temperature of 35° C., 159 ml of an aqueous solution containing silver nitrate (18.6 g) and an aqueous solution containing 1 mol/l of potassium bromide were added by the control double jet method over 6.5 minutes while pAg was maintained at 7.7. Further, 476 ml of an aqueous solution containing silver nitrate (55.4 g) and an aqueous solution containing 1 mol/l of potassium bromide were added by the control double jet method over 30 minutes while pAg was maintained at 7.7. Then, 4-hydroxy-6-methyl-1,3,3a,7-tetrazaindene (1 g) was added, and the pH was lowered to cause coagulation precipitation to thereby effect desalting. Then, phenoxyethanol (0.1 g) was added, and pH and pAg were adjusted to 5.9 and 8.2, respectively, to complete the preparation of silver bromide grains (cubic grains having an average grain size of 0.12 μm, variation coefficient of projected area of 8% and a [100] face ratio of 88%).

The temperature of the silver bromide grains obtained as described above was raised to 60° C., and added with sodium thiosulfonate ($8.5\times10^{-4}$ mol per 1 mole of silver). The grains were ripened for 120 minutes, then quenched to 40° C., added with Dye S-1 ($1\times10^{-5}$ mol), 2-mercapto-5-methylbenzimidazol ($5\times 10^{-5}$ mol) and N-methyl-N'-{3-(mercaptotetrazolyl)phenyl}urea ($5\times10^{-5}$ mol), and quenched to 30° C. to obtain a silver halide emulsion.

(Preparation of Organic Silver Salt Dispersion)

Stearic acid (4.4 g), behenic acid (39.4 g) and distilled water (700 ml) were added with 1 N aqueous NaOH solution (103 ml), allowed to react at 90° C. for 240 minutes with stirring, and cooled to 75° C. Then, 112.5 ml of an aqueous solution containing silver nitrate (19.2 g) was added over 45 seconds to the reaction mixture, which was then left for 20 minutes to be cooled to 30° C. Thereafter, the solid content was separated by suction filtration, and washed with water until the conductivity of the filtrate became 30 μS/cm. The solid content obtained as described above was added with 100 ml of 10 wt % aqueous solution of polyvinyl alcohol, and water in such an amount that the total weight should be 270 g, and the mixture was dispersed by an automatic mortar to obtain roughly dispersed organic acid silver salt. This roughly dispersed organic acid silver salt was dispersed by using a nanomizer (Nanomizer Co., Ltd.) at a pressure of 1000 kg/cm$^2$ upon impact. The dispersion was taken out from the nanomizer, and added with water to adjust the concentration. Thus, an organic silver salt dispersion containing 0.3 mol of silver per kg of dispersion was obtained. The dispersion contained acicular grains having an average short axis length of 0.04 μm, an average long axis length of 0.8 μm and a variation coefficient of 30%.

(Preparation of Dispersion of Reducing Agent)

To 1,1-bis(2-hydroxy-3,5-dimethylphenyl)-3,5,5-trimethylhexane (100 g) and polyvinyl alcohol (50 g), water (850 g) was added, and the mixture was thoroughly mixed to form a slurry. The resulting slurry was put together with dispersion beads (zirconia particles having an average diameter of 0.5 mm, 840 g) into a vessel, and dispersed in a sand mill dispersion machine (¼G Sand Grinder Mill, manufactured by Imex) for 5 hours to prepare a dispersion of reducing agent having an average grain size of 0.5 μm.

(Aqueous Solution of First Precursor)

1.5 % by weight Aqueous solution of Compound P-60

(Preparation of Dispersion of Second Precursor)

To 2-tribromomethylsulphonylquinoline (Compound II-5, 50 g) and Kuraray Poval MP-203 (Kuraray Co., Ltd., 10 g), water (940 g) was added, and the mixture was thoroughly mixed to form a slurry. The resulting slurry was dispersed with zirconia beads in the same manner as that for the aforementioned reducing agent to obtain a dispersion having an average grain size of 0.4 μm.

(Preparation of Dispersion of Nucleating Agent)

Nucleating agent No.C-62 (10 g) mentioned above and Kuraray Poval #217 (Kuraray Co., Ltd., 2.5 g) were mixed with water (87.5 g) and dispersed with zirconia beads in the same manner as that for the aforementioned reducing agent Dye S-1

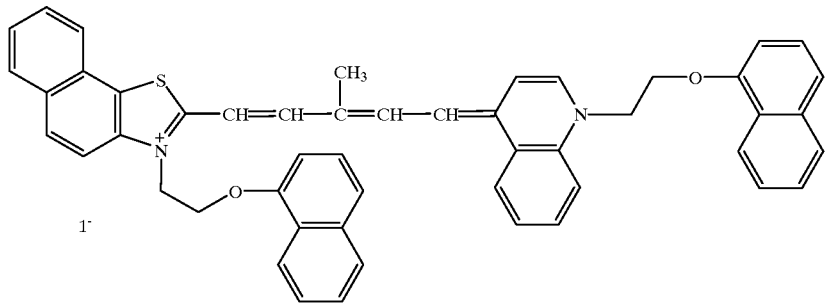

dispersion to obtain a dispersion having an average grain size of 0.3 μm.

(Preparation of Dispersion of Compound Z)

To Compound Z (10 g) mentioned below and Kuraray Poval (2 g), water (88 g) was added, and the mixture was thoroughly mixed to form a slurry. The resulting slurry was dispersed with zirconia beads in the same manner as that for the reducing agent mentioned above to obtain a dispersion having an average grain size of 0.4 μm.

Compound Z

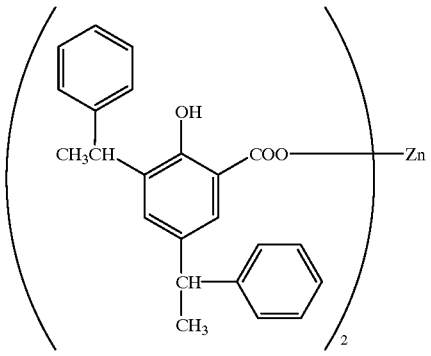

<Preparation of Sample 101 of the Present Invention>

(Preparation and Coating of Coating Solution for Photosensitive Layer)

The aforementioned organic silver salt dispersion (100 g), the dispersion of reducing agent (20 g), the dispersion of the second precursor (12 g), the aqueous solution of the first precursor (4 g), Lacstar #3307B (Dai-Nippon Ink & Chemicals. Inc., SBR latex, Tg: 13° C., 49 wt %, 40 g), Kuraray Poval MP-203 (10 wt %, 40 g), the silver halide emulsion (20 g), the dispersion of the nucleating agent (2 g), 5-methylbenzotriazol (0.01 g), sodium dihydrogenphosphate (2 mg) and the dispersion of salicylic acid derivative mentioned above (1.4 g), Dye A mentioned below (6 mg) were added with water (100 g) and thoroughly mixed to form a coating solution. On the surface of the support opposite to the surface coated with the backing layer, the coating solution was coated so that the coated silver amount should be 1.5 g/m$^2$.

Dye A

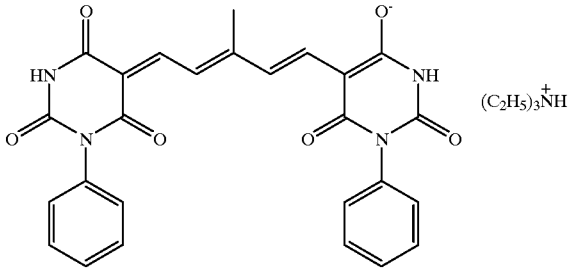

(Preparation and Coating of Coating Solution for Protective Layer)

To 40 wt % polymer latex (containing copolymer of methyl methacrylate/styrene/2-ethylhexyl acrylate/2-hydroxyethyl methacrylate/methacrylic acid, copolymerization ratio: 59/9/26/5/1 (weight ratio), Tg: 47° C., 50 g) was added with water (262 g), and successively added with benzyl alcohol as a film-forming agent (14 g), Compound-2 mentioned below (2.5 g), Cellosol 524 (Chukyo Yushi Co., Ltd., 3.6 g), Compound F (12 g), Compound E (1 g), Compound-5 (2 g) and Compound-6 (7.5 g) mentioned below, and polymethacrylate particles having an average diameter of 3 μm as matting agent (3.4 g). Water was further added to make the mixture 1000 g to prepare a coating solution having a viscosity of 5 cp (at 25° C.) at pH 3.4. This coating solution was coated so that the solid content of the polymer latex should be 2 g/m$^2$.

Compound-2

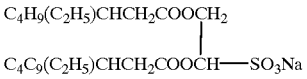

Compound F

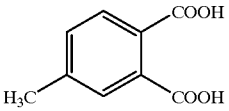

Compound E

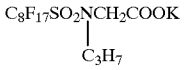

Compound-5

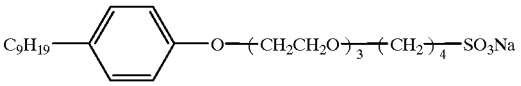

Compound-6

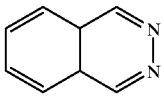

The photosensitive layer and the protective layer were coated simultaneously as laminated layers, and then dried at 60° C. for 2 minutes.

<Preparation of Comparative Samples 102–109>

Samples were prepared in the same manner as the preparation of Sample 101 with changing addition amounts of the first and second halogen-releasing precursors as shown in Table 1.

(Evaluation of Photographic Performance)

These samples were left in an environment of relative humidity of 70% at 40° C. for 5 days, and evaluated as follows.

Each sample was light-exposed by a 780 nm-semiconductor laser sensitometer, and subjected to heat development at 118° C. or 120° C. for 20 seconds. The density of the obtained image was measured using a densitometer. The measurement was performed by using visible light. The measurement results were evaluated as minimum density corresponding to fog (Dmin), sensitivity and gradation. The sensitivity was evaluated as a relative value of logarithm of exposure amount necessary for giving a density 1.5 higher than Dmin, and expressed as a difference of such a value obtained by a treatment at 118° C. from a standard value obtained by a treatment at 120° C. for 20 seconds. The gradation was expressed as a gradient of a linear part of a characteristic curve. Dmax was a maximum density. The results are shown in Table 2.

(Evaluation of Development Humidity Dependency)

Each sample was left in an atmosphere of a relative humidity of 30% or 70% for 2 hours, and then subjected to heat development at 119° C. for 25 seconds. Sensitivity was evaluated in the same manner as above, and expressed as a difference from the value obtained in the sample left at a relative humidity of 70%, which was used as a standard.

The results are shown in Table 3.

TABLE 1

| Sample No. | Second precursor | First precursor | Note |
|---|---|---|---|
| 101 | Compound II-5 $4.3 \times 10^{-2}$ mol/Ag mol | Compound P-60 $4.2 \times 10^{-3}$ mol/Ag mol | Invention |
| 102 | $3.0 \times 10^{-2}$ mol/Ag mol | — | Comparative |
| 103 | $4.3 \times 10^{-2}$ mol/Ag mol | — | Comparative |
| 104 | $4.7 \times 10^{-2}$ mol/Ag mol | — | Comparative |
| 105 | $6.5 \times 10^{-2}$ mol/Ag mol | — | Comparative |
| 106 | — | $3.0 \times 10^{-3}$ mol/Ag mol | Comparative |
| 107 | — | $4.2 \times 10^{-3}$ mol/Ag mol | Comparative |
| 108 | — | $6.3 \times 10^{-3}$ mol/Ag mol | Comparative |
| 109 | — | $8.4 \times 10^{-3}$ mol/Ag mol | Comparative |

TABLE 2

| Sample No. | Heat condition | development | Dmin | Gradation | D-max | Sensitivity | Note |
|---|---|---|---|---|---|---|---|
| 101 | (1) 118° C., | 20 seconds | 0.09 | 18.7 | 4.0 | −0.15 | Invention |
| 101 | (2) 120° C., | 20 seconds | 0.11 | 21.5 | 4.7 | Standard | Invention |
| 102 | (1) 118° C., | 20 seconds | 0.15 | 21.0 | 4.5 | −0.43 | Comparative |
| 102 | (2) 120° C., | 20 seconds | 0.33 | 27.5 | 4.8 | Standard | Comparative |
| 103 | (1) 118° C., | 20 seconds | 0.13 | 20.5 | 4.2 | −0.33 | Comparative |
| 103 | (2) 120° C., | 20 seconds | 0.29 | 24.8 | 4.7 | Standard | Comparative |
| 104 | (1) 118° C., | 20 seconds | 0.11 | 18.6 | 3.6 | −0.30 | Comparative |
| 104 | (2) 120° C., | 20 seconds | 0.25 | 22.9 | 4.2 | Standard | Comparative |
| 105 | (1) 118° C., | 20 seconds | 0.09 | 17.6 | 3.1 | −0.25 | Comparative |
| 105 | (2) 120° C., | 20 seconds | 0.12 | 20.1 | 3.8 | Standard | Comparative |
| 106 | (1) 118° C., | 20 seconds | 0.21 | 21.7 | 4.4 | −0.47 | Comparative |
| 106 | (2) 120° C., | 20 seconds | 0.79 | 29.3 | 4.8 | Standard | Comparative |
| 107 | (1) 118° C., | 20 seconds | 0.17 | 20.5 | 4.2 | −0.39 | Comparative |
| 107 | (2) 120° C., | 20 seconds | 0.65 | 26.8 | 4.8 | Standard | Comparative |
| 108 | (1) 118° C., | 20 seconds | 0.15 | 17.5 | 3.7 | −0.38 | Comparative |
| 108 | (2) 120° C., | 20 seconds | 0.53 | 21.8 | 4.2 | Standard | Comparative |
| 109 | (1) 118° C., | 20 seconds | 0.13 | 16.3 | 3.4 | −0.34 | Comparative |
| 109 | (2) 120° C., | 20 seconds | 0.37 | 19.7 | 3.9 | Standard | Comparative |

TABLE 3

| Sample No. | Humidity condition | Dmin | Gradation | D-max | Sensitivity | Note |
|---|---|---|---|---|---|---|
| 101 | (i) 25° C., 30% RH | 0.10 | 16.9 | 3.9 | −0.17 | Invention |
| 101 | (ii) 25° C., 70% RH | 0.11 | 21.5 | 4.7 | Standard | Invention |
| 102 | (i) 25° C., 30% RH | 0.13 | 18.0 | 4.5 | −0.39 | Comparative |
| 102 | (ii) 25° C., 70% RH | 0.37 | 29.5 | 4.8 | Standard | Comparative |
| 103 | (i) 25° C., 30% RH | 0.12 | 20.5 | 4.3 | −0.31 | Comparative |
| 103 | (ii) 25° C., 70% RH | 0.30 | 24.7 | 4.8 | Standard | Comparative |

TABLE 3-continued

| Sample No. | Humidity condition | Dmin | Gradation | D-max | Sensitivity | Note |
|---|---|---|---|---|---|---|
| 104 | (i) 25° C., 30% RH | 0.11 | 19.1 | 3.6 | −0.27 | Comparative |
| 104 | (ii) 25° C., 70% RH | 0.26 | 23.5 | 4.2 | Standard | Comparative |
| 105 | (i) 25° C., 30% RH | 0.10 | 15.7 | 3.1 | −0.21 | Comparative |
| 105 | (ii) 25° C., 70% RH | 0.20 | 22.4 | 3.8 | Standard | Comparative |
| 106 | (i) 25° C., 30% RH | 0.23 | 21.3 | 4.4 | −0.44 | Comparative |
| 106 | (ii) 25° C., 70% RH | 0.77 | 29.0 | 4.8 | Standard | Comparative |
| 107 | (i) 25° C., 30% RH | 0.19 | 21.5 | 4.2 | −0.37 | Comparative |
| 107 | (ii) 25° C., 70% RH | 0.69 | 25.5 | 4.8 | Standard | Comparative |
| 108 | (i) 25° C., 30% RH | 0.16 | 17.0 | 3.7 | −0.35 | Comparative |
| 108 | (ii) 25° C., 70% RH | 0.55 | 20.9 | 4.2 | Standard | Comparative |
| 109 | (i) 25° C., 30% RH | 0.12 | 17.7 | 3.4 | −0.32 | Comparative |
| 109 | (ii) 25° C., 70% RH | 0.40 | 19.3 | 3.9 | Standard | Comparative |

From the results shown in Tables 2 and 3, it can be seen that the increase in Dmin, reduction of Dmax and sensitivity fluctuation caused by temperature or humidity variation were suppressed within a very small range in the samples according to the present invention, whereas they were quite large in the comparative samples. The results indicate that such improvement effect cannot be obtained by use of the first precursor or the second precursor alone, but can be obtained only by a combination thereof.

(Discussion on Evaluation Results)

It was demonstrated that the samples of the present invention showed high contrast and stable performance even though the heat development condition was varied.

Example 2

Samples according to the present invention was prepared in the same manner as in Example 1, but the precursors of Sample 101 were changed as shown in Table 4. The prepared samples were evaluated in the same manner as in Example 1. As a result, the samples showed the advantages of the present invention similar to those obtained in Example 1.

TABLE 4

| Sample No. | Second precursor | First precursor | Note |
|---|---|---|---|
| 201 | Compound II-2 $4.3 \times 10^{-2}$ mol/Ag mol | Compound P-60 $4.2 \times 10^{-3}$ mol/Ag mol | Invention |
| 202 | Compound II-2 $4.3 \times 10^{-2}$ mol/Ag mol | Compound P-60 $1 \times 10^{-2}$ mol/Ag mol | Invention |
| 203 | Compound II-2 $4.3 \times 10^{-2}$ mol/Ag mol | Compound P-61 $8.4 \times 10^{-3}$ mol/Ag mol | Invention |
| 204 | Compound II-2 $4.3 \times 10^{-2}$ mol/Ag mol | Compound P-65 $4.2 \times 10^{-3}$ mol/Ag mol | Invention |
| 205 | Compound II-2 $4.3 \times 10^{-2}$ mol/Ag mol | Compound P-64 $1 \times 10^{-2}$ mol/Ag mol | Invention |
| 206 | Compound II-2 $4.3 \times 10^{-2}$ mol/Ag mol | Compound P-53 $8.4 \times 10^{-3}$ mol/Ag mol | Invention |
| 207 | Compound II-3 $4.3 \times 10^{-2}$ mol/Ag mol | Compound P-65 $4.2 \times 10^{-3}$ mol/Ag mol | Invention |

TABLE 4-continued

| Sample No. | Second precursor | First precursor | Note |
|---|---|---|---|
| 208 | Compound II-37 $4.3 \times 10^{-2}$ mol/Ag mol | Compound P-60 $6.3 \times 10^{-3}$ mol/Ag mol | Invention |
| 209 | Compound II-38 $4.7 \times 10^{-2}$ mol/Ag mol | Compound P-61 $8.4 \times 10^{-3}$ mol/Ag mol | Invention |
| 210 | Compound II-38 $6.5 \times 10^{-2}$ mol/Ag mol | Compound P-64 $1 \times 10^{-2}$ mol/Ag mol | Invention |

Example 3

A sample was prepared in the same manner as in the preparation of Sample No.101 in Example 1, except that the first precursor was not added to the coating solution for photosensitive layer, but instead added to the protective layer. The added amount was $6.3\times10^{-3}$ mol/Ag mol. On the protective layer, an overcoat layer was further coated on the protective layer as mentioned below. The image-forming layer and the protective layer were simultaneously coated as laminated layers, and dried at 60° C. for 1 minute. Then, the overcoat layer was provided by coating the following polymer latex, and dried at 60° C. for 1 minute. The coated solid content of the polymer latex was 1.0 g/m$^2$. This sample is referred to as Sample 301.

Overcoat Layer 40 wt % polymer latex (copolymer of methyl methacrylate/styrene/2-ethylhexyl acrylate/2-hydroxyethyl acrylate/methacrylic acid, copolymerization ratio=59/9/26/5/1 (weight ratio))

Sample 301 was evaluated for photographic performance and development humidity dependency in the same manner as in Example 1. As a result, good results were obtained like Sample 101 in Example 1.

Then, Sample 101 (Example 1) and Sample 301 mentioned above were evaluated for stability of the coating solutions for photosensitive layer and protective layer. Each coating solution was stored at 40° C. for 8 hours with stirring, and then filtered through a microfilter having a nominal pore diameter of 10 microns. Then, the residue was observed. The results are shown below.

| Sample No. | Coating solution | Residue |
|---|---|---|
| 101 (Example 1) | Coating solution for photosensitive layer | Observed |
| | Coating solution for protective layer | Not observed |
| 301 | Coating solution for photosensitive layer | Not observed |
| | Coating solution for protective layer | Not observed |

As shown above, for Sample 301, no residue was observed in both of the coating solutions for photosensitive layer and protective layer, and thus the coating solutions showed good stability.

Example 4

<<Preparation of Silver Halide Emulsion>>

(Emulsion A)

In 700 ml of water, alkali-treated gelatin (calcium content: 2700 ppm or less, 11 g), potassium bromide (30 mg) and sodium benzenethiosulfonate (10 mg) were dissolved. After the solution was adjusted to pH 5.0 at a temperature of 40° C., 159 ml of an aqueous solution containing silver nitrate (18.6 g) and an aqueous solution containing 1 mol/l of potassium bromide, $5\times10^{-6}$ mol/l of $(NH_4)_2RhCl_5(H_2O)$ and $2\times10^{-5}$ mol/l of $K_3IrCl_6$ were added by the control double jet method over 6 minutes and 30 seconds while pAg was maintained at 7.7. Then, 476 ml of an aqueous solution containing silver nitrate (55.5 g) and an aqueous halogen salt solution containing 1 mol/l of potassium bromide and $2\times10^{-5}$ mol/l of $K_3IrCl_6$ were added by the control double jet method over 28 minutes and 30 seconds while pAg was maintained at 7.7. Then, the pH was lowered to cause coagulation precipitation to thereby effect desalting, Compound A (0.17 g) and low molecular weight gelatin having an average molecular weight of 15,000 (calcium content: 20 ppm or less, 51.1 g) were added, and pH and pAg were adjusted to 5.9 and 8.0, respectively. The grains obtained were cubic grains having an average grain size of 0.08 $\mu$m, a variation coefficient of projected area of 9% and a [100] face ratio of 90%.

The temperature of the silver halide grains obtained as described above was raised to 60° C., and added with sodium benzenethiosulfonate (76 $\mu$mol per mole of silver). After 3 minutes, triethylthiourea (71 $\mu$mol) was further added, then the grains were ripened for 100 minutes, added with $5\times10^{-4}$ mol/l of 4-hydroxy-6-methyl-1,3,3a,7-tetrazaindene, and cooled to 40° C.

Then, Sensitization Dye A and Compound B mentioned below were added in amounts of $12.8\times10^{-4}$ mol and $6.4\times10^{-3}$ mol per mole of silver halide with stirring while the emulsion was maintained at 40° C. After 20 minutes, the emulsion was quenched to 30° C. to complete the preparation of Silver halide emulsion A.

Sensitization Dye A

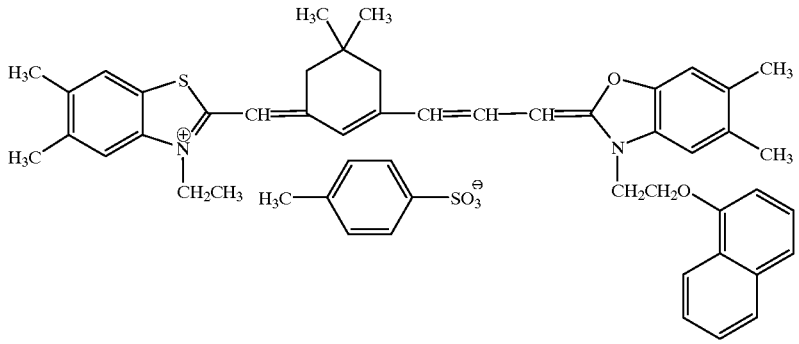

Compound A

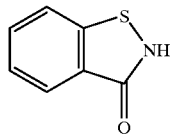

Compound B

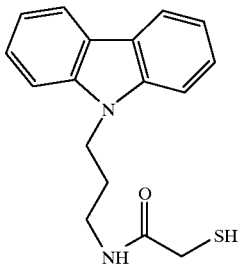

<<Preparation of Organic Acid Silver Salt Dispersion>>

Behenic acid (87.6 g, product name: Edenor C22-85R, Henkel Corp.), distilled water (423 ml), 5 N NaOH aqueous solution (49.2 ml) and tert-butyl alcohol (120 ml) were mixed and allowed to react at 75° C. for 1 hour with stirring to prepare a sodium behenate solution. Separately, an aqueous solution (206.2 ml) of silver nitrate (40.4 g) was prepared and maintained at 10° C. A reaction vessel containing distilled water (635 ml) and tert-butyl alcohol (30 ml) were maintained at 30° C., and added with the whole volumes of the sodium behenate solution and the aqueous silver nitrate solution at constant flow rates over 62 minutes and 10 seconds, and 60 minutes, respectively. This operation was designed so that only the aqueous silver nitrate solution should be added for 7 minutes and 20 seconds after starting the addition of the aqueous silver nitrate solution. Then, addition of the sodium behenate solution was started so that only the sodium behenate solution should be added for 9 minutes and 30 seconds after the completion of the addition of the aqueous silver nitrate solution. During this procedure, the internal temperature of the reaction vessel was maintained to be 30° C., and controlled so that the mixture temperature should not be raised. Piping of the sodium behenate solution addition system was warmed by a steam tracing, and steam amount was controlled so that the solution temperature at the outlet of addition nozzle tip should be 75° C. Further, piping of the aqueous silver nitrate solution addition system consisted of a double pipe system, and was cooled by circulating cooled water between the inner pipe and the outer pipe. The addition points of the sodium behenate solution and the aqueous silver nitrate solution were symmetrically located with respect to a stirring axis, and the heights thereof were controlled so as not to contact with the reaction mixture.

After the completion of the addition of the sodium behenate solution, the mixture was left at that temperature for 20 minutes with stirring so that the temperature of the mixture was lowered to 25° C. Thereafter, the solid content was separated by suction filtration, and washed with water until the conductivity of the filtrate became 30 $\mu$S/cm. The solid content obtained as described above was not dried but stored as a wet cake.

The shape of the obtained silver behenate grains was analyzed by electron microphotography. The obtained grains were scale crystals having an average projected area diameter of 0.52 $\mu$m, an average grain thickness of 0.14 $\mu$m, and an average spherical diameter variation coefficient of 15%.

Then, a silver behenate dispersion was produced as follows. To the wet cake corresponding to 100 g of dry solid content, 7.4 g of polyvinyl alcohol (trade name: PVA-217, average polymerization degree: about 1700) and water were added to make the total amount of 385 g, and the resulting mixture was preliminarily dispersed in a homomixer. Then, the preliminarily dispersed stock solution was treated three times in a dispersing machine (trade name: Microfluidizer M-110S-EH, manufactured by Microfluidex International Corporation, using G10Z interaction chamber) under a pressure controlled to be 1,750 kg/cm$^2$ to obtain a silver behenate dispersion. During the cooling operation, a desired dispersion temperature was established by providing coiled heat exchangers fixed before and after the interaction chamber and controlling the temperature of the refrigerant.

The silver behenate grains contained in the silver behenate dispersion obtained as described above were grains having a volume weighted mean diameter of 0.52 μm, and a variation coefficient of 15%. The grain size was measured by Master Sizer X manufactured by Malvern Instruments Ltd. Further, when the grains were evaluated by electron microphotography, they were grains having a ratio of long axis length and short axis length of 1.5, a grain thickness of 0.14 μm, and an average aspect ratio (ratio of circular diameter of projected area of grain and grain thickness) of 5.1.

<<Preparation of Solid Fine Grain Dispersion of Reducing Agent: 1,1-bis(2-hydroxy-3,5-dimethylphenyl)-3,5,5-trimethylhexane>>

To 1,1-bis(2-hydroxy-3,5-dimethylphenyl)-3,5,5-trimethylhexane (25 g), a 20 wt % aqueous solution of MP Polymer (25 g, MP-203, produced by Kuraray Co., Ltd.), Safinol 104E (Nisshin Kagaku Co., Ltd., 0.1 g), methanol (2 g) and water (48 ml) were added, and the mixture was thoroughly stirred to form a slurry. The resulting slurry was left for 3 hours. Then, 1-mm zirconia beads (360 g) were prepared and put together with the slurry into a vessel. The contents in the vessel were dispersed in a dispersing machine (¼G Sand Grinder Mill, manufactured by Imex) for 3 hours to prepare a solid fine grain dispersion of reducing agent. In this dispersion, 80 wt % of the grains had a particle size of from 0.3 to 1.0 μm.

<<Preparation of Solid Fine Grain Dispersion of Polyhalogenated Compound>>

Polyhalogenated compound-A (30 g) was added with MP Polymer (4.0 g, MP-203, produced by Kuraray Co., Ltd.), Compound C (0.25 g) and water (66 g), and the mixture was thoroughly stirred to form a slurry. Then, 0.5-mm zirconia silicate beads (200 g) were prepared and put together with the slurry into a vessel. The contents in the vessel were dispersed in a dispersing machine (1/16G Sand Grinder Mill, manufactured by Imex) for 5 hours to prepare a solid fine grain dispersion. In this dispersion, 80 wt % of the grains had a particle size of from 0.3 to 1.0 μm.

A solid fine grain dispersion of Polyhalogenated compound-B was also prepared in the same manner as that for Polyhalogenated compound-A. The grains in this dispersion had a similar grain size.

<<Preparation of Solid Fine Grain Dispersion of Nucleating Agent>>

Each nucleating agent shown in Table 6 (10 g) was added with polyvinyl alcohol (2.5 g, PVA-217, produced by Kuraray Co., Ltd.) and water (87.5 g), and the mixture was thoroughly stirred to form a slurry. The slurry was left for 3 hours. Then, 0.5-mm zirconia beads (240 g) were prepared and put together with the slurry into a vessel. The contents in the vessel were dispersed in a dispersing machine (¼G Sand Grinder Mill, manufactured by Imex) for 10 hours to prepare a solid fine grain dispersion. In this dispersion, 80 wt % of the grain had a particle size of from 0.1 to 1.0 μm, and the average grain size was 0.5 μm.

<<Preparation of Solid Fine Grain Dispersion of Compound Z>>

Compound Z (30 g) was added with MP Polymer (3 g, MP-203, produced by Kuraray Co., Ltd.) and water (87 ml), and the mixture was thoroughly stirred to form a slurry. The slurry was left for 3 hours. Then, a solid fine grain dispersion of Compound Z was prepared in the same manner as that used for the preparation of the solid fine grain dispersion of reducing agent. In this dispersion, 80 wt % of the grains had a particle size of from 0.3 to 1.0 μm.

<<Preparation of Coating Solution for Emulsion Layer>>

The binder, raw materials shown below and Silver halide emulsion A were added to the organic acid silver microcrystal dispersion prepared above in the indicated amounts per one mole of silver in the dispersion, and water was added to the mixture to form a coating solution for emulsion layer.

| | |
|---|---|
| Binder: LACSTAR 3307B (SBR latex, produced by Dai-Nippon Ink & Chemicals, Inc., glass transition temperature: 17° C.) | 397 g as solid |
| 1,1-Bis(2-hydroxy-3,5-dimethyl-phenyl)-3,5,5-trimethylhexane | 149 g as solid |
| Polyhalogenated compound-A | 0.06 mol as solid |
| Nucleating agent | Type and amount (mol) shown in Table 6 |
| Organic polyhalogenated compound of the formula (1) | Type and amount (mol) shown in Table 6 |
| Polyhalogenated compound-B | Amount (mol) as solid shown in Table 6 |
| Sodium ethylthiosulfonate | 0.30 g |
| Benzotriazole | 1.04 g |
| Polyvinyl alcohol (PVA235, produced by Kuraray Co., Ltd.) | 10.8 g |
| 6-iso-Propylphthalazine | 15.0 g |
| Sodium o-dihydrogenphosphate dihydrate | 0.37 g |
| Compound Z | 9.7 g as solid |
| Dye A | Amount affording optical density of 0.3 at 783 nm (about 0.37 g) |
| Silver halide emulsion A | 0.06 mol as Ag |

Polyhalogenated compound A

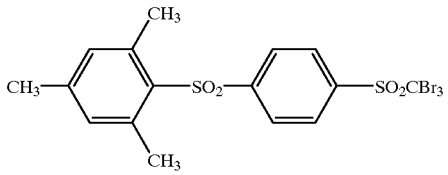

Polyhalogenated compound B

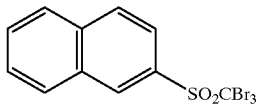

Compound Z

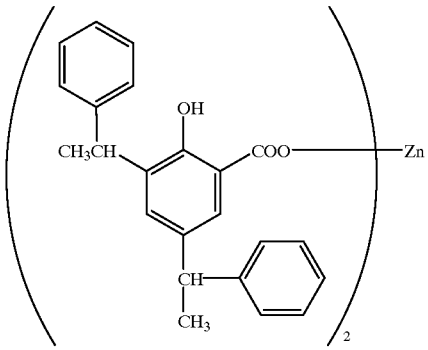

Dye A

-continued

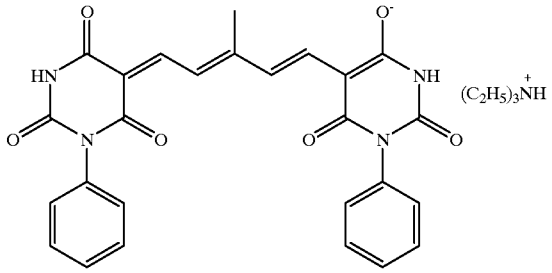

Compound C

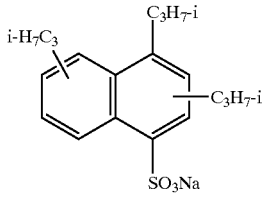

<<Preparation of Coating Solution for Lower Protective Layer for Emulsion Layer Surface>>

A polymer latex containing copolymer of methyl methacrylate/styrene/2-ethylhexyl acrylate/2-hydroxyethyl methacrylate/acrylic acid=58.9/8.6/25.4/5.1/2 (wt %) (glass transition temperature: 57° C., solid content: 21.5 wt %, average particle diameter: 120 nm, containing Compound D as a film-forming aid in an amount of 15 wt % relative to solid content of the latex)(956 g) was added with $H_2O$, Compound E (1.62 g), matting agent (polystyrene particles, average diameter: 7 μm, 1.98 g) and polyvinyl alcohol (PVA-235, Kuraray Co., Ltd., 23.6 g) and further added with $H_2O$ to form a coating solution.

<<Preparation of Coating Solution for Upper Protective Layer for Emulsion Layer Surface>>

A polymer latex containing copolymer of methyl methacrylate/styrene/2-ethylhexyl acrylate/2-hydroxyethyl methacrylate/acrylic acid=58.9/8.6/25.4/5.1/2 (wt %) (glass transition temperature: 54° C., solid content: 21.5 wt %, average particle diameter: 70 nm, containing Compound D as a film-forming aid in an amount of 15 wt % relative to solid content of the latex, 630 g) was added with $H_2O$, 30 wt % solution of carnauba wax (Cellosol 524, Chukyo Yushi Co., Ltd., 6.30 g), Compound E (0.72 g), Compound F (7.95 g), Compound (S-1) (0.01 mol), matting agent (polystyrene particles, average diameter: 7 μm, 1.18 g) and polyvinyl alcohol (PVA-235, Kuraray Co., Ltd., 8.30 g) and further added with $H_2O$ to form a coating solution.

Compound D

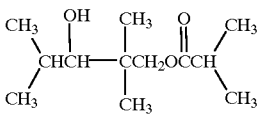

Compound E

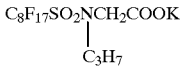

-continued

Compound F

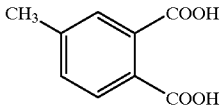

Compound S-1

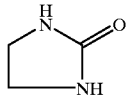

<<Preparation of PET Support with Backing Layer and Undercoat Layer>>

(1) Support

PET having IV (intrinsic viscosity) of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours, melted at 300° C., then extruded from a T-die and rapidly cooled to form an unstretched film having a thickness of 120 μm after thermal fixation.

The film was stretched along the longitudinal direction by 3.3 times using rollers of different peripheral speeds, and then stretched along the transverse direction by 4.5 times using a tenter. The temperatures used for these operations were 110° C. and 130° C., respectively. Then,the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$. Thus, a roll of a film having a width of 2.4 m, length of 3500 m, and thickness of 120 μm was obtained.

| | |
|---|---|
| (2) Undercoat layer (a) | |
| Polymer latex (1) (core shell type latex comprising 90 wt % of core and 10 wt % of shell, core: vinylidene chloride/methyl acrylate/methyl methacrylate/acrylonitrile/acrylic acid = 93/3/3/0.9/0.1 (wt %), shell: vinylidene chloride/methyl acrylate/methyl methacrylate/acrylonitrile/acrylic acid = 88/3/3/3/3 (wt %), weight average molecular weight; 38000) | 3.0 g/m$^2$ as solid content |
| 2,4-Dichloro-6-hydroxy-s-triazine | 23 mg/m$^2$ |
| Matting agent (polystyrene, average diameter; 2.4 μm) | 1.5 mg/m$^2$ |
| (3) Undercoat layer (b) | |
| Deionized gelatin ($Ca^{2+}$ content; 0.6 ppm, jelly strength; 230 g) | 50 mg/m$^2$ |
| (4) Electroconductive layer | |
| Julimer ET-410 (Nihon Junyaku Co., Ltd.) | 96 mg/m$^2$ |
| Alkali-treated gelatin (molecular weight; about 10000, $Ca^{2+}$ content; 30 ppm) | 42 mg/m$^2$ |
| Deionized gelatin ($Ca^{2+}$ content; 0.6 ppm) | 8 mg/m$^2$ |
| Compound A | 0.2 mg/m$^2$ |
| Polyoxyethylene phenyl ether | 10 mg/m$^2$ |
| Sumitex Resin M-3 (water-soluble melamine resin, Sumitomo Chemical Co., Ltd.) | 18 mg/m$^2$ |

-continued

| Dye A | Amount affording optical density of 1.2 at 783 nm |
|---|---|
| $SnO_2$/Sb (weight ratio: 9/1, acicular grains, long axis/short axis = 20–30, Ishihara Sangyo Kaisha, Ltd.) | 160 mg/m$^2$ |
| Matting agent (Polymethyl methacrylate, average particle size: 5 μm) | 7 mg/m$^2$ |
| (5) Protective layer | |
| Polymer latex (2) (copolymer of methyl methacrylate/styrene/2-ethylhexyl acrylate/2-hydroxyethylethyl methacrylate/acrylic acid = 59/9/26/5/1 (% by weight)) | 1000 mg/m$^2$ as solid |
| Polystyrenesulfonate (molecular weight: 1000–5000) | 2.6 mg/m$^2$ |
| Cellosol 524 (Chukyo Yushi Co., Ltd.) | 25 mg/m$^2$ |
| Sumitex Resin M-3 (water-soluble melamine compound, Sumitomo Chemical Co., Ltd.) | 218 mg/m$^2$ |

(6) Preparation of PET Support with Backing Layer and Undercoat Layer

Undercoat layer (a) and Undercoat layer (b) were applied successively on both sides of the support (base), and each dried at 180° C. for 4 minutes. Then, an electroconductive layer and a protective layer are successively applied to one side provided with Undercoat layer (a) and Undercoat layer (b), and each dried at 180° C. for 4 minutes to prepare PET Support having backing layers and undercoat layers. The dry thickness of Undercoat layer (a) was 2.0 μm.

(7) Heat Treatment During Transportation (7-1) Heat Treatment

The PET support with backing layers and undercoat layers prepared as described above was introduced into a heat treatment zone having a total length of 200 m set at 160° C., and transported at a tension of 3 kg/cm$^2$ and a transportation speed of 20 m/minute.

(7-2) Post-heat Treatment

Following the aforementioned heat treatment, the support was passed through a zone at 40° C. for 15 seconds, and rolled up. The rolling up tension for this operation was 10 kg/cm$^2$.

Compound A

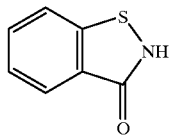

Dye A

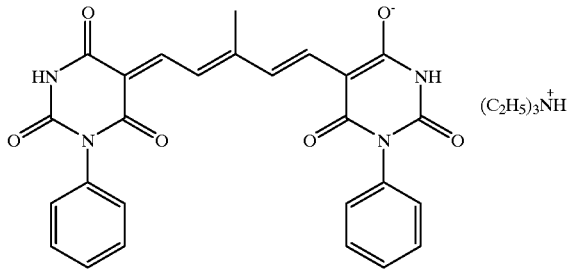

<<Preparation of Heat-developable Photosensitive Material>>

On the undercoat layers of the aforementioned PET support coated with Undercoat layer (a) and Undercoat layer (b), the coating solution for emulsion layer was coated so that the coated silver amount should be 1.6 g/m$^2$. Further, the coating solution for lower protective layer for emulsion surface was coated on the emulsion layer simultaneously with the coating solution for emulsion layer as laminated layers, so that the coated solid content of the polymer should be 1.31 g/m$^2$. Then, the coating solution for upper protective layer for emulsion surface was coated on the coated layer, so that the coated solid content of the polymer latex should be 3.02 g/m$^2$ to obtain a heat-developable photosensitive material. The film surface pH of the obtained heat-developable photosensitive material on the image-forming layer side was 4.9, and the Beck's smoothness was 660 seconds. As for the opposite surface, the film surface pH was 5.9 and the Beck's smoothness was 560 seconds.

<<Evaluation of Photographic Performance>>

(Light Exposure)

The obtained heat-developable photosensitive material was light exposed for $2\times10^{-8}$ seconds by using a laser light-exposure apparatus of single channel cylindrical inner surface type provided with a semiconductor laser with a beam diameter (1/2 of FWHM of beam intensity) of 12.56 μm, laser output of 50 mW and output wavelength of 783 nm. The exposure time was adjusted by controlling the mirror revolution number, and exposure was adjusted by changing output. The overlap coefficient of the light exposure was 0.449.

(Heat Development)

Each light-exposed heat-developable photosensitive material was heat-developed by using a heat-developing apparatus as shown in FIG. 1, in which 3 pairs of metallic rollers/silicone rubber rollers in the preheating section A were increased to 6 pairs, while the roller temperature of the preheating section A was adjusted to each value shown in Table 5. The roller surface material of the heat development section was composed of silicone rubber, and the flat surface consisted of Teflon non-woven fabric. The heat development was performed at a transportation linear speed of 20 mm/second in the preheating section for 18 seconds (Driving units of the preheating section and the heat development section were independent from each other, and speed difference as to the heat development section was adjusted to −0.5% to −1%. Temperatures of the metallic rollers and processing times for each preheating are shown in Table 5), in the heat development section at 119° C. (surface temperature of heat-developable photosensitive material) for 17 seconds, and in the gradual cooling section for 20 seconds (cooled from 119° C. to 70° C. over 20 seconds). The temperature precision as for the transverse direction was ±1° C. As for each heating temperature, the temperature precision was secured by extending the width of the heat-developable photosensitive material by 5 cm for the both sides (for example, width of 61 cm) and heating also the extended portions. Since the rollers showed marked temperature decrease at the both end portions, the temperature of the end portions was controlled to be higher than that of the roller center by 1–3° C., so that uniform image density of a developed image should be obtained in the whole heat-developable photosensitive material surface (for example, within a width of 61 cm). The temperature of the sixth roller of the preheating section was adjusted to the same temperature as the heat development temperature.

(Evaluation of Photographic Performance)

The aforementioned light exposure and heat development were performed in two kinds of environments, at 25° C., 20% RH and at 25° C., 75% RH. The heat-developable photosensitive material was left in each environment for 16 hours or more so that moisture content of the heat-developable photosensitive material should equilibrate at a constant level in each environment, and then subjected to the light exposure and heat development.

The obtained image was evaluated by Macbeth TD904 densitometer (visible density). The measurement results were evaluated as Dmin (fog), Dmax (maximum density), sensitivity (evaluated as a reciprocal of the ratio of the exposure amount giving a density 1.0 higher than Dmin, and expressed as a relative value of sensitivity resulting from the light exposure and heat development at 25° C., 75% RH with respect to the sensitivity resulting from the light exposure and heat development at 25° C., 20% RH that was taken as 100). A smaller difference of Dmax between those obtained from the treatments under the two kinds of environments and sensitivity closer to 100 mean a better image-forming method.

The results of the above evaluation for each heat-developable photosensitive material are shown in Table 6.

TABLE 5

| Image-forming | Set temperature (° C.) of rollers and time (second) in preheating section | | | | | | | | | | | |
|---|---|---|---|---|---|---|---|---|---|---|---|---|
| | First roller | | Second roller | | Third roller | | Fourth roller | | Fifth roller | | Sixth roller | |
| method | Temperature | Time | Temperature | Time | Temperature | Time | Temperature | Time | Temperature | Time | Temperature | Time |
| 401 (Invention) | 40 | 3 | 40 | 3 | 40 | 3 | 109 | 3 | 115 | 3 | 119 | 3 |
| 402 (Invention) | 65 | 3 | 78 | 3 | 95 | 3 | 109 | 3 | 115 | 3 | 119 | 3 |
| 403 (Invention) | 40 | 3 | 40 | 3 | 110 | 3 | 109 | 3 | 110 | 3 | 119 | 3 |
| 404 | 65 | 3 | 78 | 3 | 95 | 3 | 109 | 3 | 115 | 3 | 119 | |
| 405 | 65 | 3 | 78 | 3 | 95 | 3 | 109 | 3 | 115 | 3 | 119 | 3 |
| 406 (Invention) | 65 | 3 | 78 | 3 | 95 | 3 | 109 | 3 | 115 | 3 | 119 | 3 |
| 407 (Invention) | 65 | 3 | 78 | 3 | 95 | 3 | 109 | 3 | 115 | 3 | 119 | 3 |
| 408 (Invention) | 65 | 3 | 78 | 3 | 95 | 3 | 109 | 3 | 115 | 3 | 119 | 3 |
| 409 (Invention) | 65 | 3 | 78 | 3 | 95 | 3 | 109 | 3 | 115 | 3 | 119 | 3 |
| 410 (Invention) | 65 | 3 | 78 | 3 | 95 | 3 | 109 | 3 | 115 | 3 | 119 | 3 |
| 411 | 65 | 3 | 78 | 3 | 95 | 3 | 109 | 3 | 115 | 3 | 119 | 3 |
| 412 (Invention) | 65 | 3 | 78 | 3 | 95 | 3 | 109 | 3 | 115 | 3 | 119 | 3 |
| 413 | 65 | 3 | 78 | 3 | 95 | 3 | 109 | 3 | 115 | 3 | 119 | 3 |
| 414 | 40 | 3 | 40 | 3 | 40 | 3 | 40 | 3 | 40 | 3 | 119 | 3 |

TABLE 6

| Image-forming | Heat-developable photosensitive material | | | | | Photographic performance | | | | |
|---|---|---|---|---|---|---|---|---|---|---|
| | Nucleating agent | | Compound of formula (1) | | Polyhalogenated compound-B | Treatment at 25° C., 20% RH | | Treatment at 25° C., 75% RH | | Sensitivity after treatment at 25° C. |
| method | Type | Addition amount (mol) | Type | Addition amount (mol) | Addition amount (mol) | Dmin | Dmax | Dmin | Dmax | 75% RH ** |
| 401 (Invention) | C-62 | $3 \times 10^{-2}$ | P-82 | 0.02 | — | 0.12 | 4.0 | 0.12 | 4.2 | 120 |
| 402 (Invention) | C-62 | $3 \times 10^{-2}$ | P-82 | 0.02 | — | 0.12 | 4.1 | 0.12 | 4.2 | 112 |
| 403 (Invention) | C-62 | $3 \times 10^{-2}$ | P-82 | 0.02 | — | 0.12 | 4.1 | 0.12 | 4.2 | 107 |
| 404 | C-62 | $3 \times 10^{-2}$ | — | — | 0.02 | 0.13 | 4.0 | 0.15 | 4.2 | 191 |
| 405 | C-62 | $3 \times 10^{-2}$ | — | — | 0.04 | 0.13 | 3.7 | 0.14 | 4.1 | 180 |
| 406 (Invention) | C-62 | $3 \times 10^{-2}$ | P-62 | 0.02 | — | 0.12 | 4.0 | 0.12 | 4.1 | 116 |
| 407 (Invention) | C-62 | $3 \times 10^{-2}$ | P-60 | 0.02 | — | 0.12 | 4.1 | 0.12 | 4.2 | 115 |
| 408 (Invention) | C-62 | $3 \times 10^{-2}$ | P-65 | 0.02 | — | 0.12 | 4.1 | 0.12 | 4.2 | 112 |
| 409 (Invention) | C-1 | $1 \times 10^{-2}$ | P-60 | 0.02 | — | 0.12 | 4.0 | 0.12 | 4.2 | 118 |
| 410 (Invention) | C-8 | $1 \times 10^{-2}$ | P-60 | 0.02 | — | 0.12 | 3.9 | 0.12 | 4.1 | 115 |
| 411 | C-62 | $3 \times 10^{-2}$ | — | — | — | 0.12 | 4.0 | 0.13 | 4.3 | 209 |
| 412 (Invention) | H-1* | $1 \times 10^{-2}$ | P-60 | 0.02 | — | 0.13 | 3.8 | 0.14 | 4.2 | 125 |
| 413 | — | — | — | — | — | 0.12 | 1.5 | 0.12 | 1.6 | 110 |
| 414 | — | — | — | — | — | 0.12 | 1.5 | 0.12 | 1.6 | 112 |

*H-1: N-(2-methoxyphenyl)-N'-formylhydrazine

**Relative sensitivity to the sensitivity obtained from the treatment at 25° C., 20% RH that is taken as 100. (Values nearer 100 indicate smaller sensitivity fluctuation in environmental humidity.)

From the results shown in Tables 5 and 6, it can be seen that good performance could be obtained in the image-forming method for heat-developable photosensitive material according to the present invention, including low Dmin (fog), small Dmax and sensitivity fluctuations caused by environmental humidity variation. Further, comparison of the results of Image-forming method 411 and Image-forming methods 413 and 414 revealed that the sensitivity fluctuation and Dmax fluctuation due to environmental humidity was a phenomenon caused by addition of a nucleating agent.

Example 5

Heat-developable photosensitive materials were prepared and evaluated in the same manner as in Example 4 as follows.

<<Preparation of Silver Halide Emulsion>>

(Emulsion A)

Silver halide emulsion A was prepared in the same manner as in Example 4.

<<Preparation of Organic Silver Salt Dispersion>>

A silver behenate dispersion was prepared in the same manner as in Example 4.

<<Preparation of Solid Fine Grain Dispersion of Reducing Agent: 1,1-bis(2-hydroxy-3,5-dimethylphenyl)-3,5,5-trimethylhexane>

A solid fine grain dispersion of reducing agent was prepared in the same manner as in Example 4.

<<Preparation of Solid Fine Grain Dispersion of Polyhalogenated Compound>>

Solid fine grain dispersions of Polyhalogenated compound-A and Polyhalogenated compound-B were each prepared in the same manner as in Example 4.

<<Preparation of Solid Fine Grain Dispersion of Nucleating Agent>>

A solid fine grain dispersion was prepared for each nucleating agent mentioned in Table 7 in the same manner as in Example 4.

<<Preparation of Solid Fine Grain Dispersion of Compound Z>>

A solid fine grain dispersion of Compound Z was prepared in the same manner as in Example 4.

<<Preparation of Coating Solution for Emulsion Layer>>

The binder, raw materials shown below and Silver halide emulsion A were added to the organic acid silver microcrystal dispersion prepared above in the indicated amounts per one mole of silver in the dispersion, and water was added to the mixture to form a coating solution for emulsion layer.

| | |
|---|---|
| Binder: LACSTAR 3307B (SBR latex, produced by Dai-Nippon Ink & Chemicals, Inc., glass transition temperature: 17° C.) | 397 g as solid |
| 1,1-Bis(2-hydroxy-3,5-dimethylphenyl)-3,5,5-trimethylhexane | 149 g as solid |
| Polyhalogenated compound-A | 0.06 mol as solid |
| Nucleating agent | Type and amount (mol) shown in Table 7 |
| Organic polyhalogenated compound of the formula (1) | Type and amount (mol) shown in Table 7 |
| Polyhalogenated compound-B | Amount (mol) as solid shown in Table 7 |
| Sodium ethylthiosulfonate | 0.30 g |
| Benzotriazole | 1.04 g |
| Polyvinyl alcohol (PVA235, produced by Kuraray Co., Ltd.) | 10.8 g |
| 6-iso-Propylphthalazine | 15.0 g |

-continued

| | |
|---|---|
| Sodium o-dihydrogenphosphate dihydrate | 0.37 g |
| Compound Z | 9.7 g as solid |
| Dye A | Amount affording optical density of 0.3 at 783 nm (about 0.37 g) |
| Silver halide emulsion A | 0.06 mol as Ag |

<<Preparation of Coating Solution for Lower Protective Layer for Emulsion Layer Surface>>

Each coating solution for lower protective layer for emulsion layer surface was prepared in the same manner as in Example 4 except that Compound of the formula (S) was optionally added as shown in Table 7.

<<Preparation of Coating Solution for Upper Protective Layer for Emulsion Layer Surface>>

Each coating solution for upper protective layer for emulsion layer surface was prepared in the same manner as in Example 4 except that Compound (S-1) was used as shown in Table 7.

<<Preparation of PET Support with Backing Layer and Undercoat Layer>>

A PET support with backing layers and undercoat layers was prepared and subjected to heat treatment during transportation in the same manner as in Example 4.

<<Preparation of Heat-developable Photosensitive Material>>

Each heat-developable photosensitive material was prepared in the same manner as in Example 4 (Table 7). The obtained heat-developable photosensitive material showed the same film surface pH and Beck's smoothness as those obtained in Example 4.

<<Evaluation of Photographic Performance>>

(Light Exposure)

Light exposure was conducted in the same manner as in Example 4.

(Heat Development)

Each light-exposed heat-developable photosensitive material was heat-developed by using a heat-developing apparatus as shown in FIG. 1, in which the roller surface material was composed of silicone rubber, and the flat surface consisted of Teflon non-woven fabric. The heat development was performed at a transportation linear speed of 20 mm/second in the preheating section at 90–110° C. for 15seconds (driving units of the preheating section and heat development section were independent from each other, and speed difference as to the heat development section was adjusted to −0.5 to −1%), in the heat development section at 120° C. for 20 seconds and in the gradual cooling section for 15 seconds. The temperature precision as for the transverse direction was ±1° C.

(Evaluation of Photographic Performance)

The obtained image was evaluated by Macbeth TD904 densitometer (visible density). The measurement results were evaluated as Dmin, sensitivity (a reciprocal of the ratio of the exposure amount necessary for giving a density 1.0 higher than Dmin, expressed as a relative value to the sensitivity of Heat-developable photosensitive material 504 mentioned in Table 7 that was taken as 100), Dmax and γ (contrast). γ was expressed by a gradient of a straight line connecting the points at densities of 0.2 and 2.5, with the abscissa being a logarithm of the exposure amount. For evaluation of storability, moisture of each heat-developable material was conditioned at 25° C., 30% RH, and the material was cut into sheets to prepare a stack of three sheets, and introduced into a moisture-proof bag. It was stored at 40° C. for 20 days, and then the center sheet (second sheet) of three was subjected to light exposure and heat development as described above, and evaluated for Dmin, sensitivity, Dmax and γ (contrast). Further, the heat-developable photosensitive material after coating was left in the dark at 50° C. in a humidity of 75% RH, which was established with steam, for 3 days. Then, it was subjected to light exposure and heat development as described above, and evaluated for Dmin, sensitivity, Dmax and γ (contrast).

The results of the above evaluation for each heat-developable photosensitive material are shown in Table 8.

TABLE 7

| Heat-developable photosensitive material | Compound of formula (S) | | | Nucleating agent | | Compound of formula (1) | | Added amount of |
|---|---|---|---|---|---|---|---|---|
| | Added layer | Type | Added amount (mol) | Type | Added amount (mol) | Type | Added amount (mol) | Polyhalogenated compound-B (mol) |
| 501 | Upper protective layer | S-1 | $1 \times 10^{-2}$ | — | — | — | — | — |
| 502 | Upper protective layer | S-1 | $1 \times 10^{-2}$ | — | — | — | — | 0.02 |
| 503 (Invention) | Upper protective layer | S-1 | $1 \times 10^{-2}$ | — | — | P-82 | 0.02 | — |
| 504 | — | — | | C-62 | $3 \times 10^{-2}$ | — | — | — |
| 505 | Upper protective layer | S-1 | $1 \times 10^{-2}$ | C-62 | $3 \times 10^{-2}$ | — | — | |
| 506 | Upper protective layer | S-1 | $1 \times 10^{-2}$ | C-62 | $3 \times 10^{-2}$ | — | — | 0.02 |
| 507 | Upper protective layer | S-1 | $1 \times 10^{-2}$ | C-62 | $3 \times 10^{-2}$ | — | — | 0.04 |
| 508 (Invention) | Upper protective layer | S-1 | $1 \times 10^{-2}$ | C-62 | $3 \times 10^{-2}$ | P-82 | 0.02 | — |
| 509 (Invention) | — | — | | C-62 | $3 \times 10^{-2}$ | P-82 | 0.02 | — |
| 510 (Invention) | Upper protective layer | S-2 | $1 \times 10^{-2}$ | C-62 | $3 \times 10^{-2}$ | P-82 | 0.02 | — |
| 511 (Invention) | Upper protective layer | S-14 | $1 \times 10^{-2}$ | C-62 | $3 \times 10^{-2}$ | P-82 | 0.02 | — |
| 512 (Invention) | Upper protective layer | S-1 | $1 \times 10^{-2}$ | C-62 | $3 \times 10^{-2}$ | P-62 | 0.02 | — |
| 513 (Invention) | Upper protective layer | S-1 | $1 \times 10^{-2}$ | C-62 | $3 \times 10^{-2}$ | P-61 | 0.02 | — |
| 514 (Invention) | Upper protective layer | S-1 | $1 \times 10^{-2}$ | C-62 | $3 \times 10^{-2}$ | P-65 | 0.02 | — |
| 515 (Invention) | Upper protective layer | S-1 | $2 \times 10^{-2}$ | C-62 | $3 \times 10^{-2}$ | P-61 | 0.02 | — |
| 516 (Invention) | Upper protective layer | S-1 | $4 \times 10^{-2}$ | C-62 | $3 \times 10^{-2}$ | P-61 | 0.02 | — |
| 517 (Invention) | Upper protective layer | S-1 | $4 \times 10^{-2}$ | C-62 | $3 \times 10^{-2}$ | P-61 | 0.013 | — |
| 518 (Invention) | Lower protective layer | S-1 | $1 \times 10^{-2}$ | C-62 | $3 \times 10^{-2}$ | P-61 | 0.02 | — |
| 519 (Invention) | Lower protective layer | S-1 | $1 \times 10^{-2}$ | C-1 | $1 \times 10^{-2}$ | P-61 | 0.02 | — |
| 520 (Invention) | Lower protective layer | S-1 | $1 \times 10^{-2}$ | C-8 | $1 \times 10^{-2}$ | P-61 | 0.02 | — |
| 521 (Invention) | Lower protective layer | S-1 | $1 \times 10^{-2}$ | H-1* | $1 \times 10^{-2}$ | P-61 | 0.02 | — |

* H-1: N-(2-methoxyphenyl )-N'-formylhydrazine

TABLE 8

| Heat-developable photosensitive material | Performance before time lapse (fresh) | | | | Storability after 20 days at 40° C. (controlled humidity at 30% RH) | | | | Performance after 3 days at 50° C., 75% RH | | | |
|---|---|---|---|---|---|---|---|---|---|---|---|---|
| | Dmin | Dmax | Sensitivity | γ (contrast) | Dmin | Dmin | Sensitivity | γ (contrast) | Dimin | Dmax | Sensitivity | γ (contrast) |
| 501 | 0.13 | 1.5 | 55 | Not determinable | 0.16 | 1.5 | 39 | Not determinable | 0.36 | 1.5 | 66 | Not determinable |
| 502 | 0.12 | 1.5 | 54 | Not determinable | 0.15 | 1.5 | 52 | Not determinable | 0.30 | 1.5 | 62 | Not determinable |
| 503 (Invention) | 0.11 | 1.5 | 54 | Not determinable | 0.11 | 1.5 | 52 | Not determinable | 0.12 | 1.5 | 56 | Not determinable |
| 504 | 0.14 | 4.0 | 100 | 12 | 0.32 | 4.2 | 209 | 4 | 0.53 | 4.2 | 127 | 3 |
| 505 | 0.14 | 4.0 | 98 | 12 | 0.17 | 4.2 | 110 | 11 | 0.52 | 4.2 | 125 | 4 |
| 506 | 0.13 | 4.0 | 98 | 12 | 0.15 | 4.2 | 107 | 11 | 0.36 | 4.2 | 120 | 6 |
| 507 | 0.13 | 3.9 | 82 | 10 | 0.14 | 4.1 | 92 | 9 | 0.30 | 4.1 | 100 | 6 |
| 508 (Invention) | 0.12 | 3.9 | 98 | 10 | 0.12 | 4.1 | 103 | 12 | 0.13 | 4.1 | 105 | 12 |
| 509 (Invention) | 0.12 | 3.9 | 98 | 10 | 0.28 | 4.2 | 182 | 4 | 0.13 | 4.1 | 105 | 12 |
| 510 (Invention) | 0.12 | 3.9 | 99 | 10 | 0.13 | 4.2 | 104 | 12 | 0.14 | 4.1 | 107 | 12 |
| 511 (Invention) | 0.12 | 3.9 | 98 | 11 | 0.12 | 4.1 | 103 | 11 | 0.13 | 4.1 | 105 | 11 |
| 512 (Invention) | 0.13 | 4.1 | 100 | 12 | 0.13 | 4.2 | 104 | 12 | 0.14 | 4.1 | 107 | 12 |
| 513 (Invention) | 0.12 | 4.0 | 98 | 12 | 0.12 | 4.1 | 103 | 12 | 0.13 | 4.1 | 105 | 12 |
| 514 (Invention) | 0.12 | 4.0 | 98 | 11 | 0.12 | 4.1 | 102 | 11 | 0.13 | 4.1 | 104 | 11 |
| 515 (Invention) | 0.12 | 4.0 | 98 | 12 | 0.12 | 4.1 | 102 | 12 | 0.13 | 4.1 | 105 | 12 |
| 516 (Invention) | 0.12 | 4.0 | 98 | 12 | 0.12 | 4.1 | 103 | 12 | 0.13 | 4.1 | 105 | 12 |
| 517 (Invention) | 0.13 | 4.0 | 100 | 12 | 0.13 | 4.1 | 105 | 12 | 0.14 | 4.1 | 107 | 11 |
| 518 (Invention) | 0.12 | 4.0 | 98 | 12 | 0.12 | 4.1 | 103 | 12 | 0.13 | 4.1 | 105 | 12 |
| 519 (Invention) | 0.12 | 4.0 | 97 | 12 | 0.13 | 4.1 | 102 | 11 | 0.14 | 4.1 | 104 | 11 |
| 520 (Invention) | 0.12 | 3.9 | 93 | 11 | 0.13 | 4.0 | 98 | 10 | 0.14 | 4.1 | 100 | 10 |
| 521 (Invention) | 0.14 | 4.0 | 97 | 10 | 0.17 | 4.1 | 127 | 9 | 0.20 | 4.2 | 122 | 9 |

It can be seen that good performance, including low Dmin (fog), small increase of fog and small sensitivity fluctuation during storage, was obtained in the heat-developable photosensitive materials of the present invention. Further, it can also be seen that images having high Dmax could be obtained by using a nucleating agent, and even in such a case, fog and sensitivity fluctuations could be reduced in the heat-developable photosensitive materials of the present invention. It can further be seen that the use of the compounds of the formulas (1) to (3), which are preferably used in the present invention, afforded more excellent improvement of fog and sensitivity fluctuations compared with use of the formylhydrazine compound. From the above, the advantages of the present invention were clearly demonstrated.

Example 6

Heat-developable photosensitive materials 504 (Comparative) and 508 (Invention) mentioned in Example 5 were packaged according to the roll packaging disclosed in JP-A-6-214350 to obtain light-shielded roll packages (package form of completed products) of a material having a width of 61 cm and a length of 59 m.

The humidity in these packages in the package form of completed products was estimated to be 25% RH based on the moisture content of the heat-developable photosensitive materials.

The storability test was performed for these packages in the package form of completed products at 50° C. for 3 days and at 40° C. for 20 days, and evaluated in the same manner as in Example 5.

The obtained results were substantially similar to the results of Example 5, and it could be confirmed that the small increase of Dmin and little sensitivity fluctuation of Heat-developable photosensitive material 508 according to the present invention could also be attained in the packaged product form. Thus, the advantages of the present invention were clearly demonstrated.

What is claimed is:

1. A heat-developable photosensitive material having at least one photosensitive image-forming layer comprising an organic silver salt, a photosensitive silver halide, a reducing agent and an organic binder, wherein at least one of the photosensitive image-forming layer and a layer adjacent to the photosensitive image-forming layer contains a first halogen-releasing precursor and a second hydrophobic halogen-releasing precursor, wherein said first halogen-releasing precursor is a compound represented by the following formula (1):

(1)

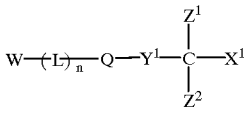

wherein, in formula (1), $Z^1$ and $Z^2$ each independently represent a halogen atom, $X^1$ represents hydrogen atom or an electron withdrawing group, Y1 represents —CO— group or —$SO^2$— group, Q represents an arylene group or a divalent heterocyclic group, L represents a linking group, W represents carboxyl group or a salt thereof, sulfo group or a salt thereof, phosphoric acid group, hydroxyl group, a quaternary ammonium group, or a polyethyleneoxy group, and n represents 0 or 1, and wherein said second halogen-releasing precursor is a compound represented by the following formula (2):

(2)

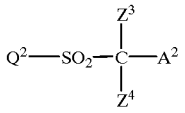

wherein, in formula (2), $Q^2$ represents an aryl group of a heterocyclic group, $Z^3$ and $Z^4$ each independently represent a halogen atom, and $A^2$ represents hydrogen atom or an electron withdrawing group.

2. The heat-developable photosensitive material according to claim 1, which is prepared by using a solution of the first halogen-releasing precursor.

3. The heat-developable photosensitive material according to claim 1, which is prepared by using a solid dispersion of the second halogen-releasing precursor.

4. The heat-developable photosensitive material according to claim 1, which is prepared by using a solution of the first halogen-releasing precursor, a solid dispersion of the second halogen-releasing precursor and a solid dispersion of the reducing agent.

5. The heat-developable photosensitive material according to claim 1, which contains the second halogen-releasing precursor inthephotosensitive image-forming layerandthe first halogen-releasing precursor in a non-image-forming layer adjacent to the photosensitive image-forming layer.

6. The heat-developable photosensitive material according to claim 1, which further contains, on the side of a support provided with the image-forming layer, at least one compound represented by the following formula (S):

(S)

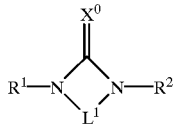

wherein, in the formula (S), $X^0$ represents oxygen atom or =NH group; $R^1$ and $R^2$ each independently represent hydrogen atom, an acyl group, a hydrocarbon group or a carbamoyl group provided that, when $X^0$ is oxygen atom, at least one of $R^1$ and $R^2$ is hydrogen atom; and $L^1$ represents a ethylene, trimethylene,

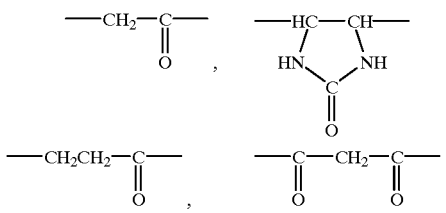

wherein $L^1$ may be substituted with a methyl group, an amino group, a ureido group, or a =$CH^2$ group.

7. The heat-developable photosensitive material according to claim 1, which further contains, on the side of a support provided with the image-forming layer, at least one nucleating agent.

8. The heat-developable photosensitive material according to claim 6, which further contains, on the side of a support provided with the image-forming layer, at least one nucleating agent.

9. The heat-developable photosensitive material according to claim 7, wherein the nucleating agent consists of one or more compounds selected from a substituted alkene derivative represented by the following formula (3), a substituted isoxazole derivative represented by the following formula (4), and a particular acetal compound represented by the following formula (5):

(3)

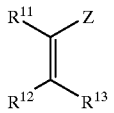

(4)

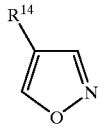

(5)

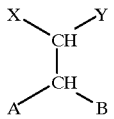

wherein, in the formula (3), $R^{11}$, $R^{12}$ and $R^{13}$ each independently represents hydrogen atom or a substituent, and Z represents an electron withdrawing group, or a silyl group, and $R^{11}$ and Z, $R^{12}$ and $R^{13}$, $R^{11}$ and $R^{12}$, or $R^{13}$ and Z may be combined with each other to form a ring structure;

in the formula (4), $R^{14}$ represents a substituent;

in the formula (5), X and Y independently represent hydrogen atom or a substituent, A and B each independently represent an alkoxy group, an alkylthio group, an alkylamino group, an aryloxy group, an arylthio group, an anilino group, a heterocyclyloxy group, a heterocyclylthio group or a heterocyclylamino group, and X and Y, or A and B may be combined with each other to form a ring structure.

10. The heat-developable photosensitive material according to claim 8, wherein the nucleating agent consists of one or more compounds selected from a substituted alkene derivative represented by the following formula (3), a substituted isoxazole derivative represented by the following formula (4), and a particular acetal compound represented by the following formula (5):

(3)

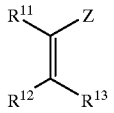

(4)

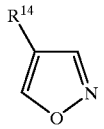

-continued (5)

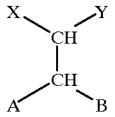

wherein, in the formula (3), $R^{11}$, $R^{12}$ and $R^{13}$ each independently represents hydrogen atom or a substituent, and Z represents an electron withdrawing group or a silyl group, and $R^{11}$ and Z, $R^{12}$ and $R^{13}$, $R^{11}$ and $R^{12}{}_1$ or $R^{13}$ and Z may be combined with each other to form a ring structure;

in the formula (4), $R^{14}$ represents a substituent;

in the formula (5), X and Y independently represent hydrogen atom or a substituent, A and B each independently represent an alkoxy group, an alkylthio group, an alkylamino group, an aryloxy group, an arylthio group, an anilino group, a heterocyclyloxy group, a heterocyclylthio group or a heterocyclylamino group, and X and Y, or A and B may be combined with each other to form a ring structure.

11. The heat-developable photosensitive material according to claim 1, which is prepared by adding the organic binder as an aqueous dispersion of a thermoplastic resin.

12. The heat-developable photosensitive material according to claim 1, wherein the organic binder comprises a latex of a polymer having a glass transition temperature of −30 to 40° C. in an amount of at least 50% by weight.

13. A method for forming an image, which comprises the steps of exposing the heat-developable photosensitive material according to claim 1 to light, heating the heat-developable photosensitive material at a temperature of 80° C. for 5 seconds or more in such a way that an image is not formed, and subjecting the head-developable photosensitive material to heat development at a temperature of 110° C. or higher to form an image.

14. A method for forming an image, which comprises the steps of exposing the heat-developable photosensitive material according to claim 7 to light, heating the heat-developable photosensitive material at a temperature of 80° C. to a temperature lower than 120° C. for 5 seconds or more in such a way that an image is not formed, and subjecting the heat-developable photosensitive material to heat development at a temperature of 110° C. or higher to form an image.

15. A method for forming an image, which comprises the steps of exposing the heat-developable photosensitive material according to claim 11 to light, heating the heat-developable photosensitive material at a temperature of 80° C. to a temperature lower than 120° C. for 5 seconds or more in such a way that an image is not formed, and subjecting the heat-developable photosensitive material to heat development at a temperature of 110° C. or higher to form an image.

* * * * *